US008292078B2

(12) United States Patent
Cook et al.

(10) Patent No.: US 8,292,078 B2
(45) Date of Patent: Oct. 23, 2012

(54) MULTI-POSITION STACKABLE CONTAINER

(75) Inventors: Alan J. Cook, Liverpool (GB); Kyle L. Baltz, Redondo Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 195 days.

(21) Appl. No.: 12/723,812

(22) Filed: Mar. 15, 2010

(65) Prior Publication Data

US 2010/0230317 A1 Sep. 16, 2010

Related U.S. Application Data

(60) Provisional application No. 61/160,104, filed on Mar. 13, 2009, provisional application No. 61/186,357, filed on Jun. 11, 2009, provisional application No. 61/255,554, filed on Oct. 28, 2009, provisional application No. 61/258,583, filed on Nov. 5, 2009, provisional application No. 61/266,901, filed on Dec. 4, 2009.

(51) Int. Cl.
*B65D 21/00* (2006.01)
*B65D 85/62* (2006.01)

(52) U.S. Cl. ..... 206/506; 206/507

(58) Field of Classification Search ..... 206/505, 206/506, 507, 511
See application file for complete search history.

(56) References Cited

U.S. PATENT DOCUMENTS

| | | | | |
|---|---|---|---|---|
| 3,379,339 | A * | 4/1968 | Asenbauer | 206/506 |
| 3,951,265 | A | 4/1976 | Carroll | |
| 4,573,577 | A | 3/1986 | Miller | |
| 7,464,817 | B2 * | 12/2008 | Raghunathan et al. | 206/506 |
| 2006/0065567 | A1 * | 3/2006 | Hassell et al. | 206/506 |
| 2006/0231449 | A1 | 10/2006 | Hassell et al. | |

FOREIGN PATENT DOCUMENTS

| | | |
|---|---|---|
| EP | 0 697 341 | 2/1996 |
| EP | 1 743 844 | 1/2007 |
| GB | 2 374 859 | 10/2002 |

OTHER PUBLICATIONS

European Search Report for EP Application No. 10156554.7, Apr. 27, 2010.

* cited by examiner

*Primary Examiner* — Harry Grosso
(74) *Attorney, Agent, or Firm* — Carlson, Gaskey & olds

(57) ABSTRACT

A container includes a base and a plurality of walls extending upward from a periphery of the base. A pair of supports are movable between a nesting position and at least one stack position. In one embodiment, the container includes projections outwardly from opposed walls that can be supported on the supports of an identical container.

26 Claims, 59 Drawing Sheets

MULTI-POSITION STACKABLE CONTAINER

This application claims priority to U.S. Provisional Application Ser. Nos. 61/160,104, filed on Mar. 13, 2009; 61/186,357, filed on Jun. 11, 2009; 61/255,554, filed on Oct. 28, 2009; 61/258,583, filed on Nov. 5, 2009; and 61/266,901, filed on Dec. 4, 2009.

BACKGROUND

Some known containers are nestable with one another when empty. Supports are pivotably connected to the side walls and movable between a home/nest position and a stack position. In the home/nest position, another container of a similar type can be nested in the container. In the stack position, another container can be stacked on the supports of the lower container.

SUMMARY

The present invention provides several embodiments and several inventive features. Generally, the container includes a base, a pair of opposed end walls and a pair of opposed side walls. A support is movable mounted to the side walls adjacent each end wall. The support is movable between a nesting position and at least one stack position.

In one feature of the present invention, the walls include contact surfaces that can be supported on an identical container at a height higher than the nesting position, but with the base of the container disposed within the plurality of walls of the identical container and below the support of the identical container. In one embodiment, the contact surfaces can be supported on the support of the identical container in the stack position. In another embodiment, the contact surfaces can be supported on contact surfaces on the walls of the identical container. The contact surfaces may be provided by projections from the walls of the container.

In one embodiment, the support is movable to a high stack position on which the base of an identical container can be supported, or a low stack position on which the contact surfaces of the identical container can be supported.

In another embodiment, the contact surfaces are configured to contact a portion of the walls of the identical container to support the container at a first height when the container is oriented in a first orientation and wherein the container can nest in the identical container in a second orientation.

In another feature of the present invention, the support is movable between a stack position and the nesting position, and an upper surface of a support portion of the support faces upward in the stack position and the nesting position. In one embodiment, the upper surface of the support portion faces upward in a high stack position, low stack position and nesting position. In another embodiment, the support portion in the high stack position and the nesting position and the support portion in the low stack position is rotated approximately 90 degrees relative to the support portion in the high stack and nesting positions.

In another feature of the present invention, the pivot pins are toward the interior of the container relative to the support portion in the high stack position, low stack position and nesting position.

In another feature of the present invention, an identical container would nest in the container when the container and identical container are in a first relative orientation, and wherein the identical container stacks on support surfaces on two of the plurality of walls of the container when the container and identical container are in a second relative orientation that is 180 degrees relative to the first orientation. Thus the movable support can provide one stacking height, and the 180 degree rotation can provide another stacking height. Two of the walls include projections outwardly therefrom, the projections of the identical container can be stacked on the support surfaces of the two of the plurality of walls. In a disclosed example, the support surfaces are provided by bottom edges of openings through the two walls.

In another feature of the present invention, the support is movable to a low stack position and a high stack position, wherein the low stack position is closer to a center of the container in the low stack position than the high stack position. In one disclosed example, an upper surface of a support portion of the support faces upwardly in the nesting position and in the high stack position.

In another feature of the present invention, the support includes a support portion extending across the container between a pair of arms movably connected to the plurality of walls, wherein the support portion includes a tapered lower surface complementary to a tapered upper surface of an upper edge of a first wall of the plurality of walls on which the support portion of the support is received in the nesting position.

In another feature of the present invention, the support includes a support portion extending across the container between a pair of arms movably connected to the plurality of walls, wherein the pair of arms are each U-shaped.

In another feature of the present invention, wherein the support includes a support portion extending across the container between a pair of arms movably connected to a pair of opposed walls of the plurality of walls, a pin projecting from each of the arms into an opening in one of the opposed walls, wherein the opening is generally horizontal.

It should be noted that many of the features can be practiced independently from one another. Also, many of the features can be practiced in different combinations with one another.

DETAILED DESCRIPTION OF THE PREFERRED EMBODIMENTS

Figure 1:
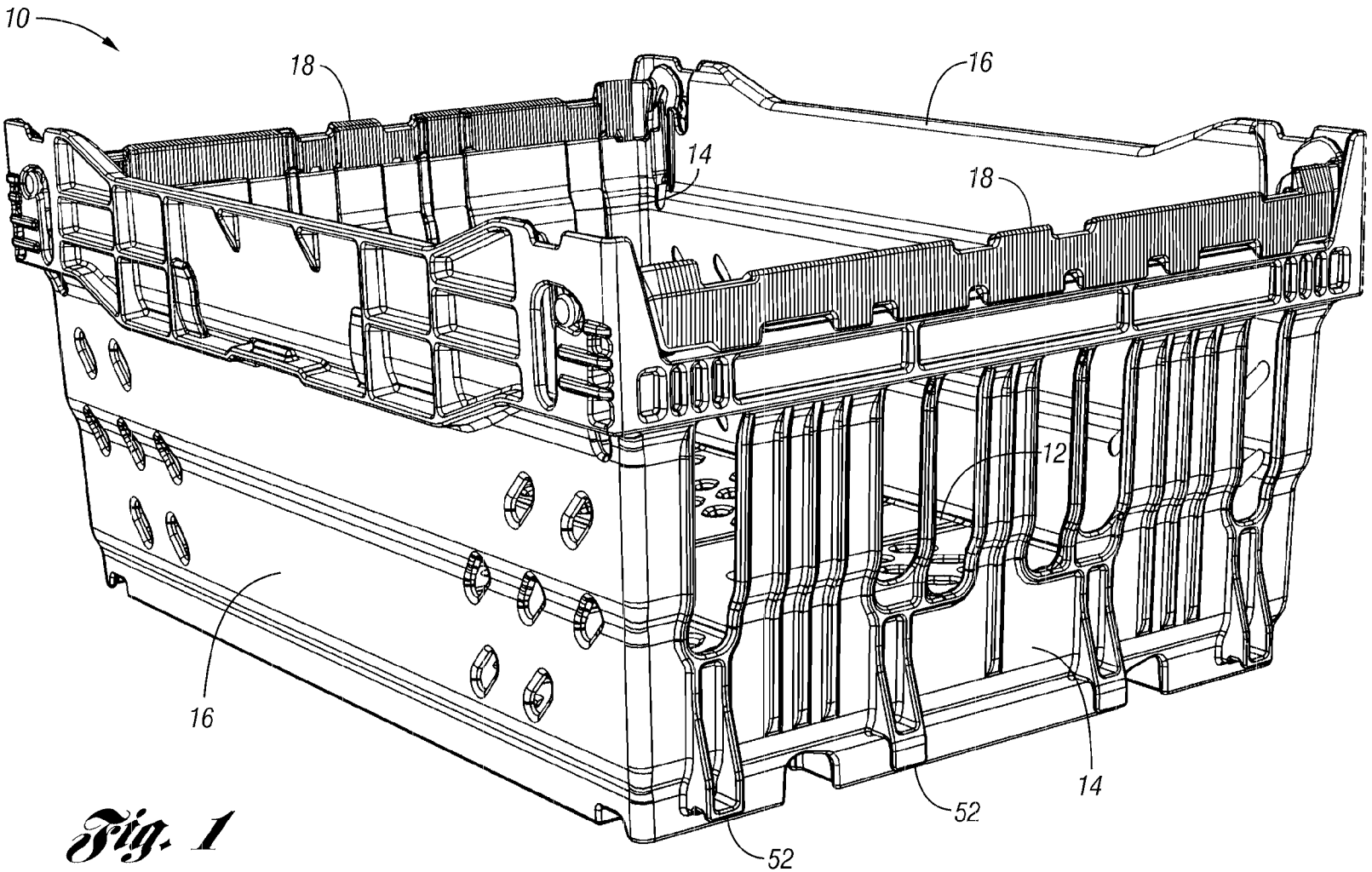
FIG. 1 is a perspective view of a container according to a first embodiment.

FIGS. 1-14 illustrate a container 10 according to a first embodiment of the present invention. FIG. 1 is a perspective view of the container 10. The container 10 includes opposed end walls 14 and opposed side walls 16 extending upwardly from a base 12. The container 10 includes a pair of supports 18 mounted adjacent each end wall 14. The supports 18 are pivotably and slidably mounted to opposite side walls 16. In FIG. 1, the supports 18 are shown in the home or nest position. Each end wall 14 includes a plurality of projections 52, which are typically used for stacking the container 10 crosswise on a container twice its size. In this embodiment, they are also used to provide a lower stacking position when stacked on a similar container.

Figure 2:
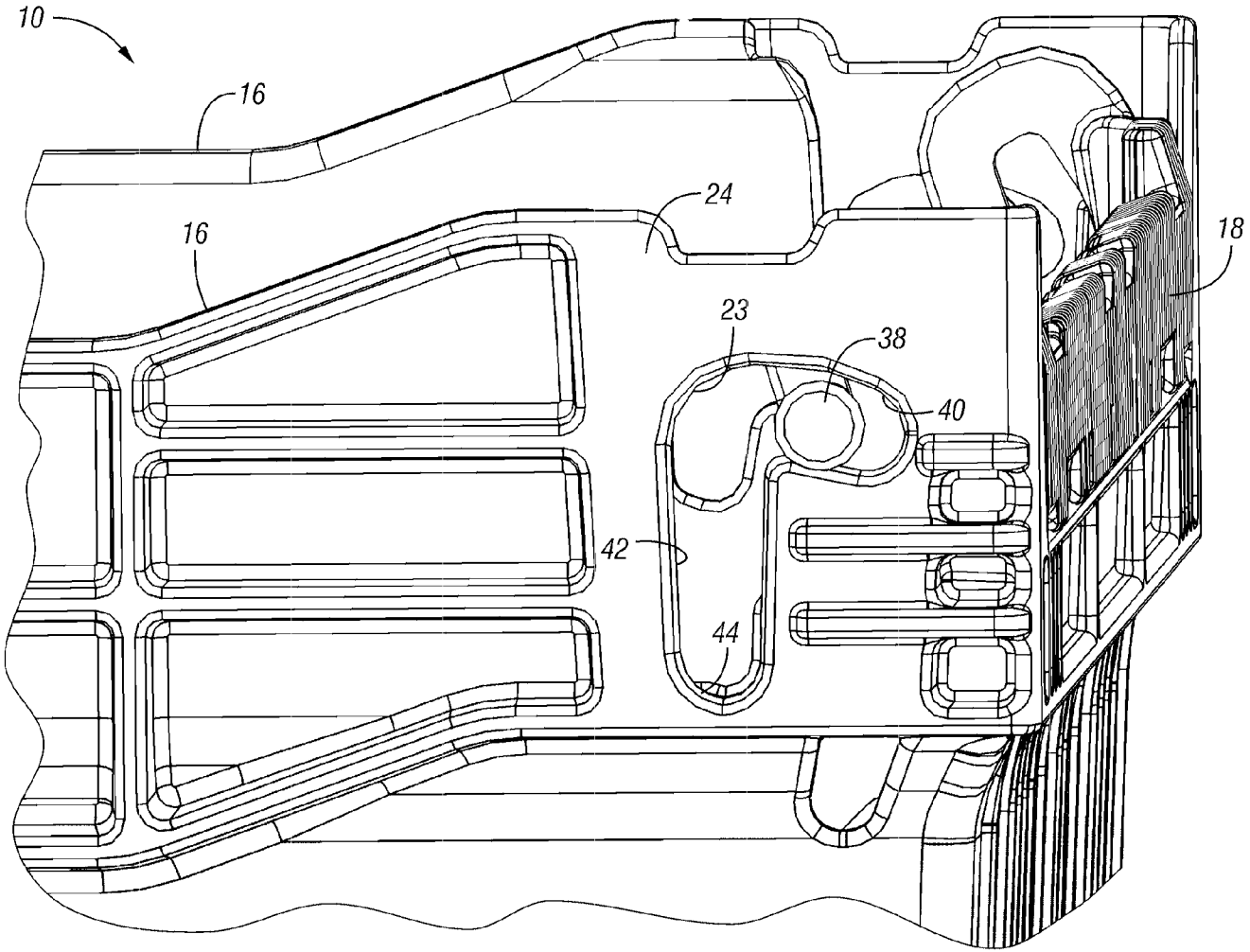
FIG. 2 is an enlarged exterior view of one corner of the container of FIG. 1.

FIG. 2 is an enlarged view of the exterior of the nearest corner of the container 10 of FIG. 1. The outer portion 24 of the side wall 16 includes an opening 23 through which the pin 38 of the support 18 is received. The opening 23 includes an upper, slanted portion 40 angling downward toward the end of the container 10, and a generally vertical portion 42 having a lower surface 44. In this embodiment, the slanted portion 40 of the opening 23 extends downward toward the end wall 14 from the top of the generally vertical portion 42 of the opening 23. As shown, when the support 18 is in the home position, the pin 38 is in the slanted portion 40. The pin 38 of the support 18 is pivotable and slidable within the opening 23.

The corner of the container 10 below the lip of the container 10 is curved outward to prevent shingling of adjacent containers 10.

Figure 3:
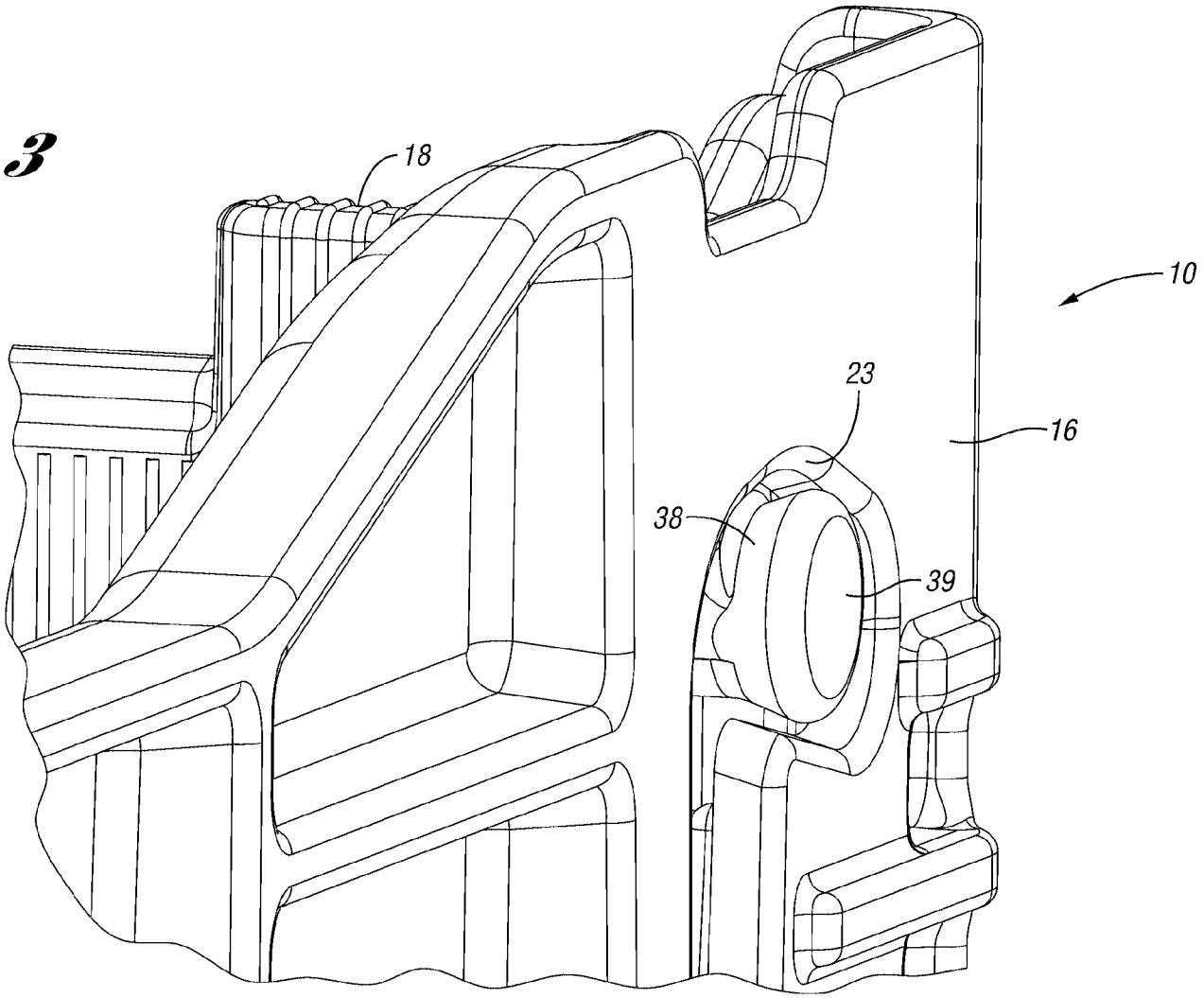
FIG. 3 is an enlarged view of the corner of FIG. 2.
Figure 4:
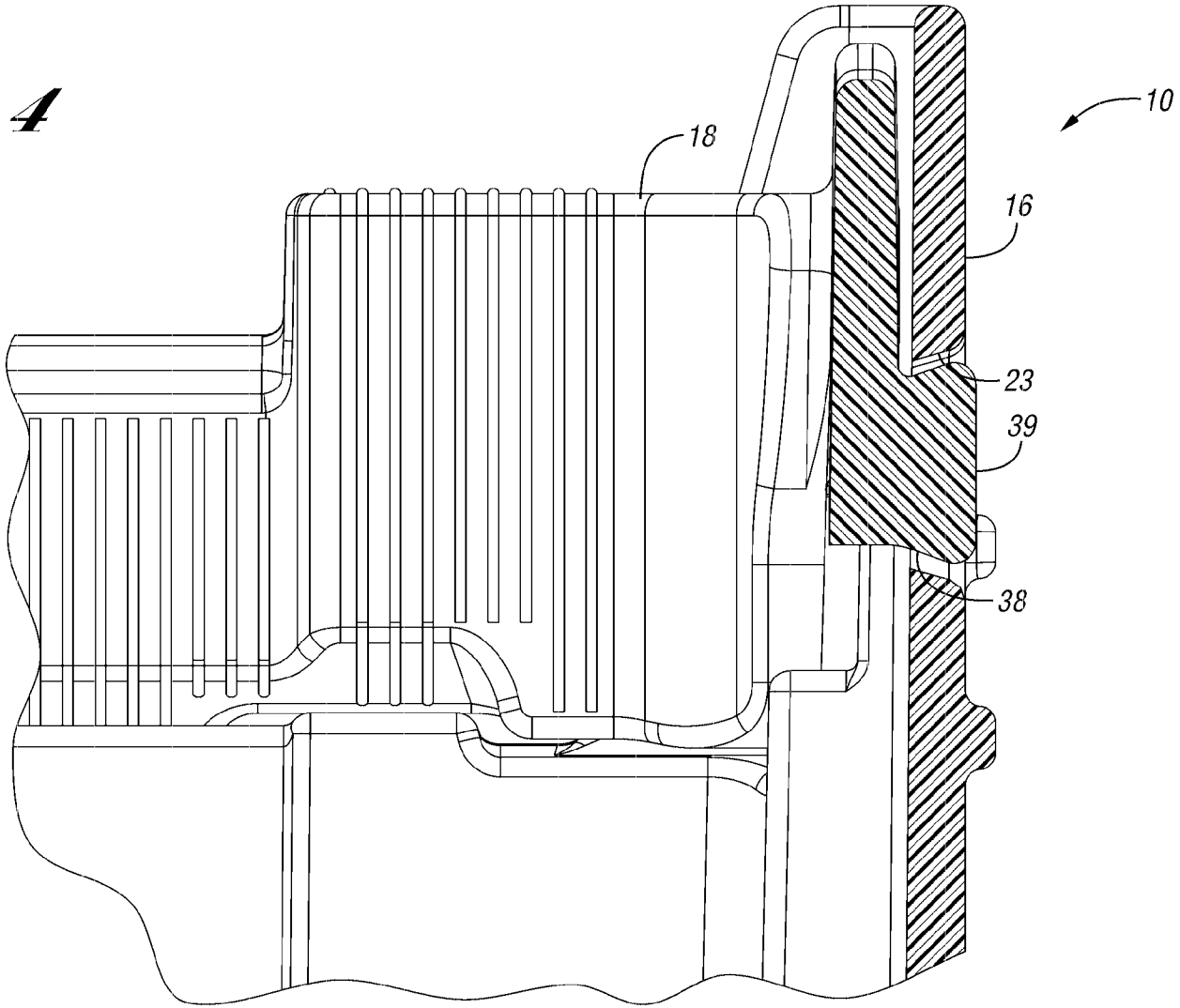
FIG. 4 is a section view through the corner of FIG. 3.

FIGS. 3 and 4 show a tapered boss 39 at the end of the pin 38 and a tapered opening 23. The complementary tapers on the boss 39 and the periphery of the opening 23 trap the support 18 to the container 10.

Figure 5:
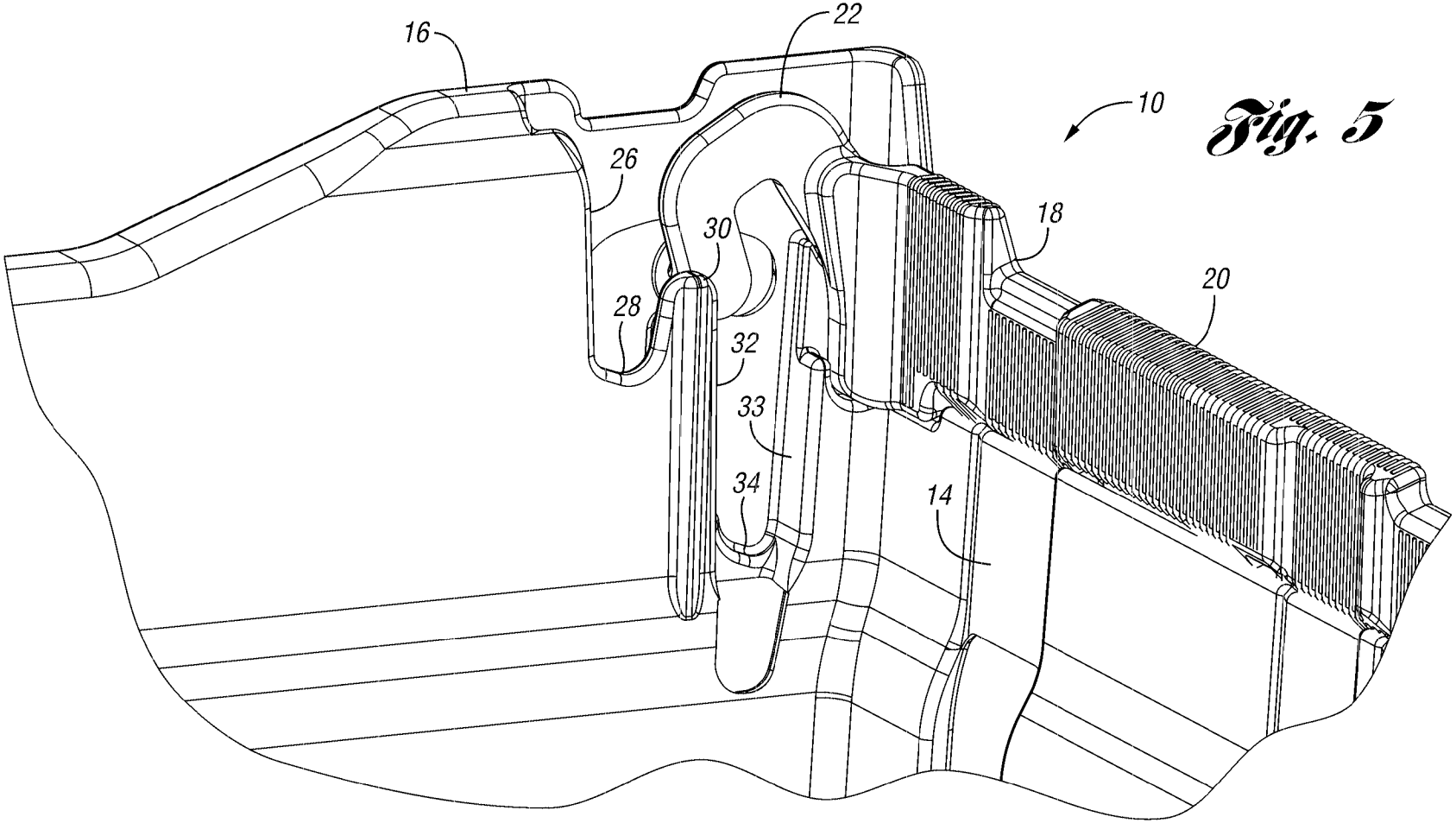
FIG. 5 an interior corner view of the container of FIG. 1.
Figure 14:
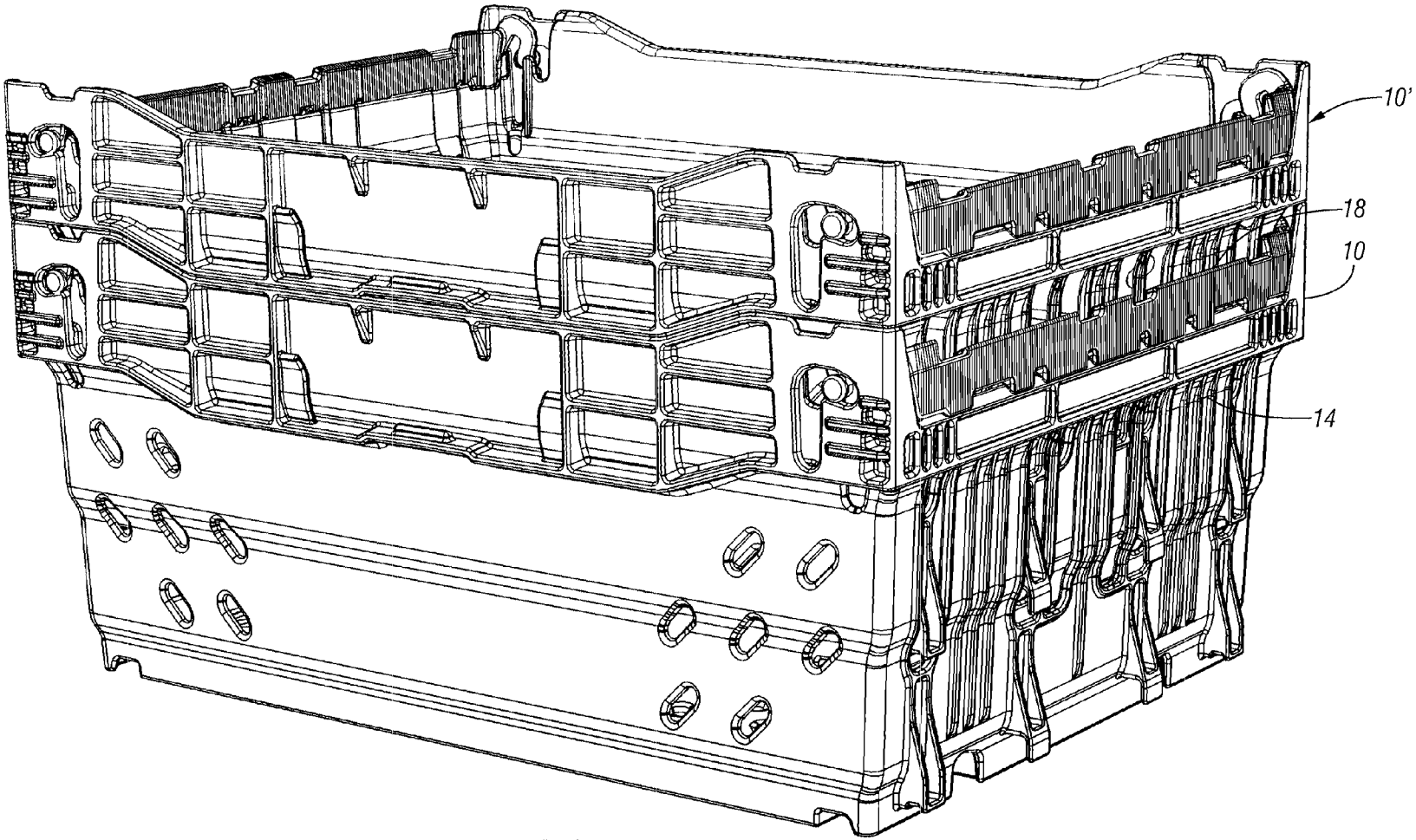
FIG. 14 is a perspective view of the container of FIG. 1 with the supports in the home position with a similar container nested therein.

FIG. 5 is an interior view of the corner of the container 10. The side wall 16 includes an inner wall portion 26 having an upper support surface 28 with an upward projection 30 adjacent thereto. A channel 32 is formed through the inner wall portion 26 adjacent to and toward the exterior of the upward projection 30. The channel 32 is partially defined by a lower support surface 34. Adjacent the channel 32 and toward the exterior thereof is an upward projection 33. The support 18 includes a support portion 20 extending across the container from one side wall 16 to the other (not shown) and sitting on the end wall 14 (or alternatively could be adjacent end wall 14). The support portion 20 is pivotably and slidably connected to the side walls 16 by arms 22. In this embodiment, the arms 22 are U-shaped, opening downwardly when the support 18 is in the home position as shown. With the supports 18 in the retracted position, a similar container can be nested to a position in which the band of the upper container rests on the band of the lower container 10 (FIG. 14). In the disclosed embodiments, the supports are plastic, so the support portion has an oblong aspect ratio to increase the support strength and stiffness.

Figure 6:
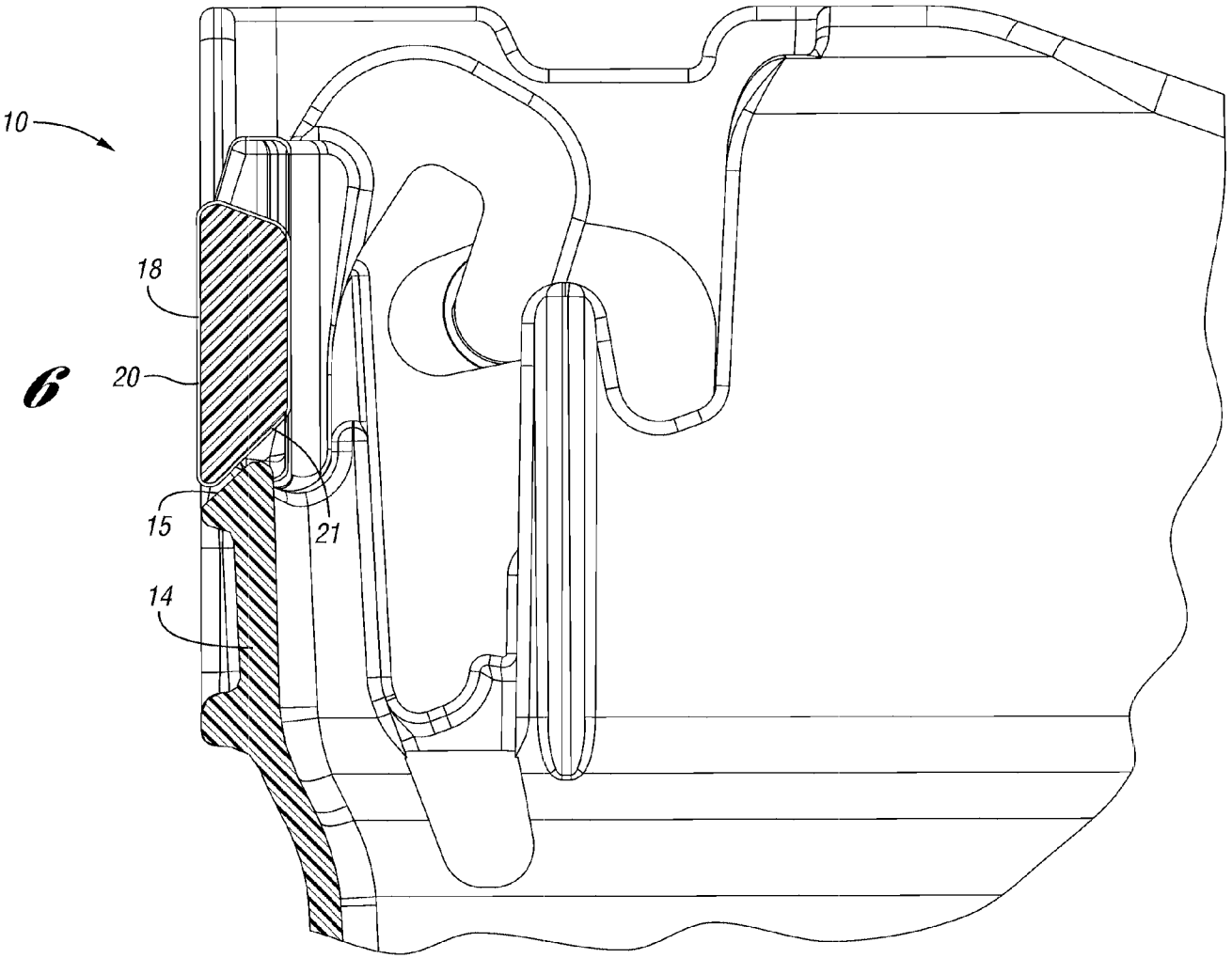
FIG. 6 is a section view through an upper portion of an end wall of FIG. 1.

As shown in FIG. 6, the support portion 20 of the support 18 includes a tapered surface 21 interlocked with a complementary tapered surface 15 at the upper edge of the end wall 14 to keep the support 18 in the proper position.

Figure 7:
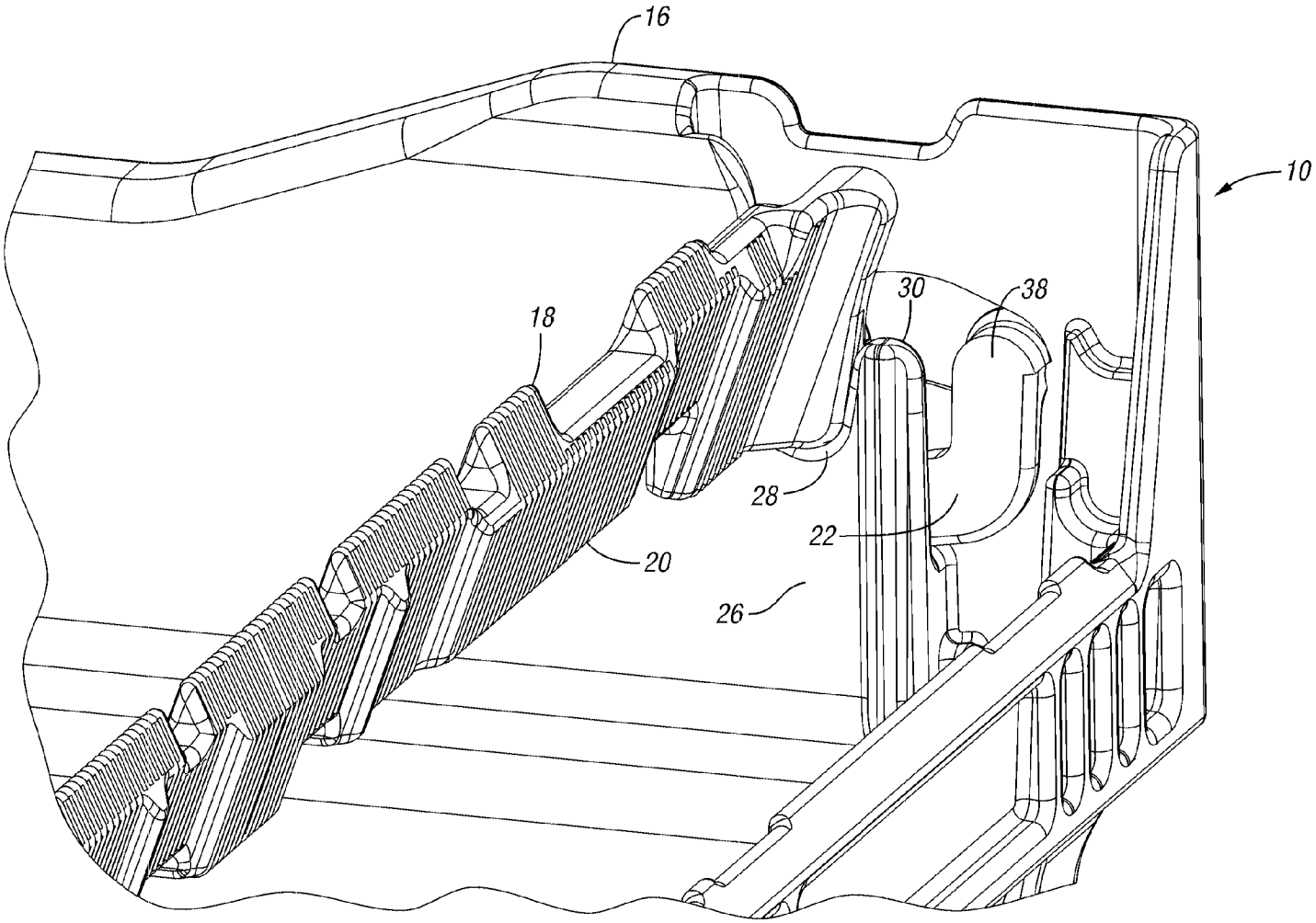
FIG. 7 is an interior corner view of the container of FIG. 1 with the support in an upper stack position.
Figure 8:
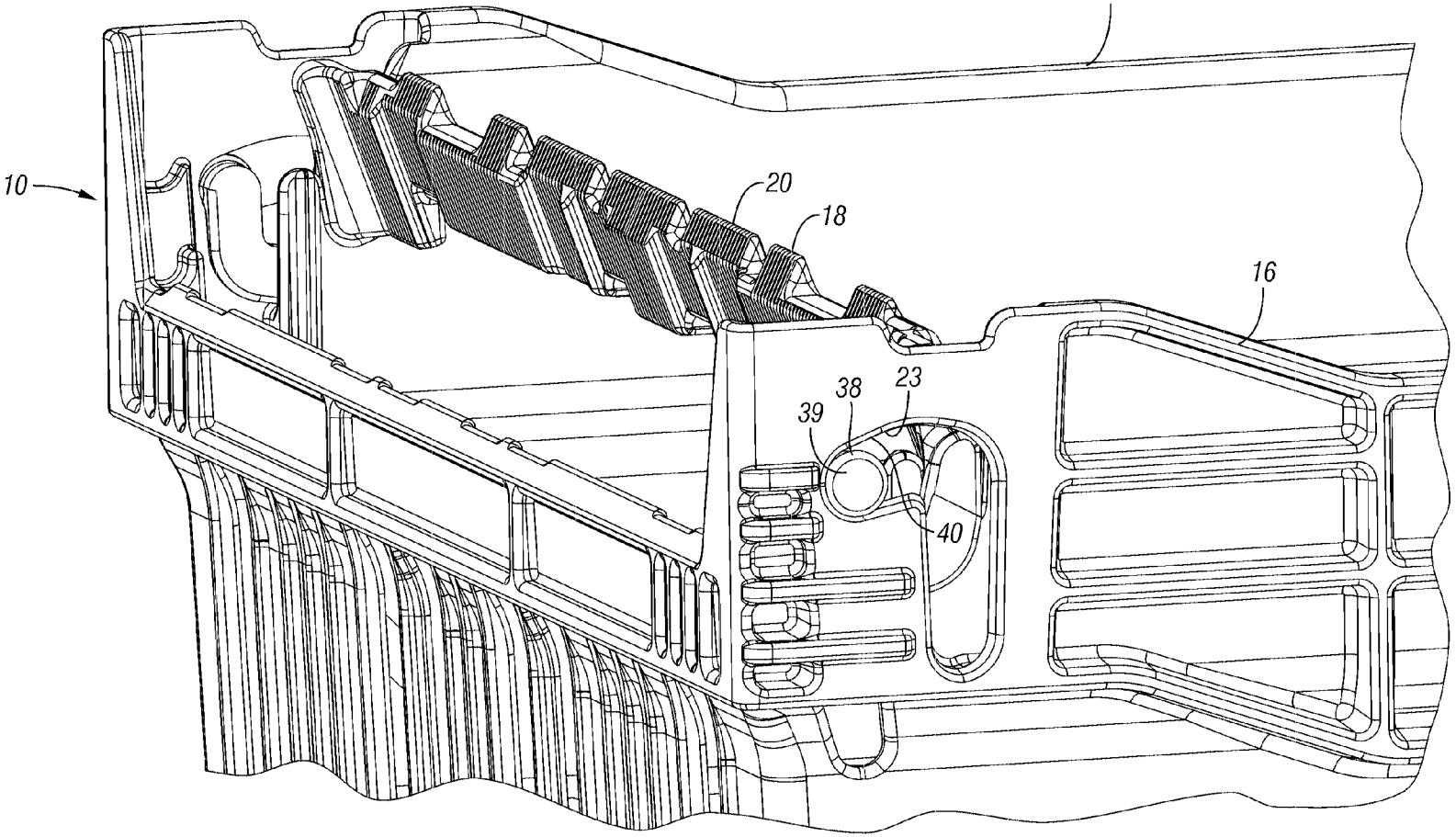
FIG. 8 is an exterior corner view of the container of FIG. 7.
Figure 9:
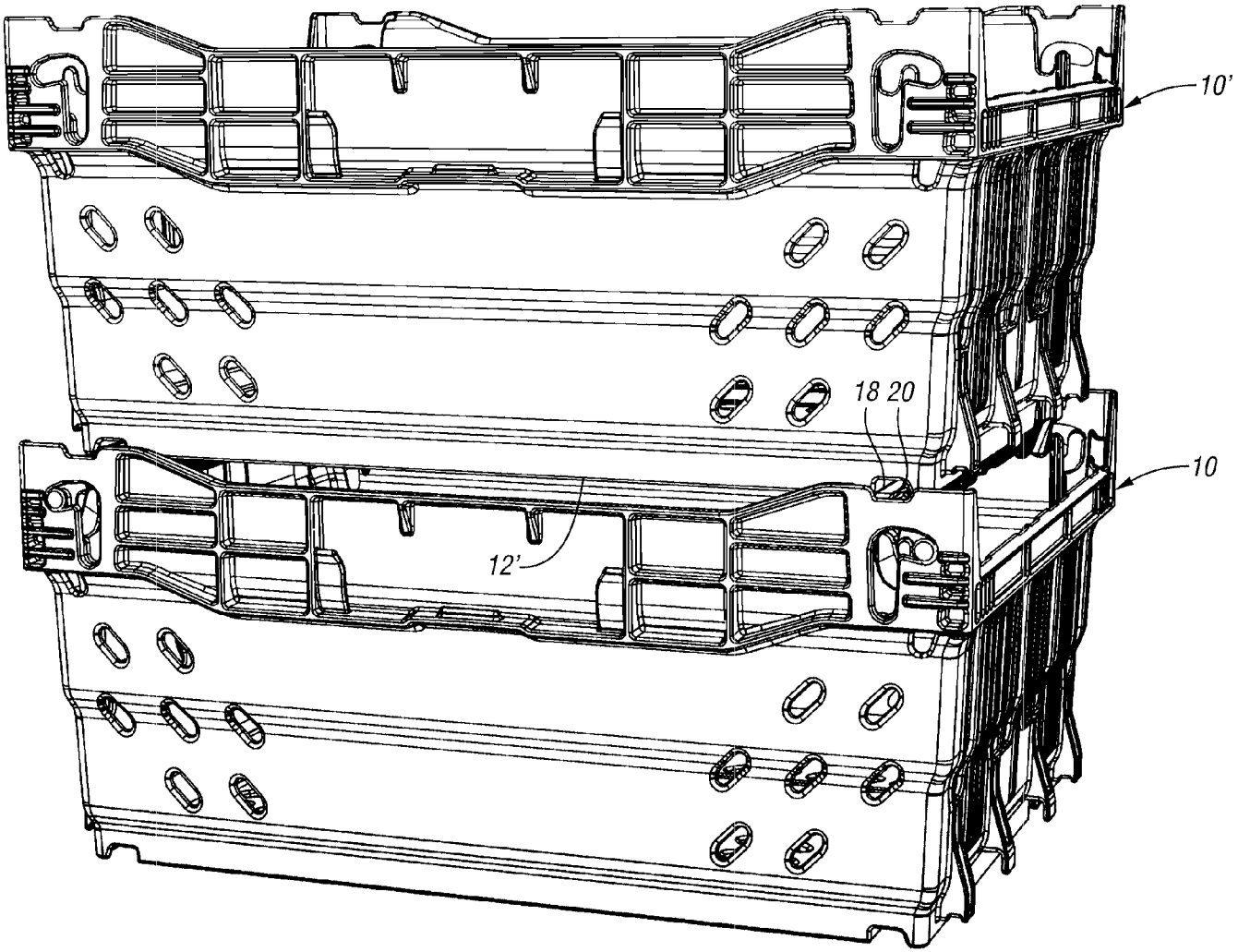
FIG. 9 is a perspective view of the container of FIG. 1 with the supports in the upper stack position with a similar container stacked thereon.
Figure 10:
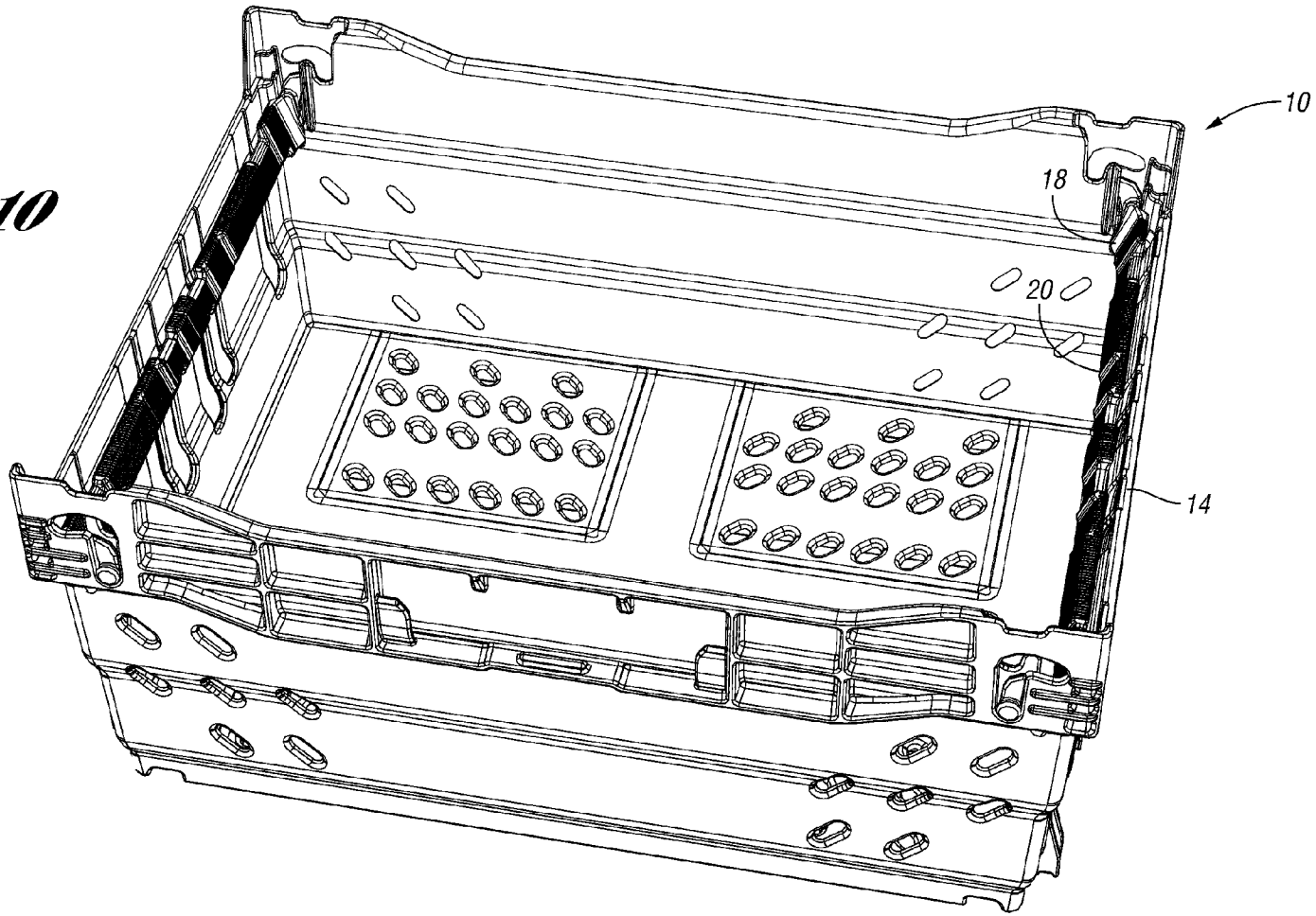
FIG. 10 is a perspective view of the container of FIG. 1 with the supports in a lower stack position.

FIGS. 7-9 illustrate the support 18 in the upper support position. Referring to FIG. 7, the support 18 is supported on the upper support surface 28 of the inner wall portion 26 of the side wall 16. In this position, the U-shaped arms 22 are inverted to open upwardly, such that the underside of the support portion 20 also faces upwardly to contact another container. Referring to FIG. 8, the pin 38 (and boss 39) are slid forward in the slanted portion 40 of the opening 23.

As shown in FIG. 9, when the supports 18 are in the upper support position, a similar container 10' can be stacked on the supports 18. The support portions 20 of the supports 18 are received in channels on the underside of the base 12' of the upper container 10'. This position provides the most room for goods stored in the lower container 10.

Figure 11:
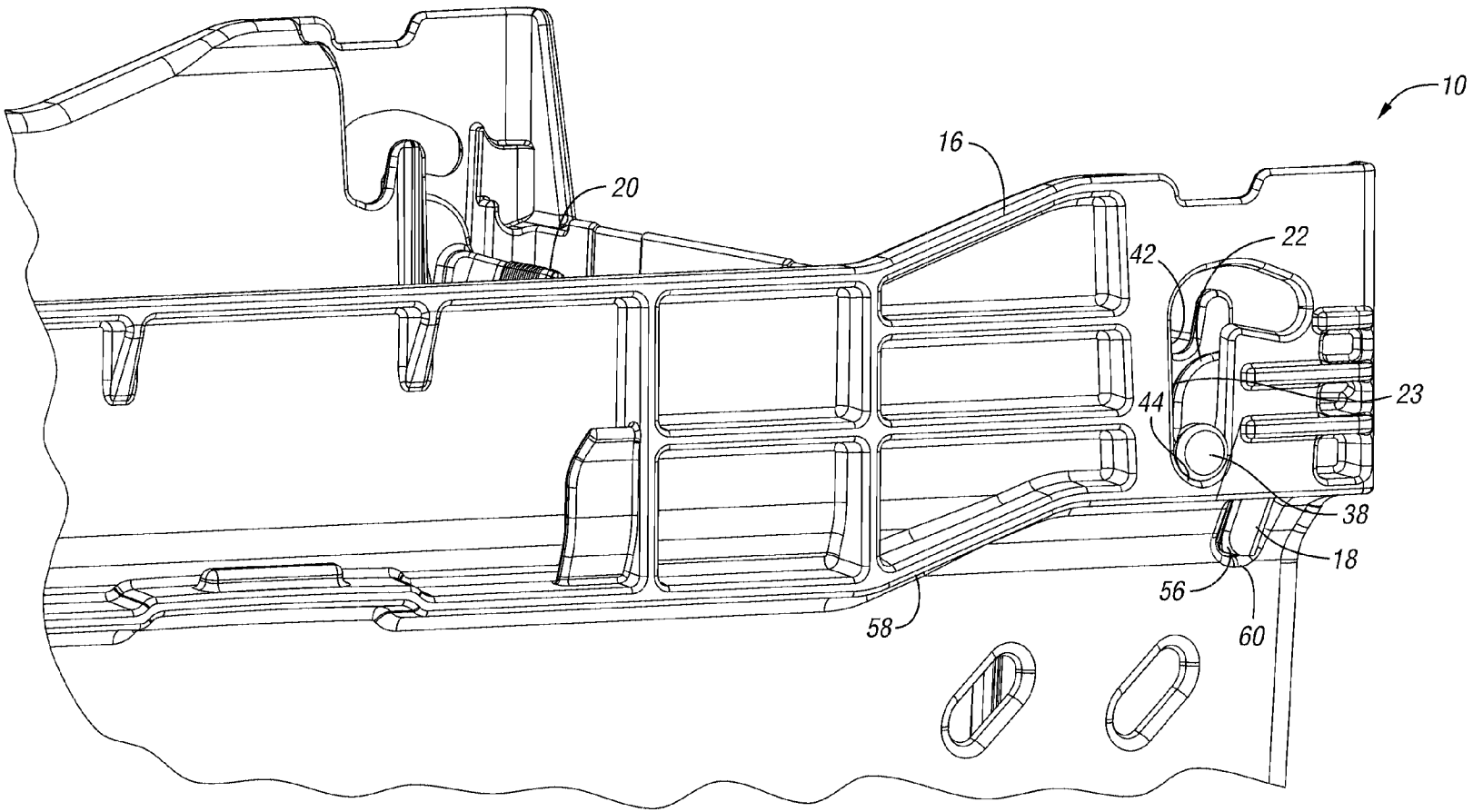
FIG. 11 is an exterior corner view of the container of FIG. 10.

FIGS. 10-13 illustrate the container 10 with the support 18 in the lower support position. Referring to FIG. 11, the pin 38 is supported on the lower surface 44 in the vertical portion 42 of the opening 23. The support 18 protrudes outward through an opening 56 through the side wall 16 below the band 58 of the container 10 and rests on a surface 60 of the side wall 16. The opening 56 permits the support 18 to move to the lower position and provides additional support to the support 18. The pin 38 of the support 18 is pivotable and slidable within the opening 23 to the lower-most position on the lower surface 44 of the channel 42 in the outer wall portion of the side wall 16. The U-shaped arms 22 are again inverted (opening downwardly) in the lower support position, such that the upper surface of the support portion 20 of the support 18 faces upwardly.

Figure 12:
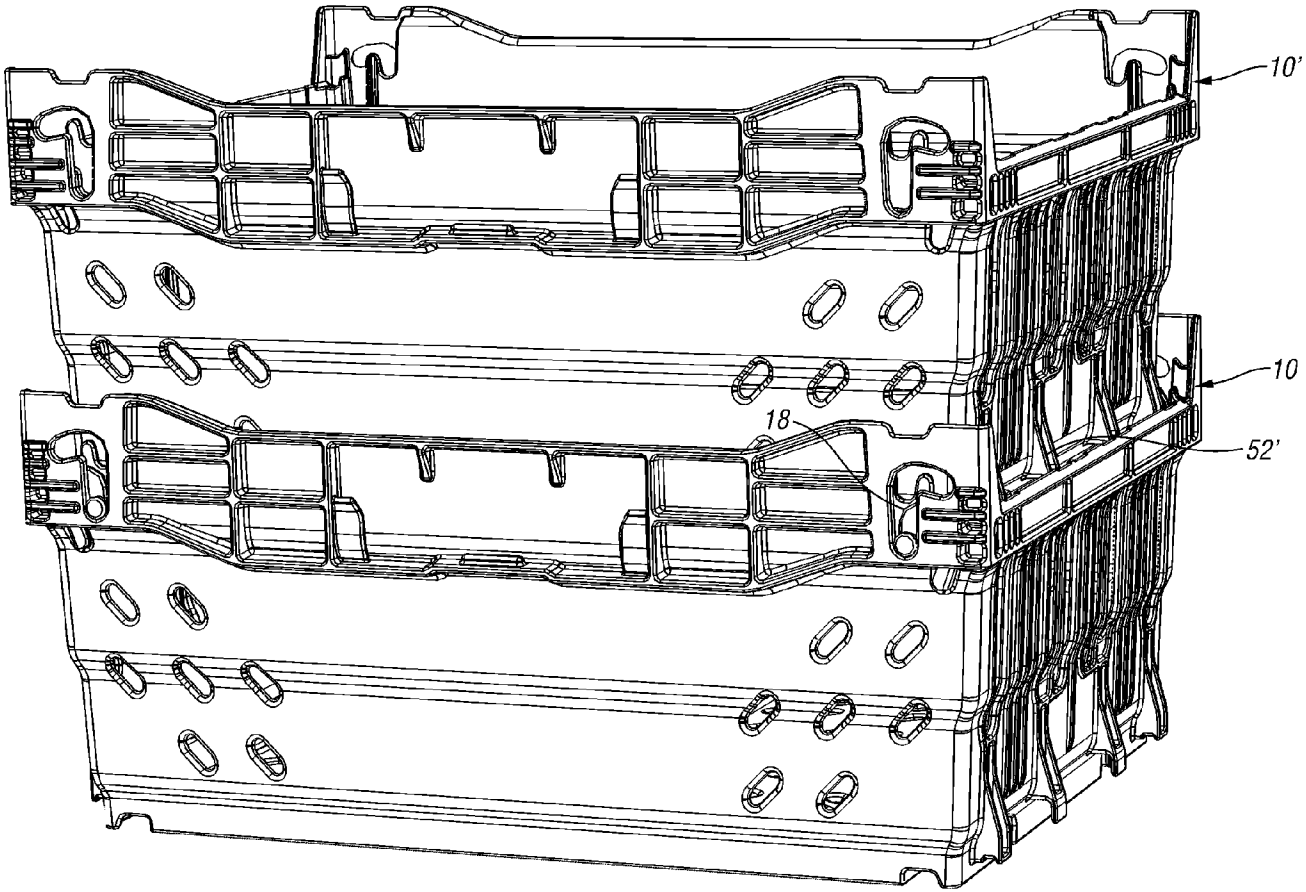
FIG. 12 is a perspective view of the container of FIG. 1 with the supports in the lower stack position with a similar container stacked thereon.
Figure 13:
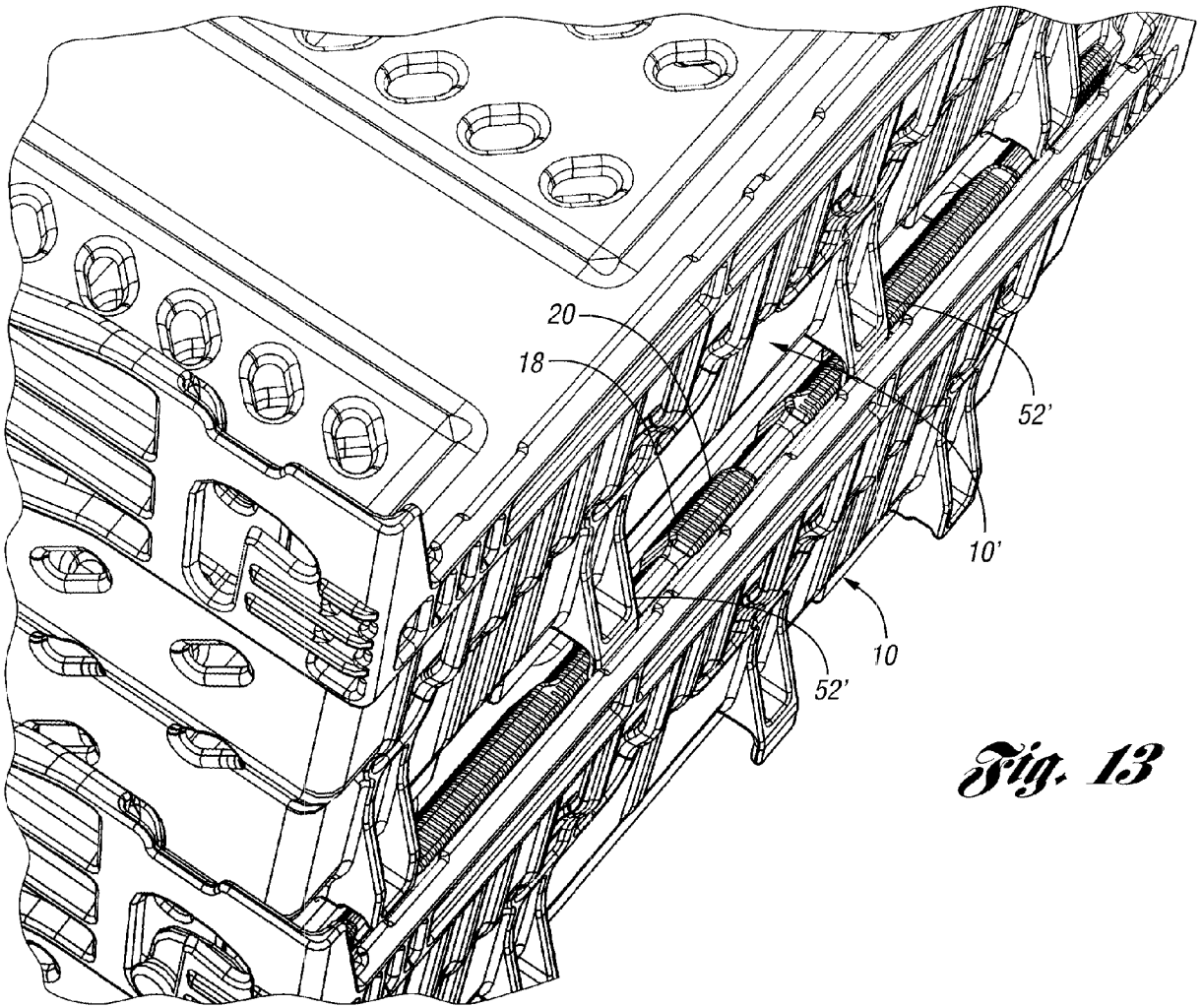
FIG. 13 is an upper perspective view of one end of the containers of FIG. 12.

When an upper container 10' is stacked on the lower container 10 with the support 18 in the lower support position as shown in FIG. 12, the projections 52' on the end walls 14 of the upper container 10' provide contact surfaces that are supported on the support portions 20 of the supports 18, as shown in FIG. 13. This provides a lower stacking height of the upper container 10' on the lower container 10. This provides more efficient stacking of the containers 10 for goods in the containers 10 that do not occupy all of the volume. This reduces the overall stacking height of the containers 10, 10'.

FIG. 14 shows the containers 10, 10' in a nested position in which the containers 10, 10' occupy the least volume, such as for storage or shipping when empty.

Figure 15:
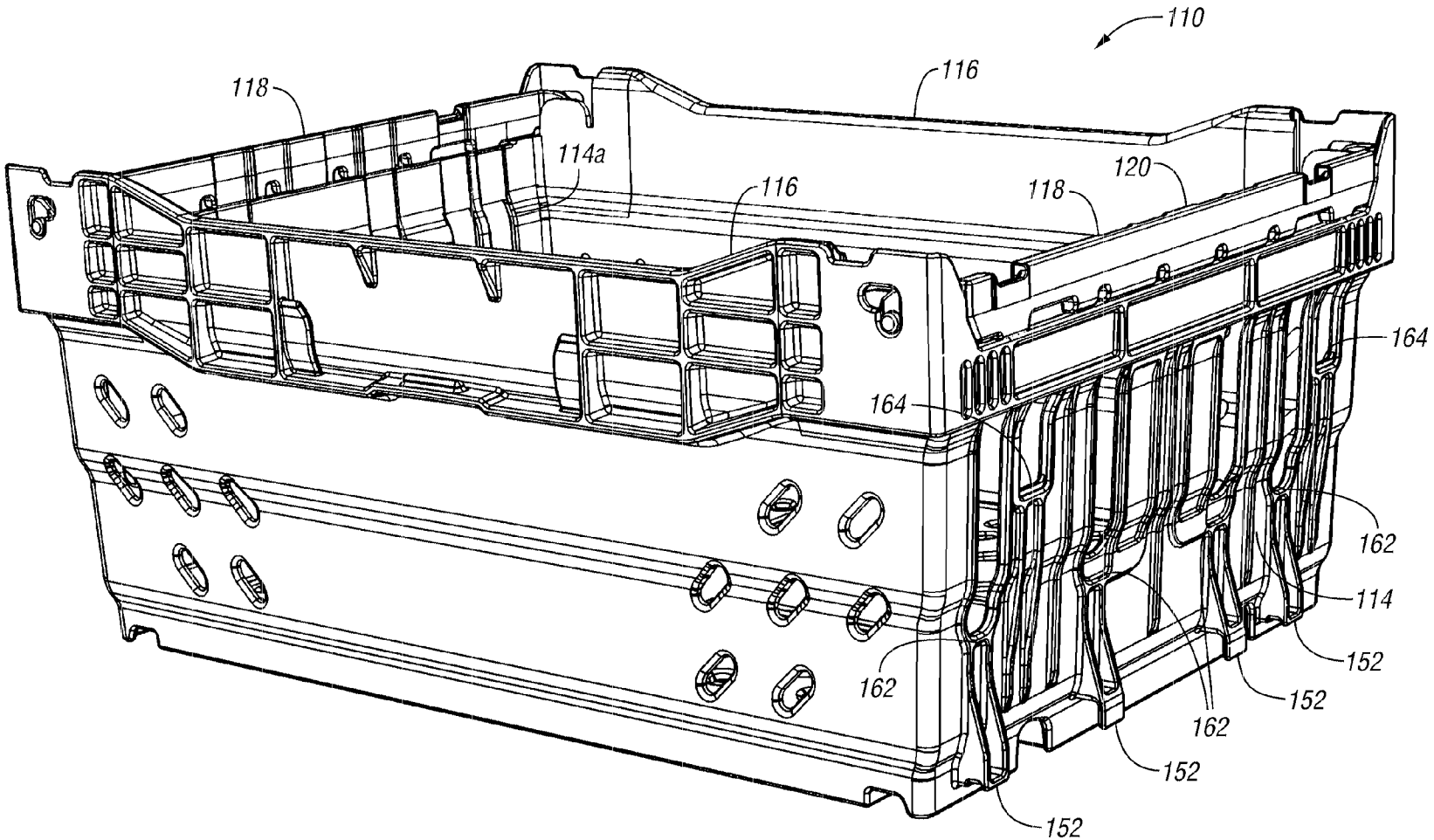
FIG. 15 is a perspective view of a container according to a second embodiment.

FIGS. 15-23 illustrate a container 110 according to a second embodiment of the present invention. FIG. 15 is a perspective view of the container 110. The container 110 includes opposed end walls 114 and opposed side walls 116 extending upwardly from a base 112. The container 110 includes a pair of supports 118 mounted adjacent each end wall 114. The supports 118 are pivotably and slidably mounted to opposite side walls 116 and include support portions 120 which extend across the container 110. The end wall 114 includes a plurality of projections 152, which are typically used for stacking the container 110 crosswise on a container twice its size. As explained below, in this embodiment, they can also be used to provide 180 degree stack/nest functionality. The end wall 114 further includes a plurality of tall elongated vertical windows 162 aligned with the projections and short elongated windows 164 between the projections 152 and spaced upwardly from the projections 152. The opposite end wall 114*a* includes the minor image arrangement of the windows 162, 164 and projections 152 of the end wall 114.

Figure 16:
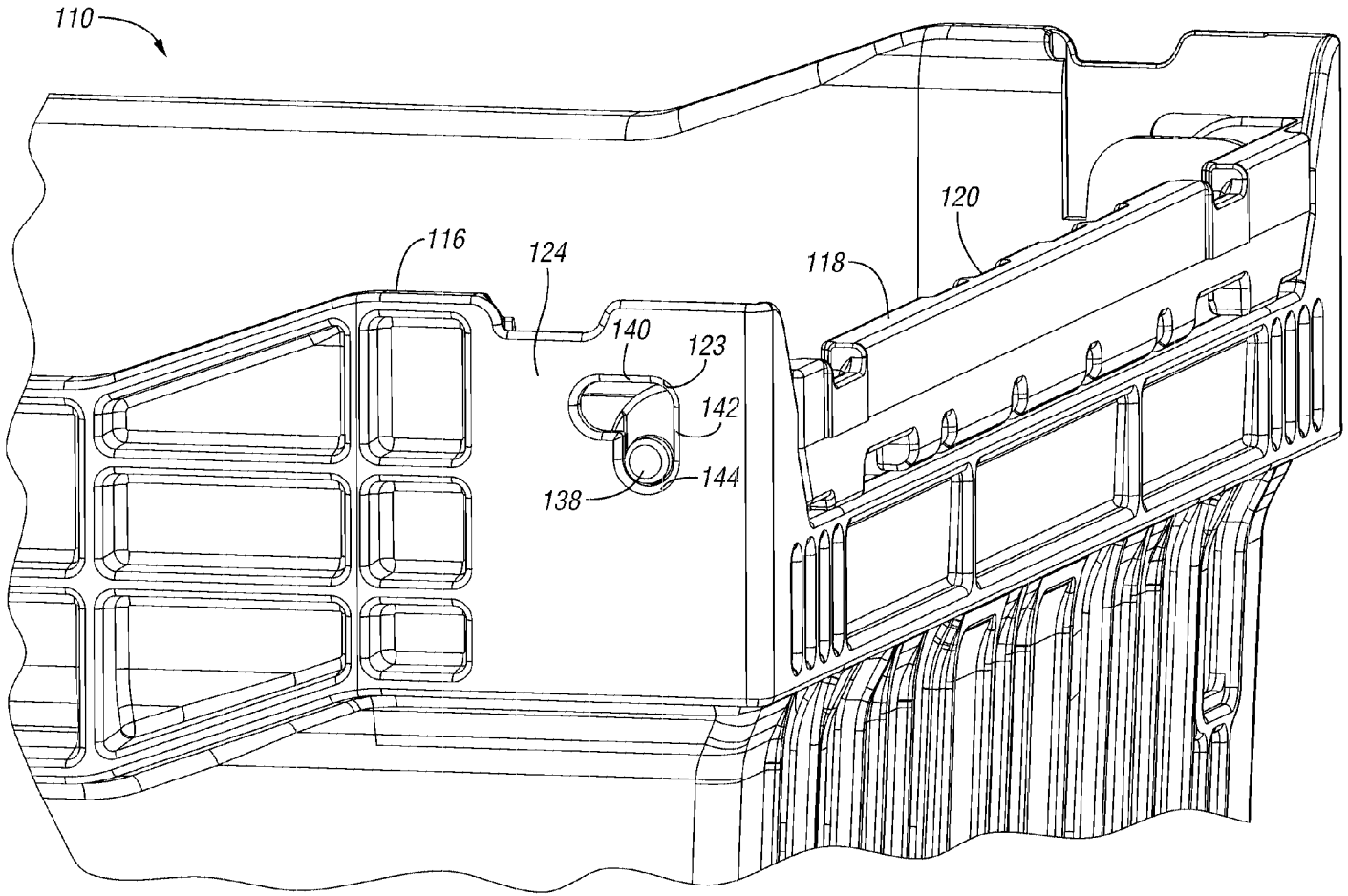
FIG. 16 is an enlarged exterior view of one corner of the container of FIG. 15.

FIG. 16 is an enlarged view of the exterior of the nearest corner of the container 110 of FIG. 15. The outer portion 124 of the side wall 116 includes an opening 123 through which the pin 138 of the support 118 is received. The opening 123 includes an upper, generally horizontal portion 140 and a generally vertical portion 142 having a lower surface 144. In this embodiment, the horizontal portion 140 of the opening 123 extends away from the end wall 114 from the upper end of the generally vertical portion 142 of the opening 123. The pin 138 of the support 118 is pivotable and slidable within the opening 123.

In FIGS. 15-17 and 22, the supports 118 are shown in the retracted position on the end wall 114.

Figure 17:
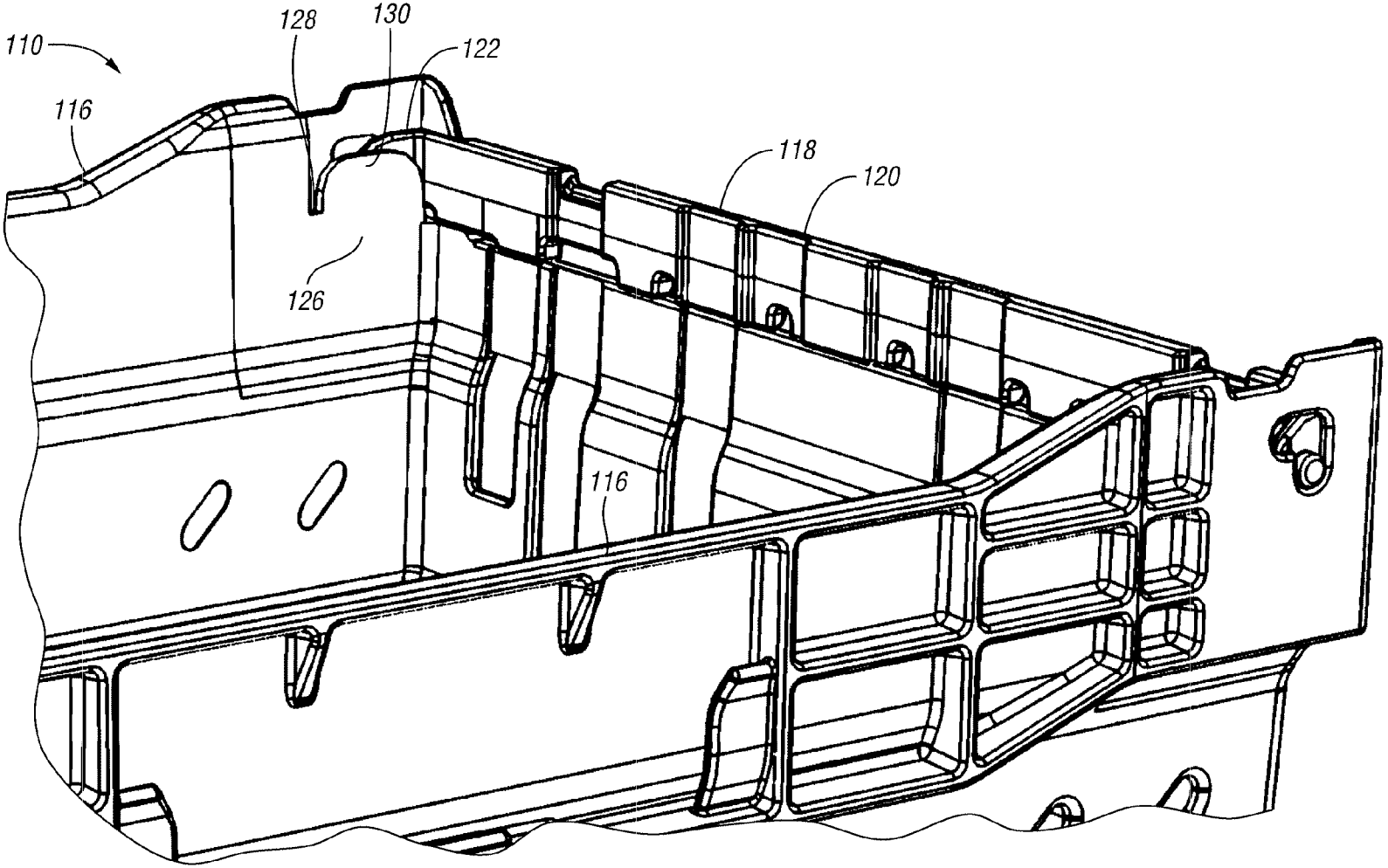
FIG. 17 an interior corner view of the container of FIG. 15.
Figure 18:
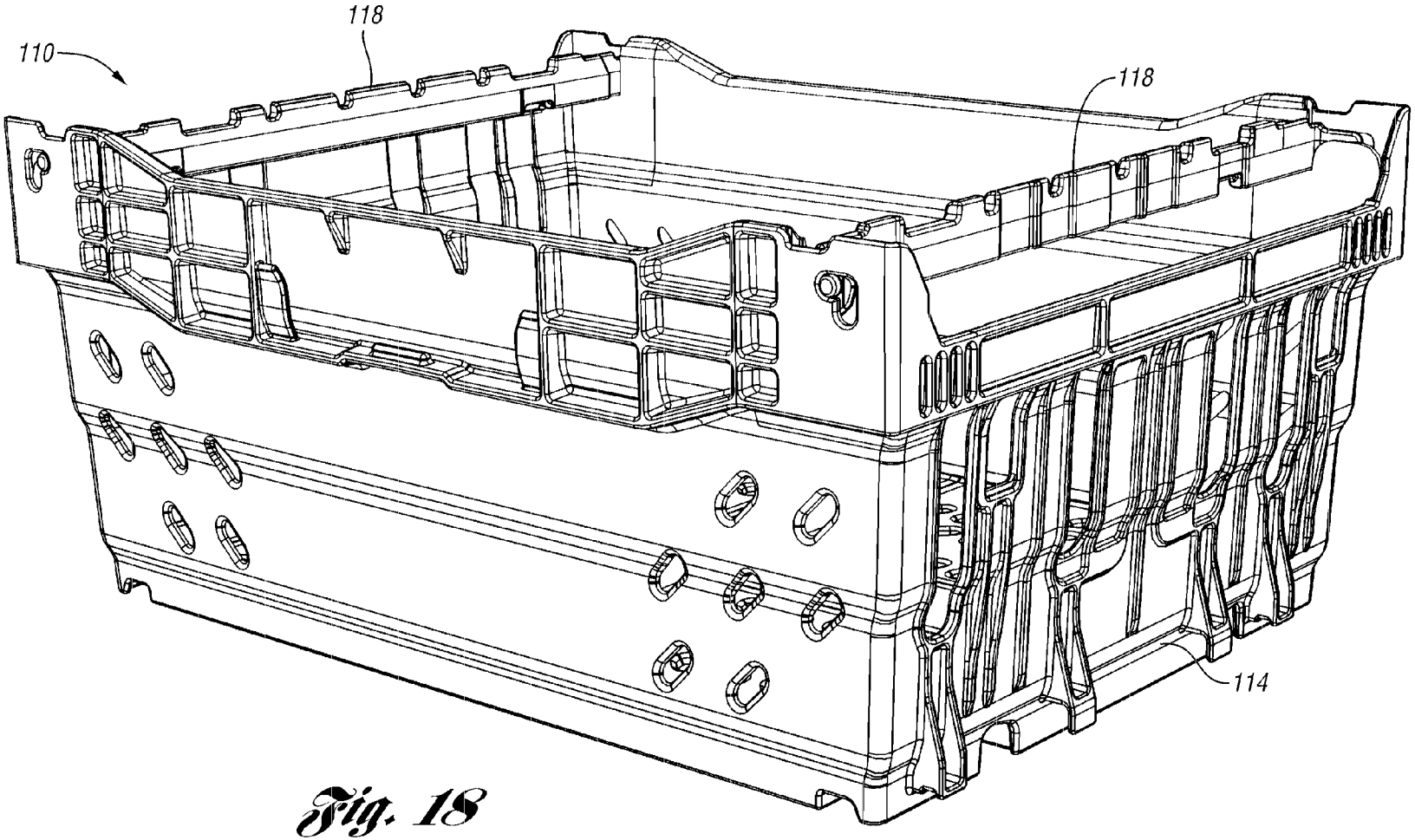
FIG. 18 is a perspective view of the container of FIG. 15 with the supports in an upper stack position.
Figure 22:
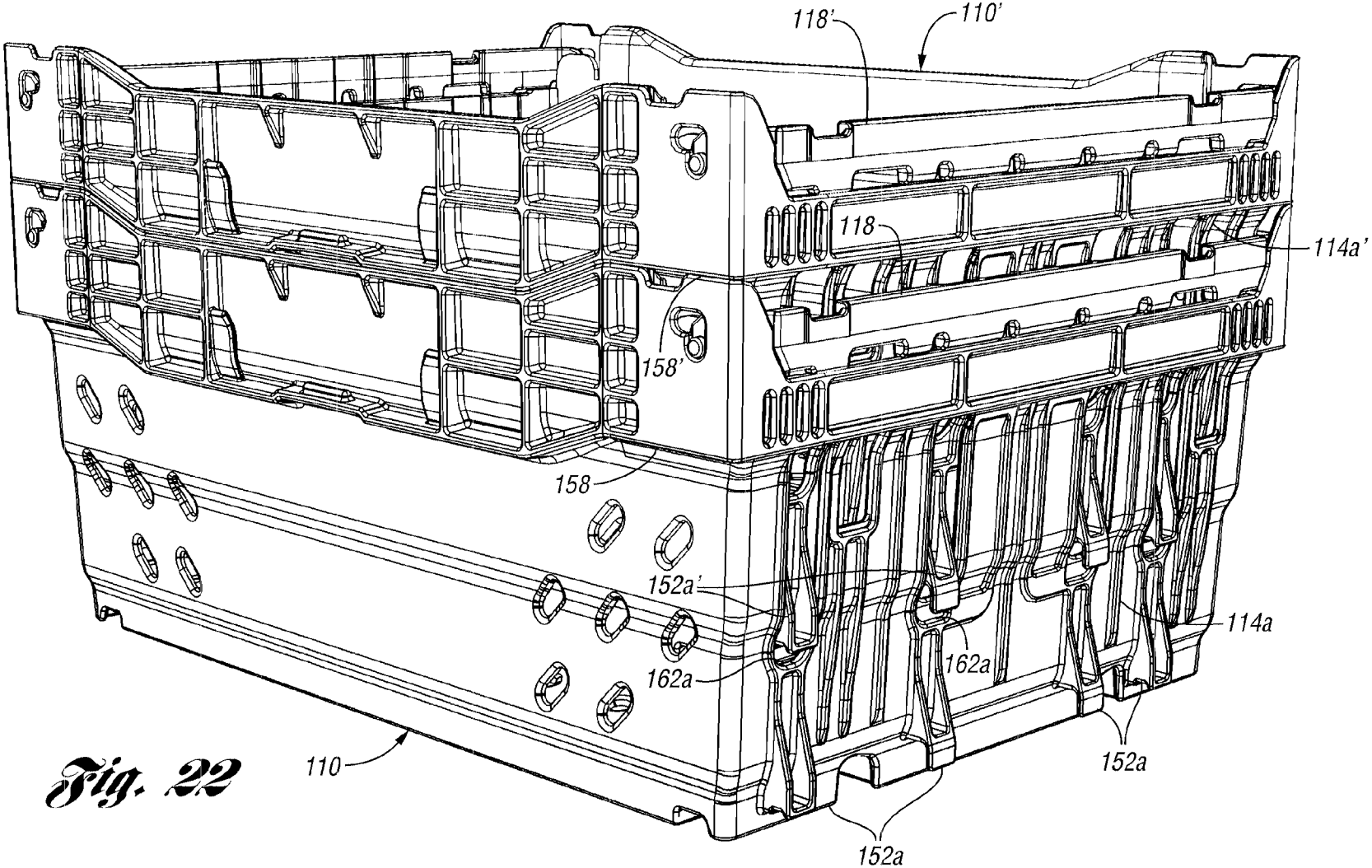
FIG. 22 is a perspective view of the container of FIG. 15 with the supports in the home position with a similar container nested therein.

FIG. 17 is an interior view of the corner of the container 110. The side wall 116 includes an inner wall portion 126 having an upper support surface 128 with an upward projection 130 adjacent thereto. The support 118 includes a support portion 120 extending across the container from one side wall 116 to the other side wall 116 and sitting on the end wall 114 (or alternatively could be adjacent end wall 114). The support portion 120 is pivotably and slidably connected to the side walls 116 by arms 122. As shown in FIG. 22, with the supports 118 in the retracted position, a similar container 110' can be nested therein to a position in which the band 158' of the upper container 110' rests on the band 158 of the lower container 110.

Figure 19:
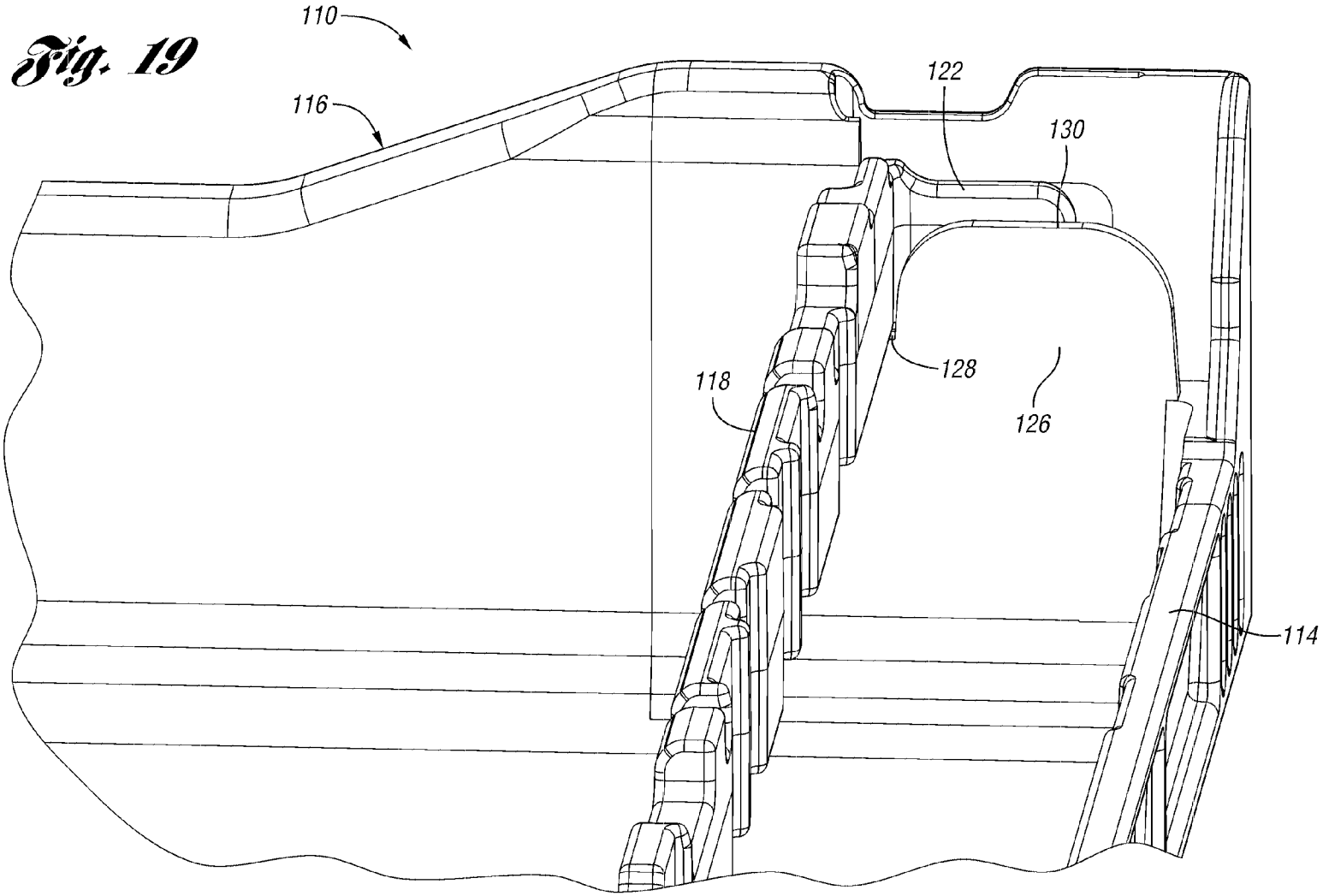
FIG. 19 is an interior corner view of the container of FIG. 15 with the support in an upper stack position.
Figure 20:
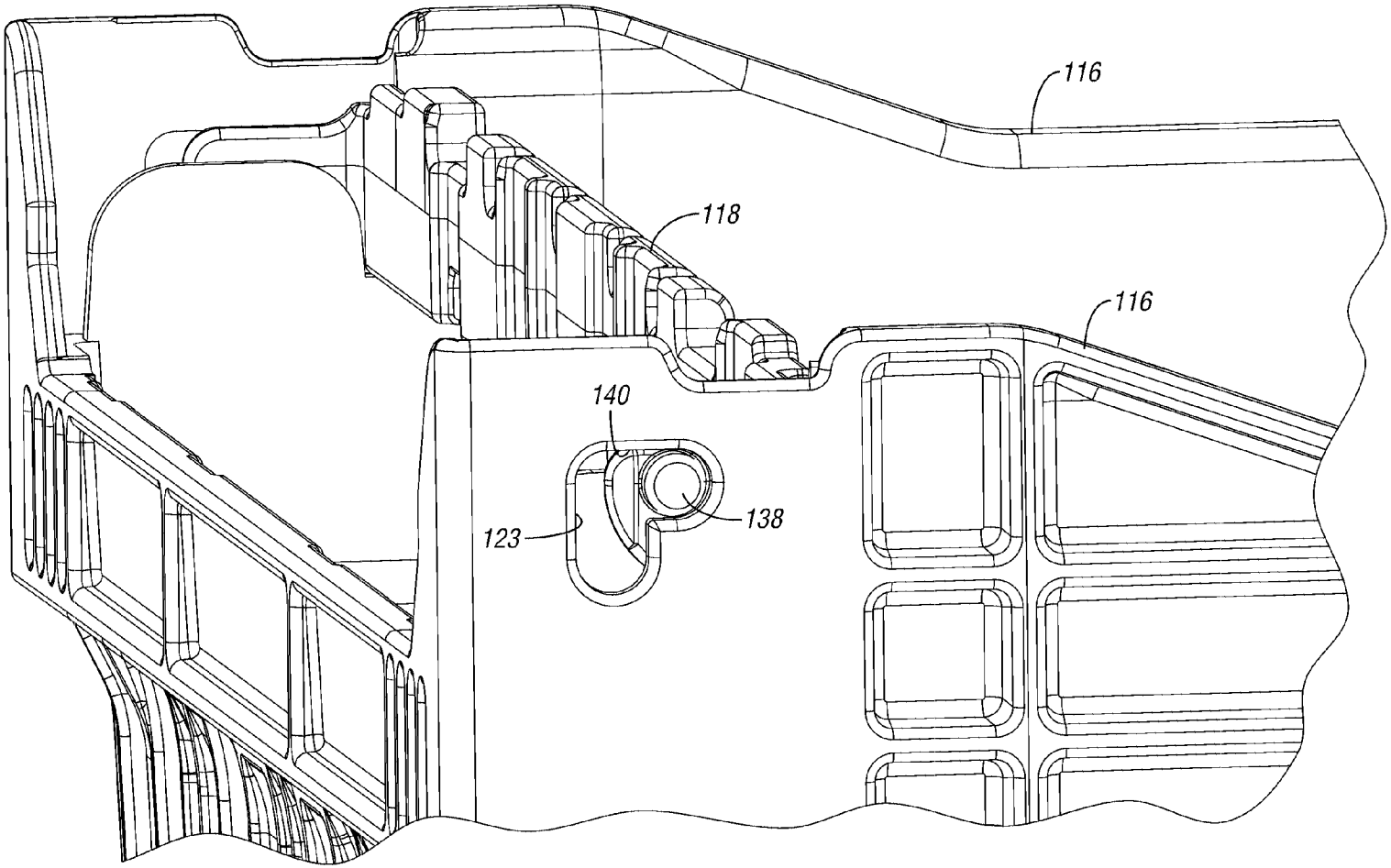
FIG. 20 is an exterior corner view of the container of FIG. 19.

By pivoting and sliding the support 118 relative to the side walls 116, the supports 118 can be moved from the retracted position of FIG. 17 to the upper support position shown in FIG. 18-21. Referring to FIG. 19, the support 118 is supported on the upper support surface 128 of the side wall 116. As shown in FIG. 20, in the upper support position, the pin 138 of the support 118 is slid to the inner end of the horizontal portion 140 of the opening 123 in the side wall 116.

Figure 21:
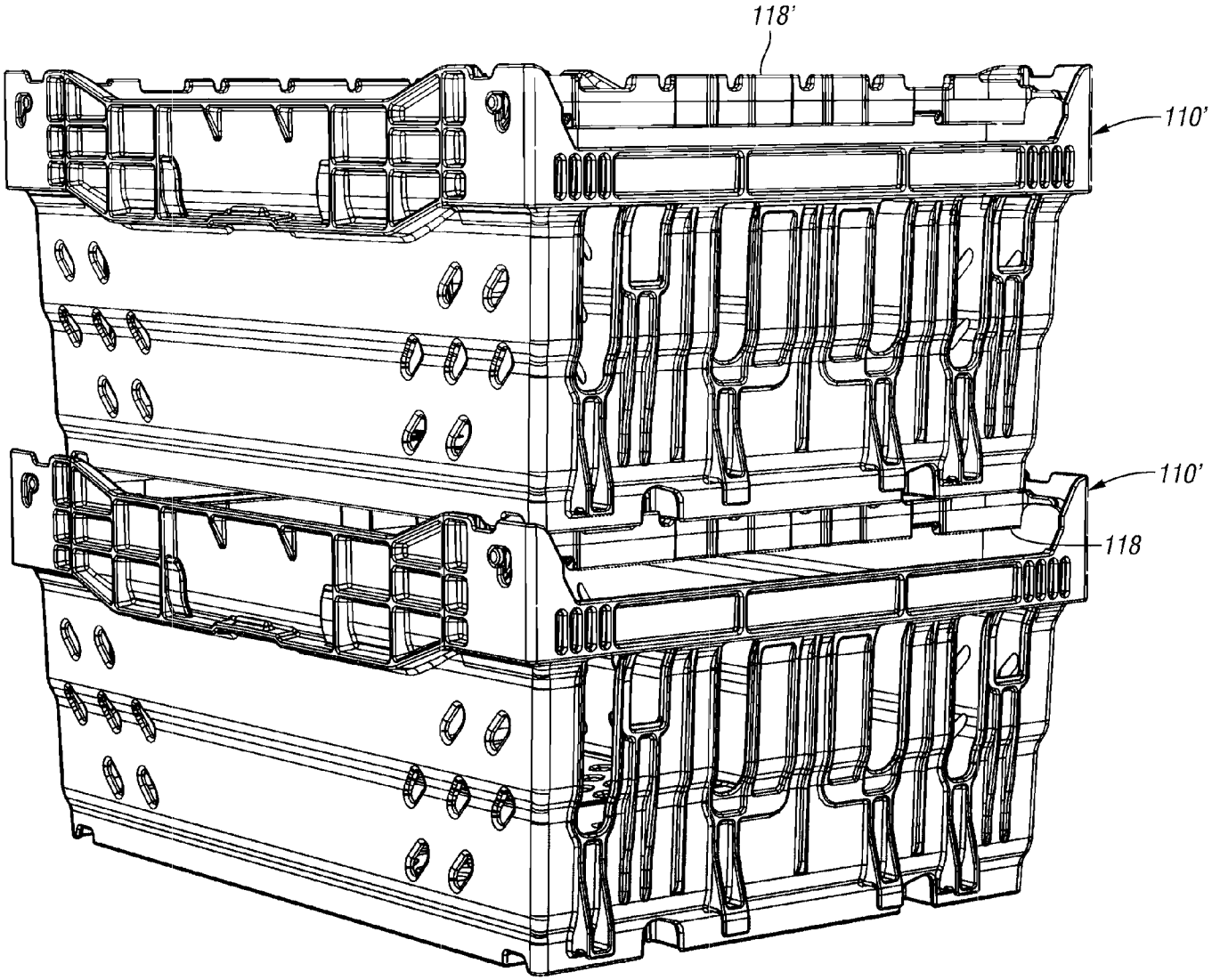
FIG. 21 is a perspective view of the container of FIG. 15 with the supports in the upper stack position with a similar container stacked thereon.

Referring to FIG. 21, with the support 118 in the upper support position, the upper container 110' is stacked on the lower container 110 at the greatest height, there providing the largest storage volume within the lower container 110.

As shown in FIG. 22, when the containers 110, 110' are oriented similarly and the supports 118 are in the nest or home position, the upper container 110' can be fully nested in the lower container 110 to occupy the least volume when empty for storage or shipping. In FIG. 22, the containers 110 are arranged with the similar end walls 114*a*, 114*a*' aligned with one another. This permits the projections 152*a*' of the upper container 110' to be received in the tall vertical windows 162*a* of the lower container 110, which permits the upper container 110' to fully nest in the lower container 110.

Figure 23:
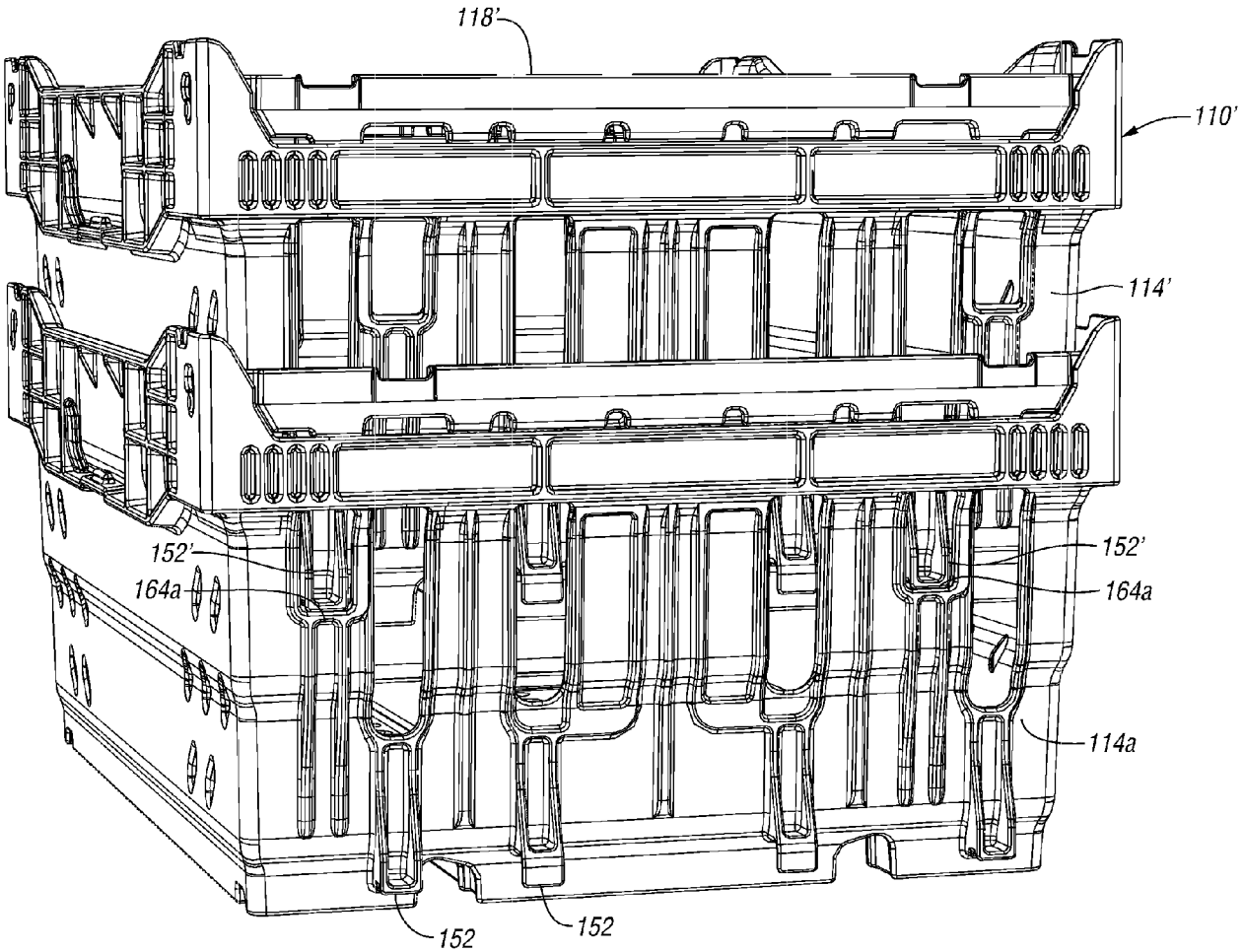
FIG. 23 shows the containers of FIG. 22 with the upper container in a reverse orientation to provide a lower stack position.

In FIG. 23, the upper container 110' is rotated 180 degrees, so that the end wall 114' is aligned with the end wall 114*a*. This causes the projections 152' of the upper container 110' to be received in and the short vertical windows 164*a* of the lower container 110, where the lower contact surfaces of the projections 152' contact support surfaces on the lower edges of the short vertical windows 164*a*. This provides a lower stacking height of the upper container 110' on the lower container 110. This provides more efficient stacking of the containers 110 for goods in the containers 110 that do not occupy all of the volume. As shown in FIG. 23, this reduces the overall stacking height of the containers 110.

It should be noted that although the container 110 is shown with a support 118 that only has two positions, the 180 degree stack/nest feature could be provided with a three (or more) position support 118, such as the three-position supports disclosed in any of the other embodiments herein.

Figure 24:
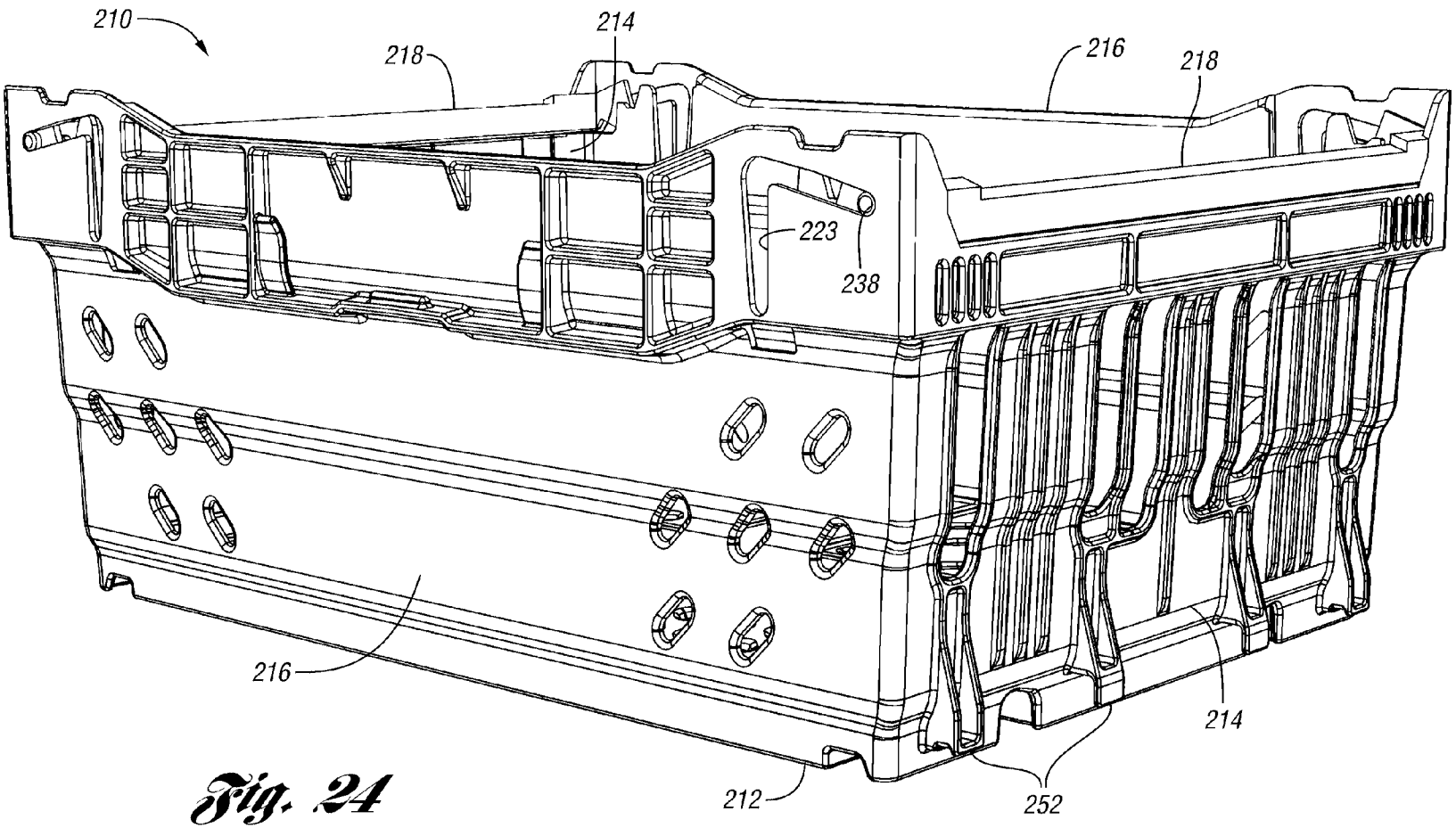
FIG. 24 is a perspective view of a container according to a third embodiment.

FIGS. 24-34 illustrate a container 210 according to a third embodiment of the present invention. FIG. 24 is a perspective view of the container 210. The container 210 includes opposed end walls 214 and opposed side walls 216 extending upwardly from a base 212. The container 210 includes a pair of supports 218 mounted adjacent each end wall 214. The supports 218 are pivotably and slidably mounted to opposite side walls 216. In FIG. 24, the supports 218 are shown in the home or nest position. Each end wall 214 includes a plurality of projections 252, which are typically used for stacking the container 210 crosswise on a container twice its size.

Figure 25:
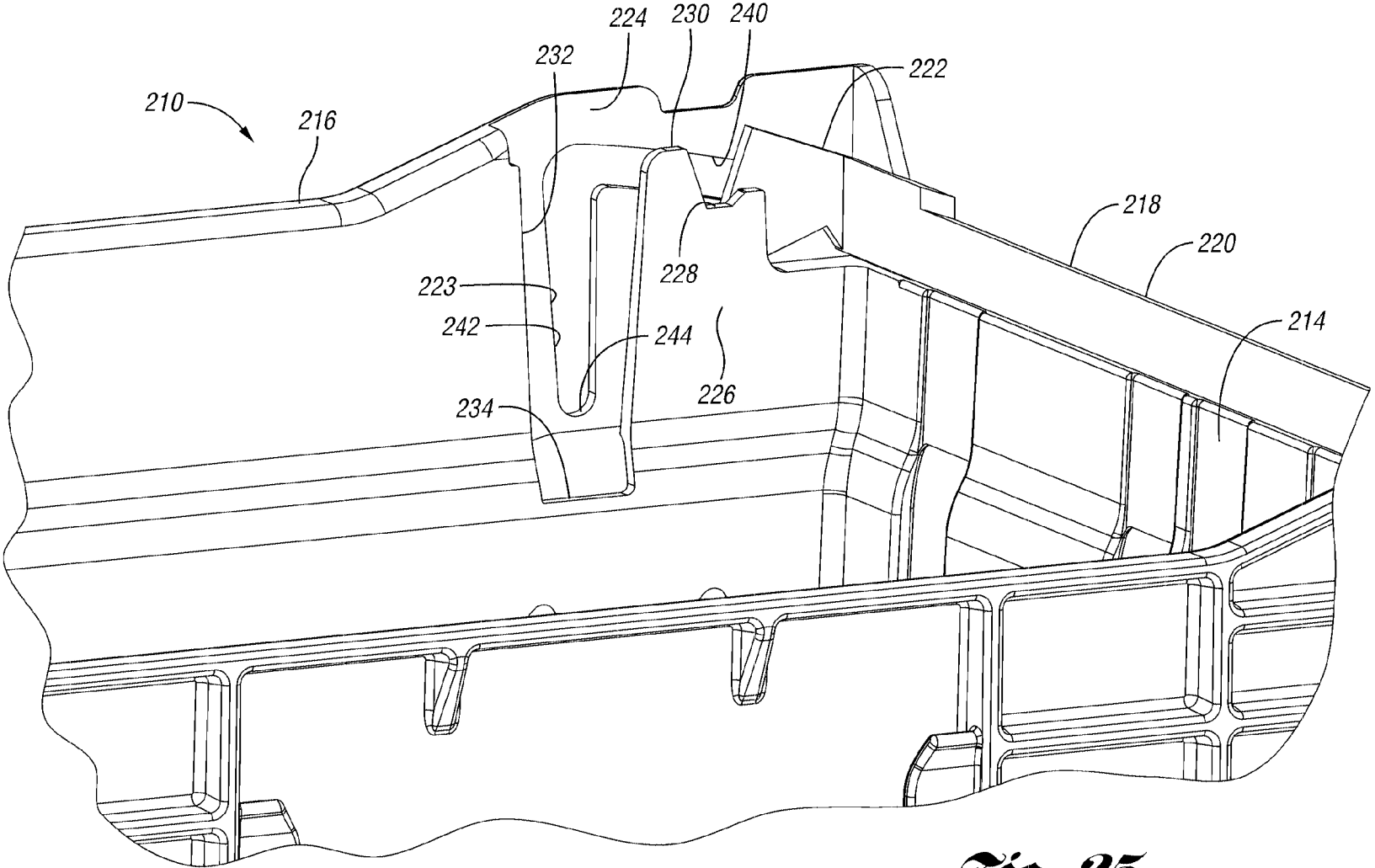
FIG. 25 is an enlarged interior view of one corner of the container of FIG. 24.

FIG. 25 is an interior view of the corner of the container 210. The side wall 216 includes an inner wall portion 226 having an upper support surface 228 with an upward projection 230 adjacent thereto. A channel 232 is formed through the inner wall portion 226 adjacent to and toward the interior of the upward projection 230. The channel 232 is partially defined by a lower support surface 234. The support 218 includes a support portion 220 extending across the container from one side wall 216 to the other (not shown) and sitting on the end wall 214 (or alternatively could be adjacent end wall 214). The support portion 220 is pivotably and slidably connected to the side walls 216 by arms 222.

Figure 26:
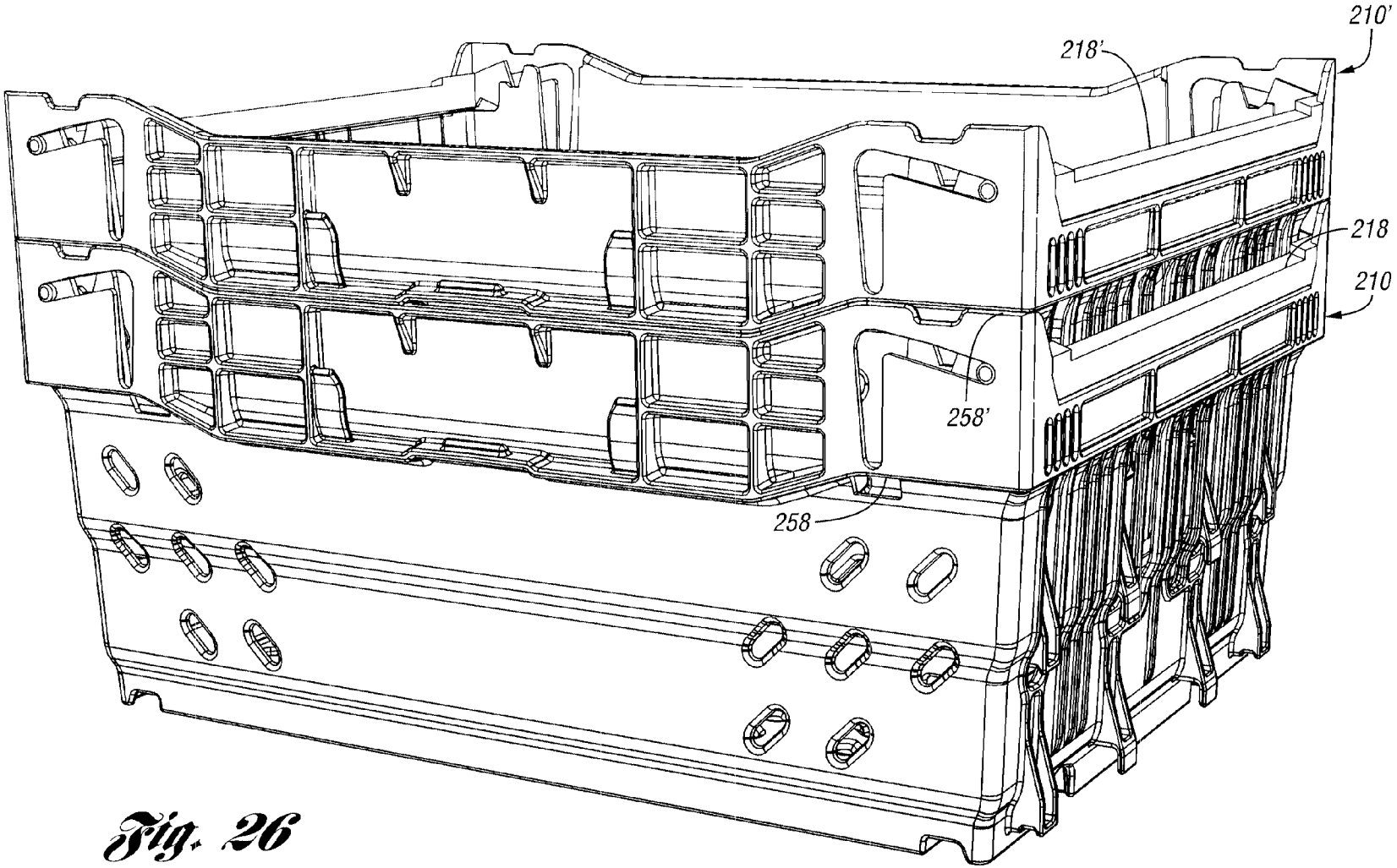
FIG. 26 is a perspective view of the container of FIG. 24 with the supports in the home position with a similar container nested therein.
Figure 27:
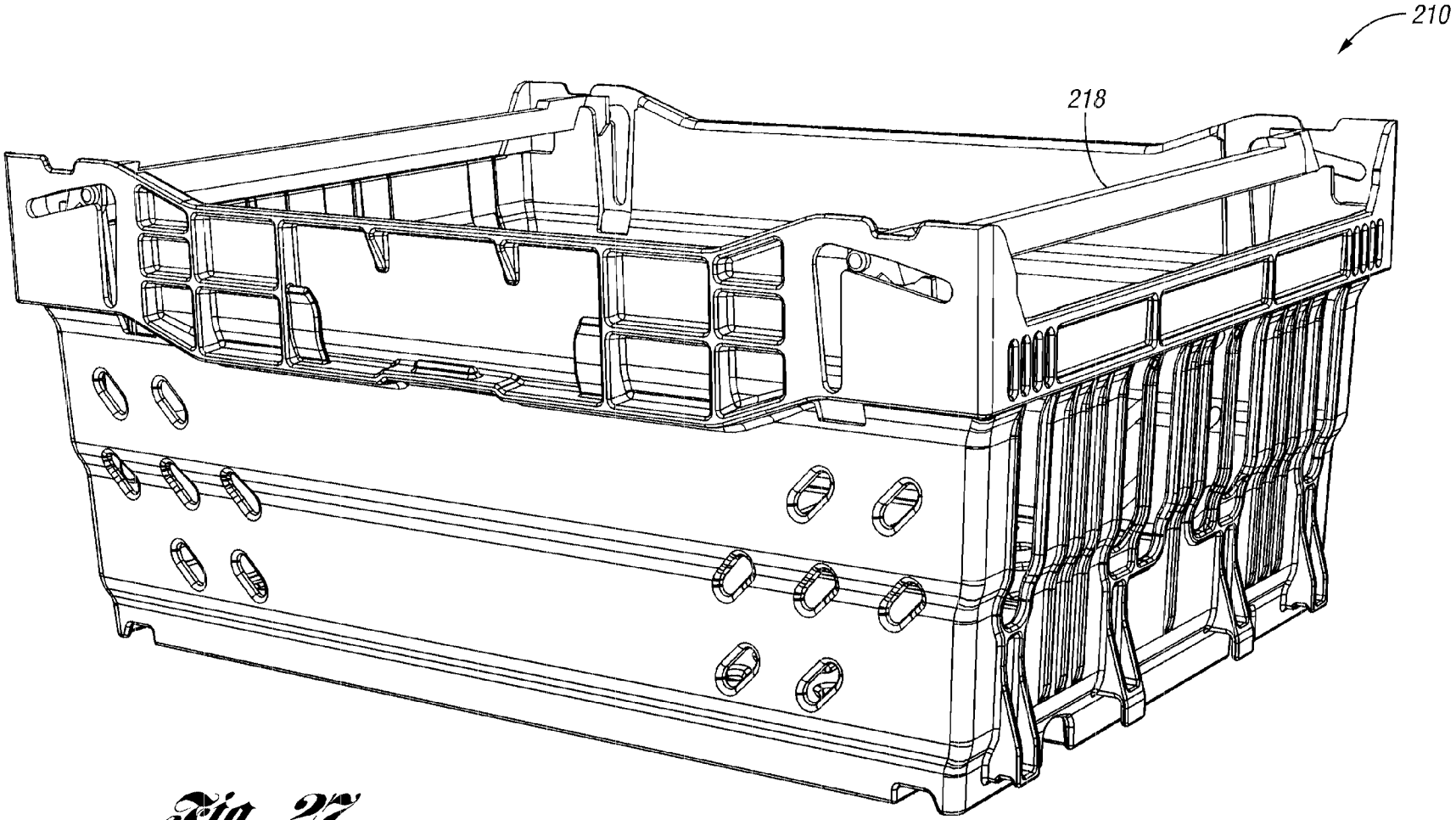
FIG. 27 is a perspective view of the container of FIG. 24 with the supports in an upper stack position.

An outer portion 224 of the side wall 216 includes an opening 223 through which the pin 238 (FIG. 24) of the support 218 is received. The opening 223 includes an upper, slanted portion 240 angling downward toward the end of the container 210, and a generally vertical portion 242 having a lower surface 244. In this embodiment, the slanted portion 240 of the opening 223 extends downward toward the end wall 214 from the generally vertical portion 242 of the opening 223. The pin 238 of the support 218 is pivotable and slidable within the opening 223. Referring to FIG. 26, as before, with the supports 218 in the retracted position, a similar container 210' can be nested to a position in which the band 258' of the upper container 210' rests on the band 258 of the lower container 210.

Figure 28:
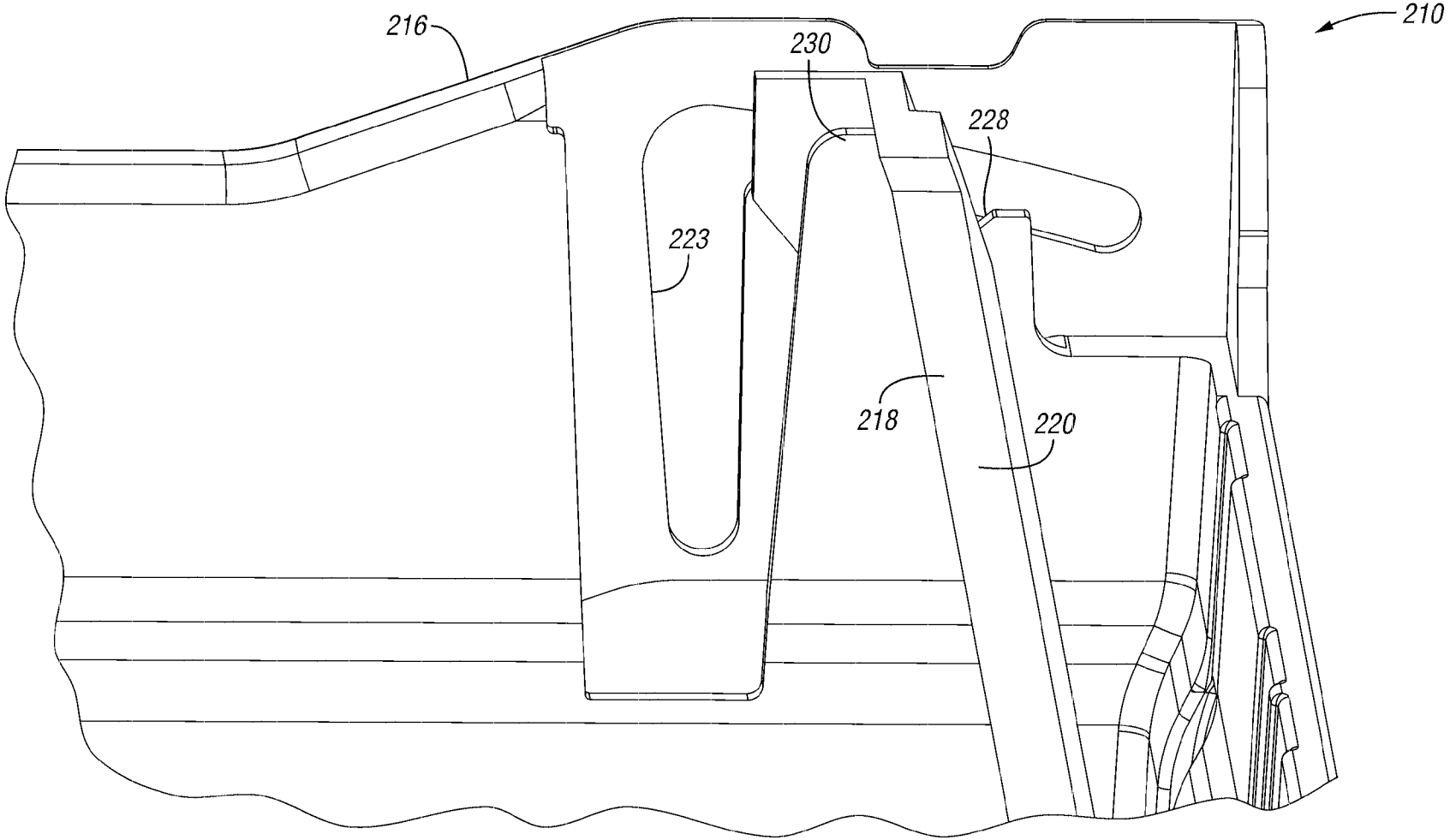
FIG. 28 is an interior corner view of the container of FIG. 24 with the support in an upper stack position.
Figure 29:
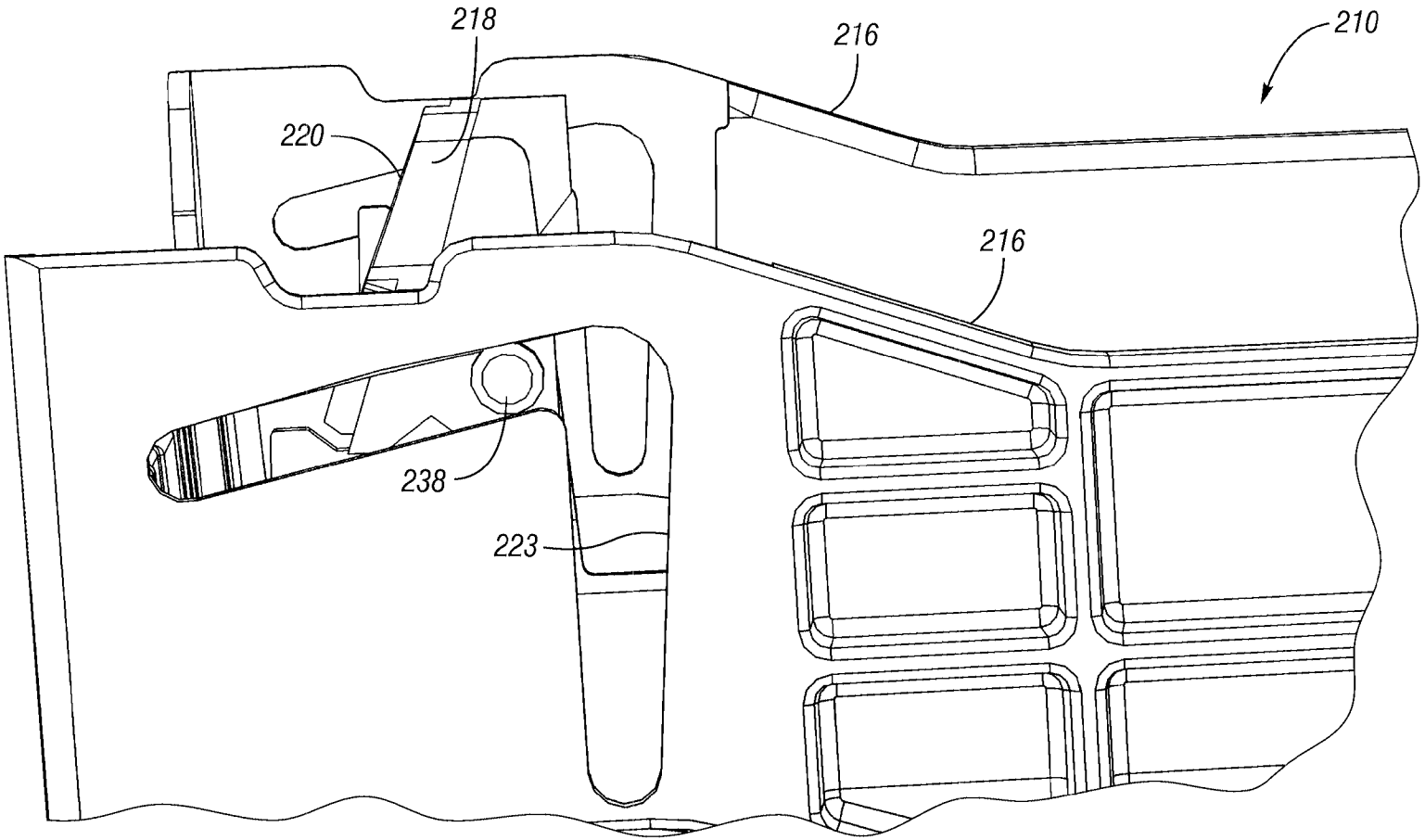
FIG. 29 is an exterior corner view of the container of FIG. 28.

FIGS. 27-30 illustrate the support 218 in the upper support position. Referring to FIGS. 28 and 29, the support 218 is supported on the upper support surface 228 of the side wall 216. To bring the support 218 out of the home position (shown in FIG. 25), the support 218 is slid in the opening 223. In this embodiment, the upper surface of the support portion 220 of the support 218 still faces upwardly in both the home (FIG. 25) and upper stack (FIG. 28) positions. As shown in FIG. 29, the pin 238 is inward of the support portion 220 in the upper stack position.

Figure 30:
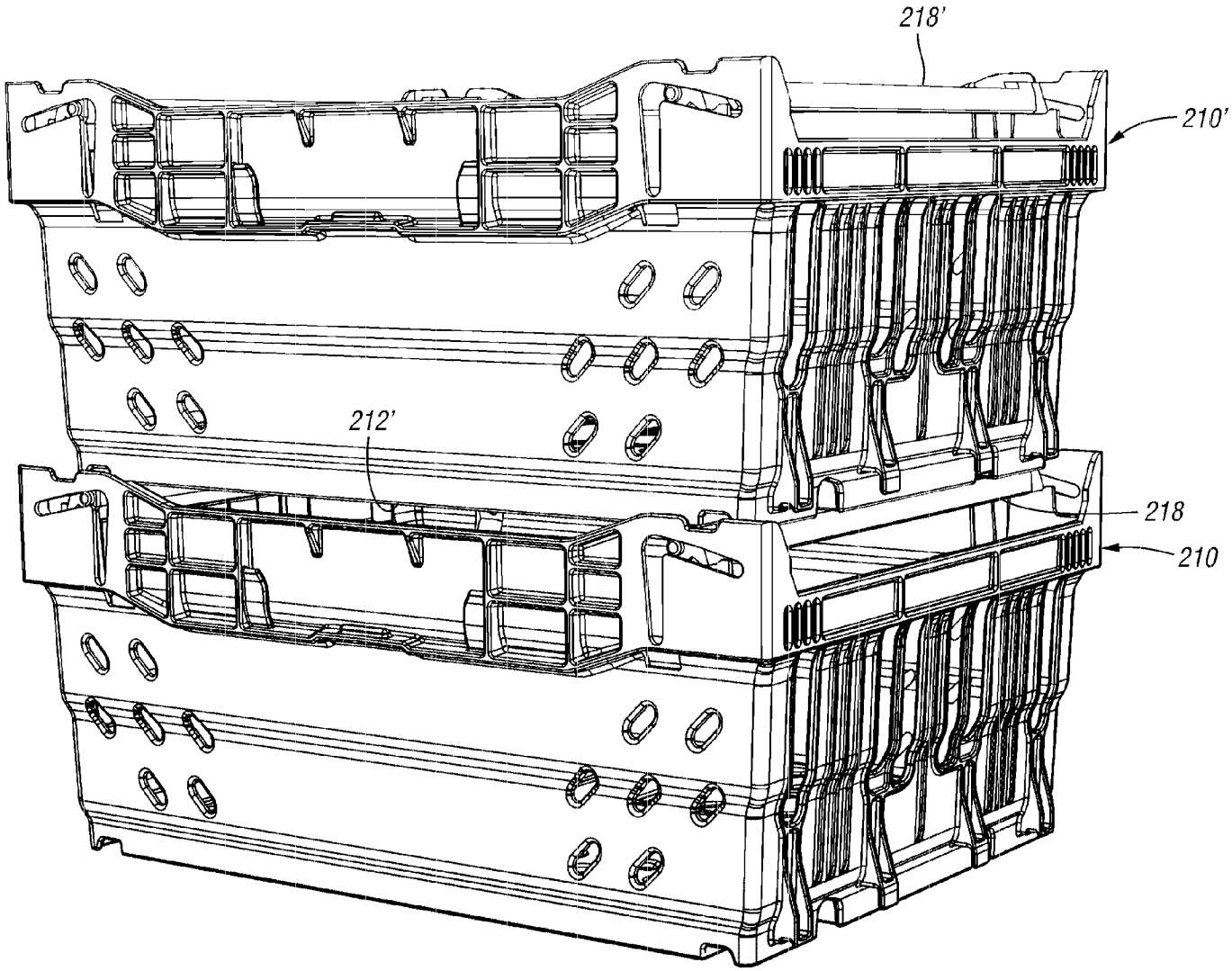
FIG. 30 is a perspective view of the container of FIG. 24 with the supports in the upper stack position and with a similar container stacked thereon.
Figure 31:
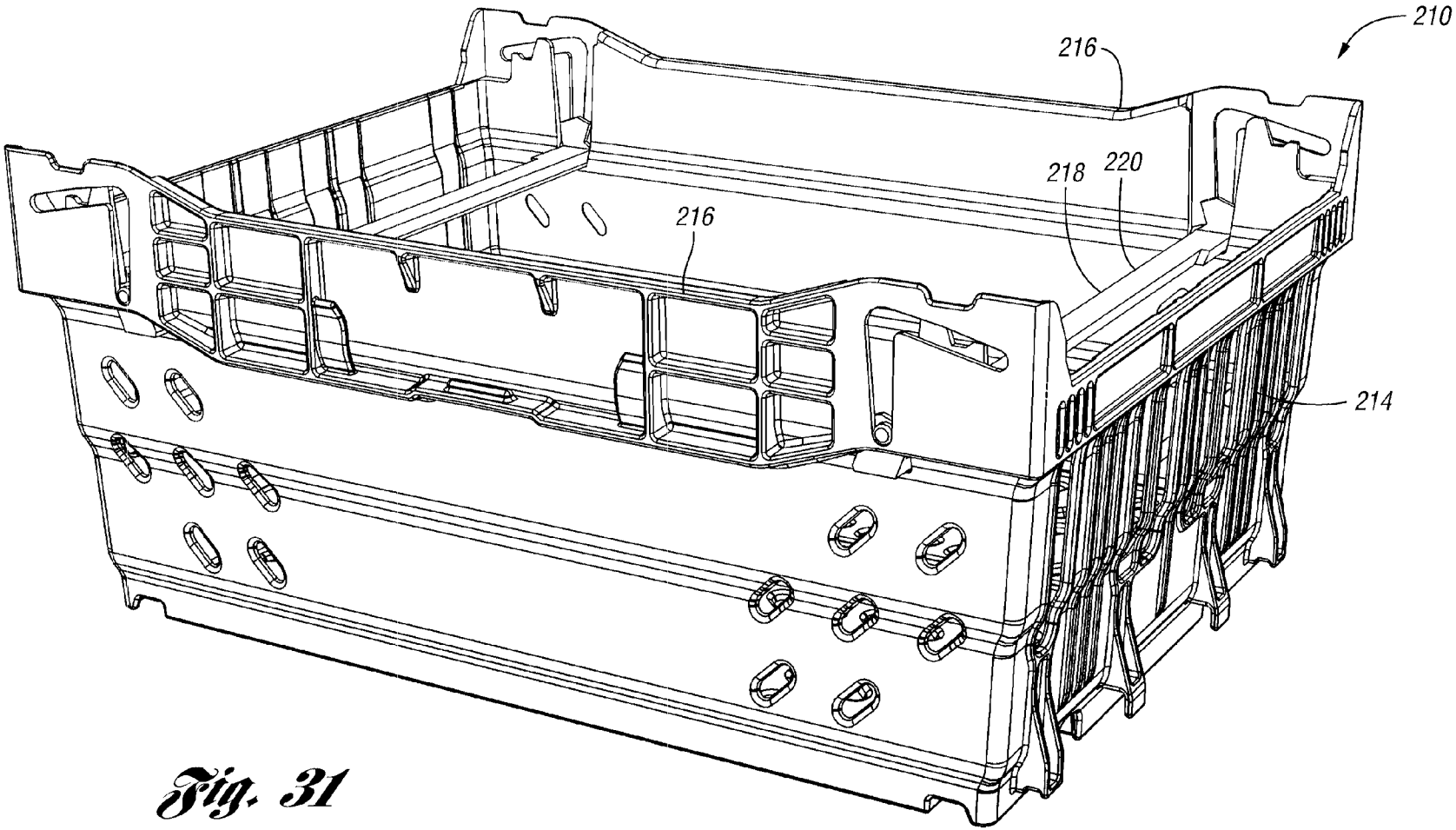
FIG. 31 is a perspective view of the container of FIG. 24 with the supports in a lower stack position.

Referring to FIG. 30, in the upper stack position, the supports 218 can support another container 210' thereon. The base 212' of the upper container 210' is supported directly on the supports 218. This provides the maximum space in the lower container 210 for goods.

Figure 32:
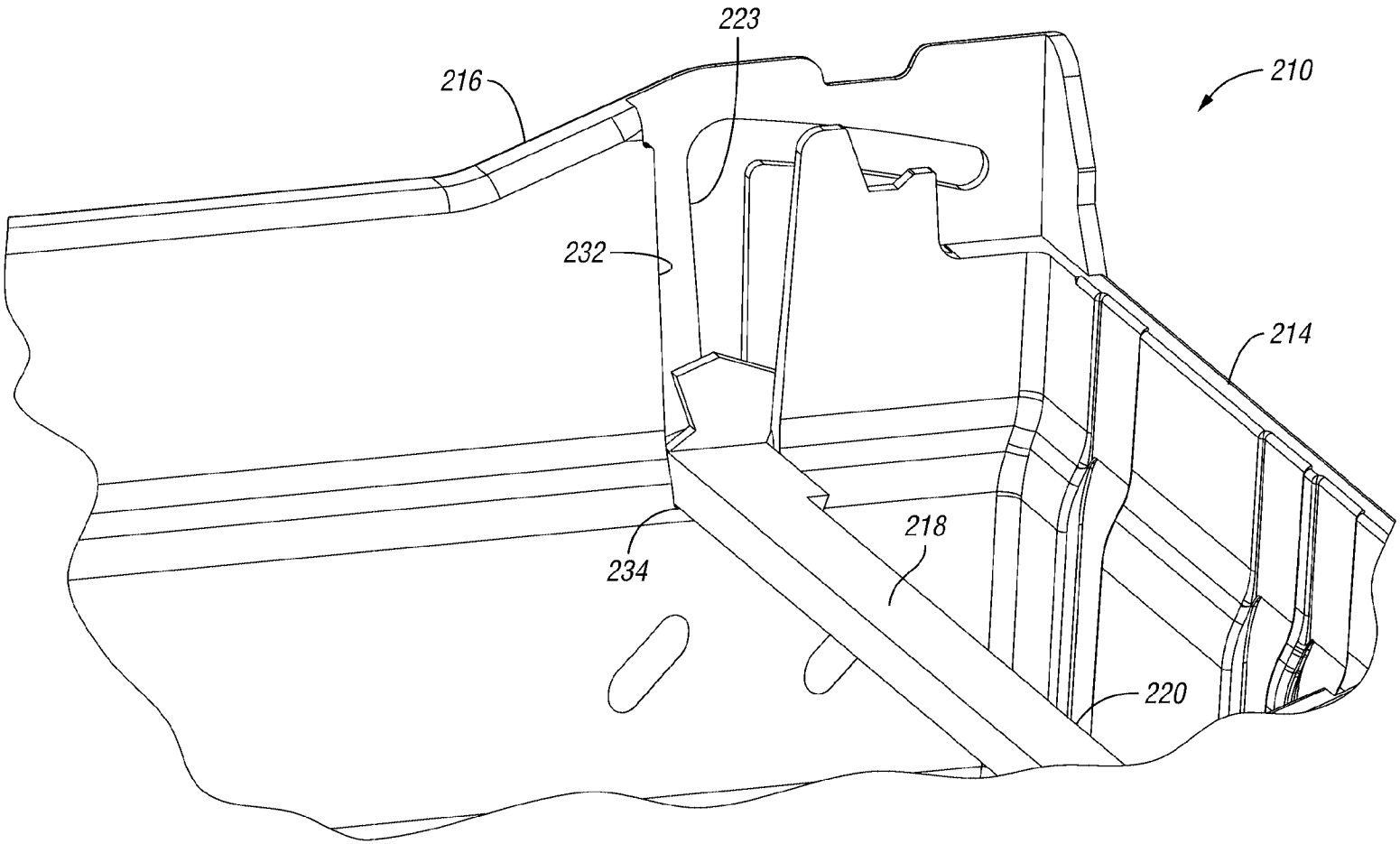
FIG. 32 is an interior corner view of the container of FIG. 24 with the support in a lower stack position.
Figure 33:
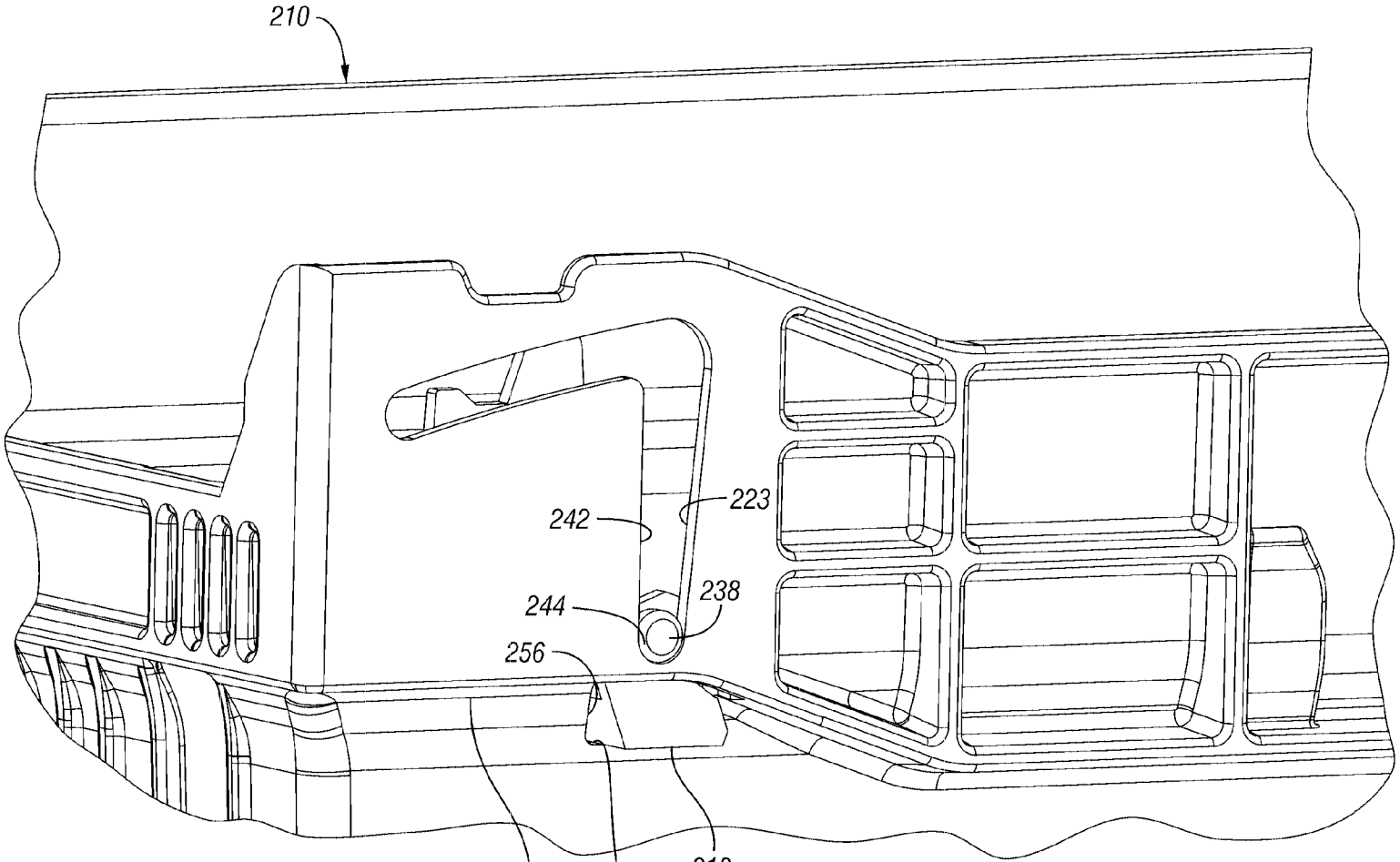
FIG. 33 is an exterior corner view of the container of FIG. 32.

FIGS. 30-34 illustrate the container 210 with the support 218 in the lower support position. As shown in FIG. 32, the support 218 is supported on the lower support surface 234 in the channel 232. The pin 238 (FIG. 33) of the support 218 is pivotable and slidable within the opening 223 to the lowermost position on the lower surface 244 of the channel 242 in the outer wall portion of the side wall 216. The support 218 is rotated to where the support portion 220 is roughly ninety degrees relative to the upper stack and home positions, thereby presenting the broad side of the support portion 220 upwardly. As shown in FIG. 33, the end of the support 218 is also supported on a lower surface 260 of an opening 256 through the side wall 216 below the band 258. This permits the support 218 to be lower in the container 210.

Figure 34:
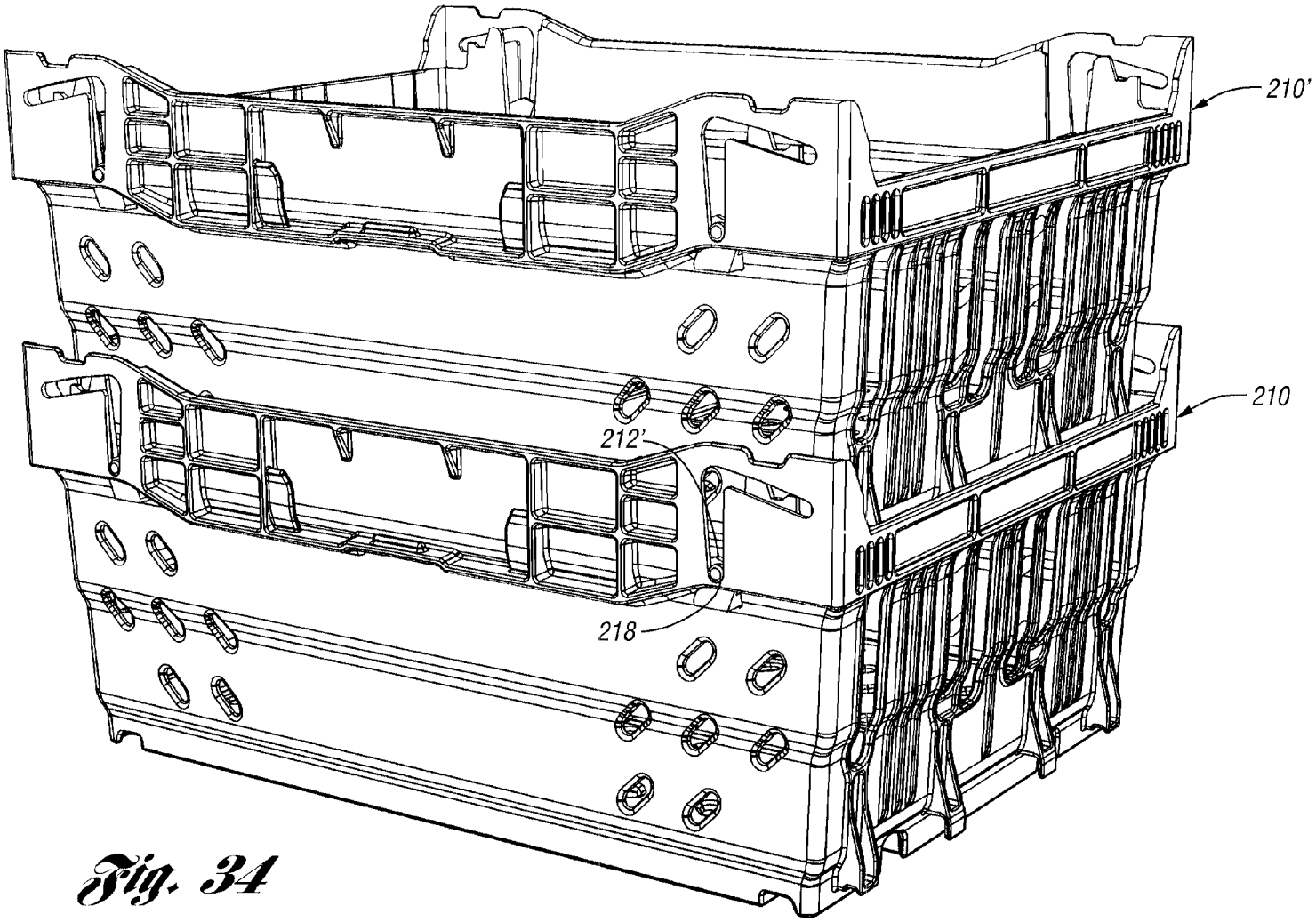
FIG. 34 is a perspective view of the container of FIG. 24 with the supports in the lower stack position and with a similar container stacked thereon.

Referring to FIG. 34, when the upper container 210' is stacked on the lower container 210 with the support 218 in the lower support position, base 212' of the upper container 210' is supported on the support portions 220 of the supports 218. This provides more efficient stacking of the containers 210 for goods in the containers 210 that do not occupy all of the volume. This reduces the overall stacking height of the containers 210.

Notably, in the embodiment of FIGS. 24-34, the support portion 220 is toward the interior of the container 210 in the lower stack position relative to the support portion 220 in the upper stack position. Also notably, the upper surface of the support portion 220 faces upwardly in both the home/nest position and the upper stack position. Further, the support portion 220 in the lower stack position is in an orientation roughly ninety degrees relative to the upper stack position and home/nest position.

Figure 35:
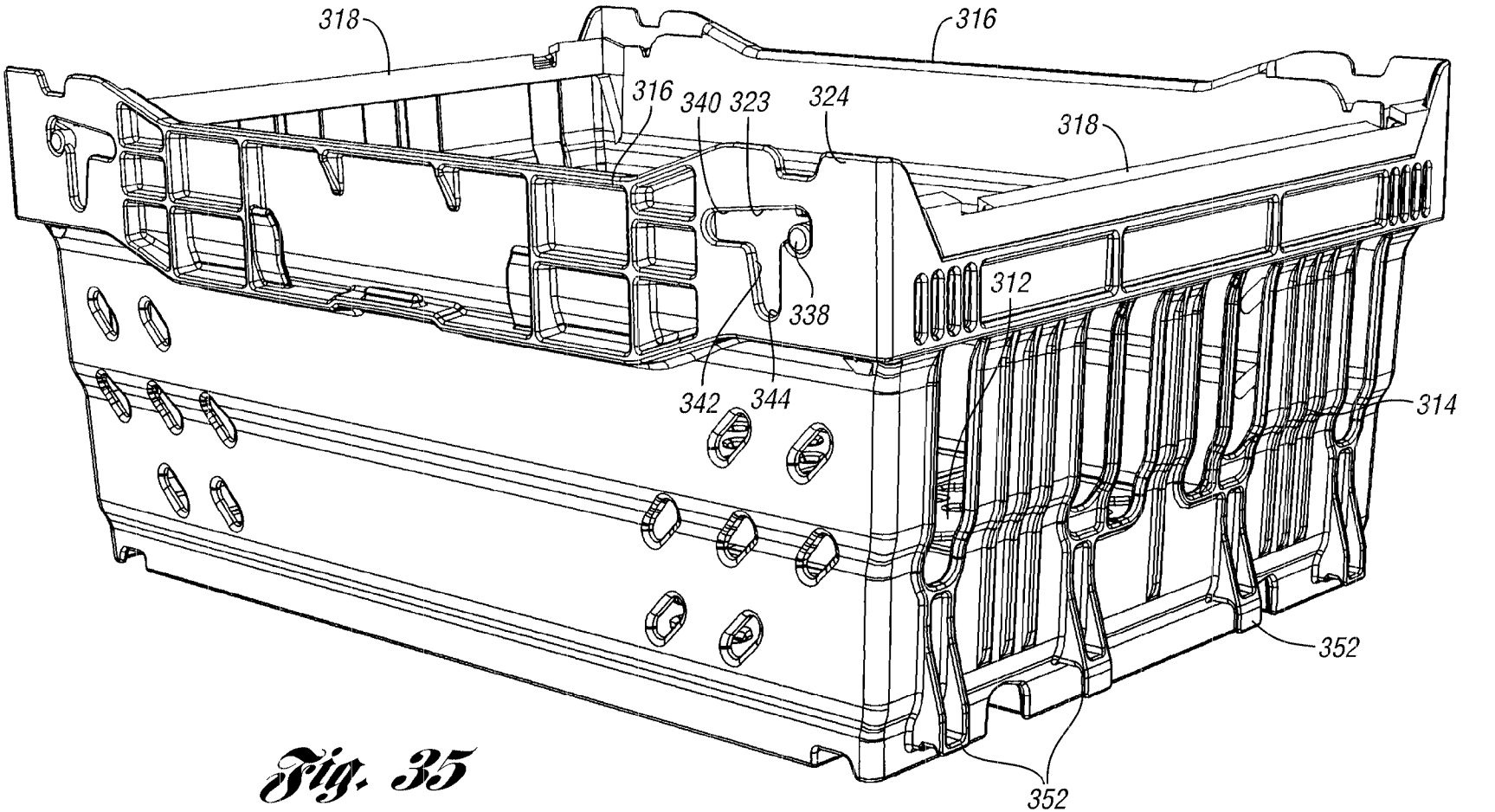
FIG. 35 is a perspective view of a container according to a fourth embodiment.
Figure 36:
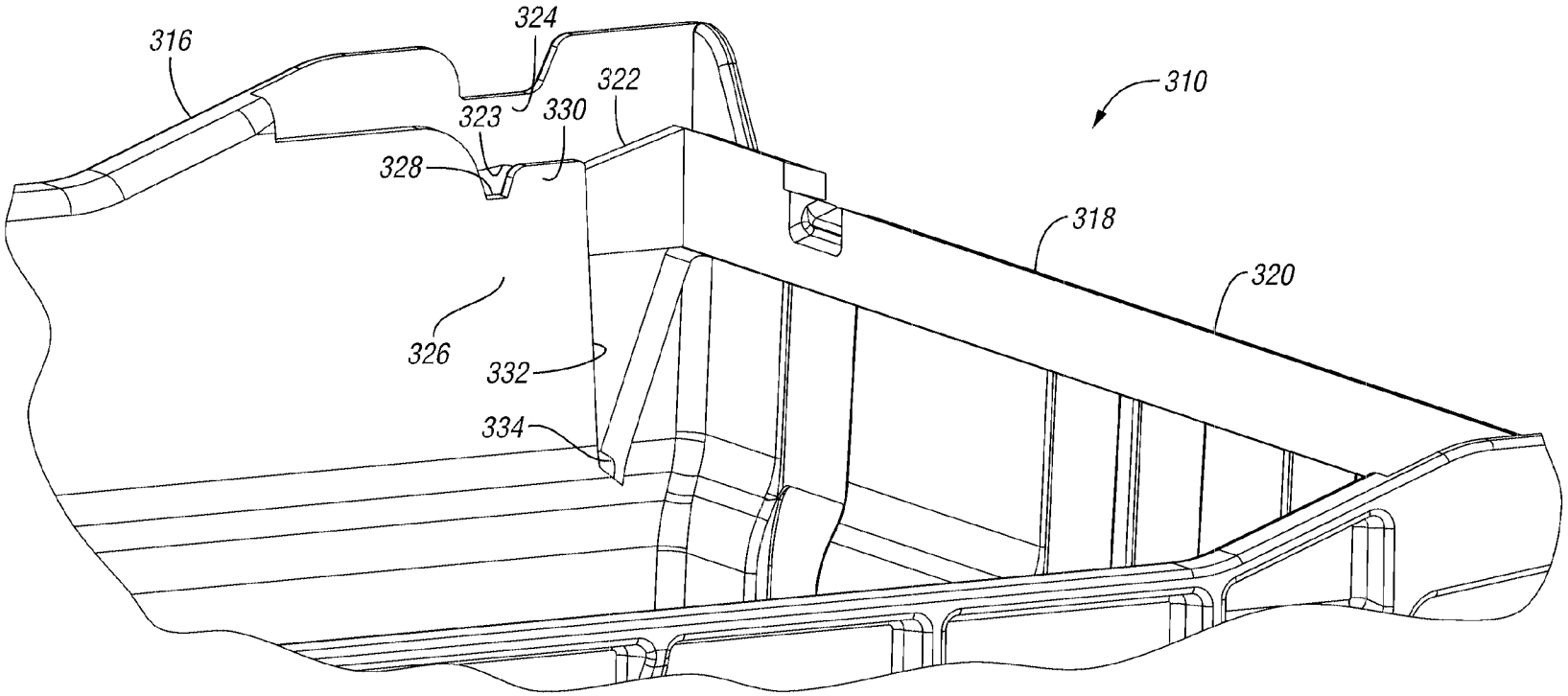
FIG. 36 is an enlarged interior view of one corner of the container of FIG. 35.

A container 310 according to a fourth embodiment of the present invention is shown in FIGS. 35-46. FIG. 35 is a perspective view of the container 310. The container 310 includes opposed end walls 314 and opposed side walls 316 extending upwardly from a base 312. The container 310 includes a pair of supports 318 mounted adjacent each end wall 314. The supports 318 are pivotably and slidably mounted to opposite side walls 316. In FIGS. 35 and 36, the supports 318 are shown in the home or nest position. Each end wall 314 includes a plurality of projections 352, which are typically used for stacking the container 310 crosswise on a container twice its size.

The outer portion 324 of the side wall 316 includes an opening 323 through which the pin 338 of the support 318 is received. The opening 323 includes an upper, slightly slanted portion 340 angling downward toward the interior of the container 310, and a generally vertical portion 342 having a lower surface 344. In this embodiment, the slanted portion 340 of the opening 323 extends downward away from the end wall 314 and the generally vertical portion 342 of the opening 323 extends downward from a mid-portion of the slanted portion 340, forming a general "T" shape. A recess for receiving the pin 338 is formed adjacent the forward edge (nearest the end wall 314) of the slanted portion 340. As shown, when the support 318 is in the home position, the pin 338 is in the recess 334. The pin 338 of the support 318 is pivotable and slidable within the opening 323.

Figure 37:
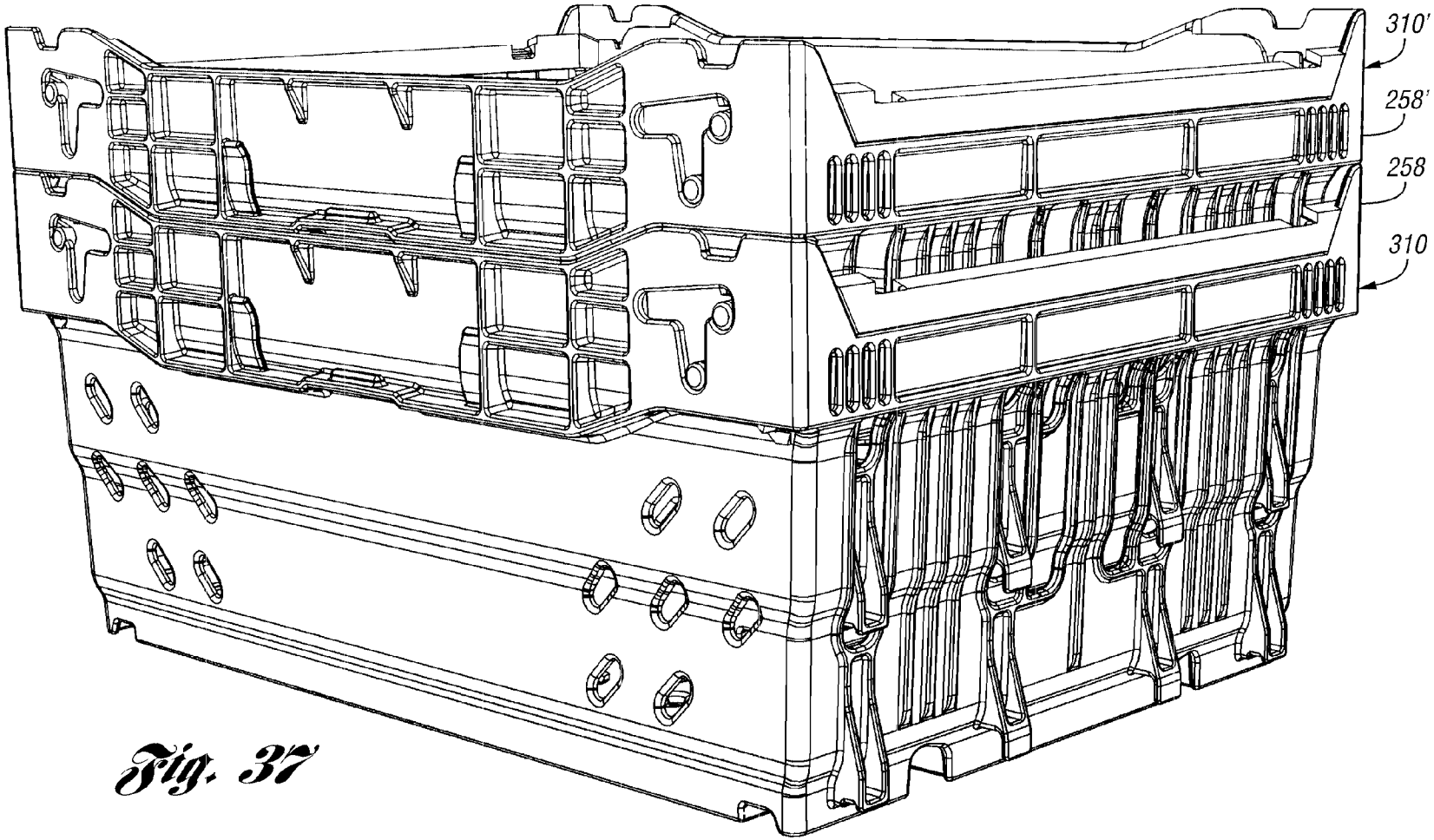
FIG. 37 is a perspective view of the container of FIG. 35 with the supports in the home position with a similar container nested therein.
Figure 38:
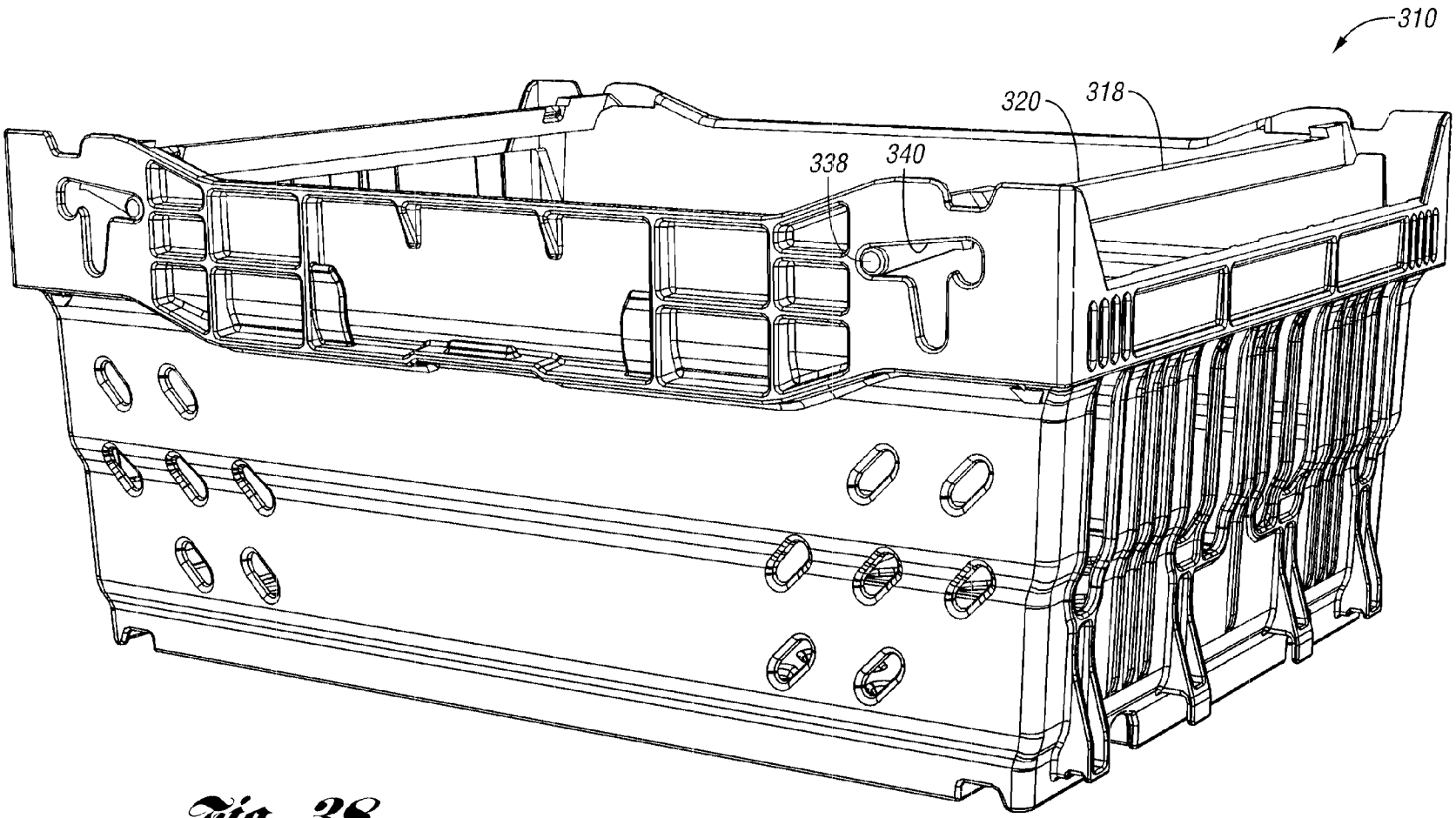
FIG. 38 is a perspective view of the container of FIG. 35 with the supports in an upper stack position.

FIG. 36 is an interior view of the corner of the container 310. The side wall 316 includes an inner wall portion 326 having an upper support surface 328 with an upward projection 330 adjacent thereto. A channel 332 is formed through the inner wall portion 326 adjacent to and toward the exterior of the upward projection 330. The channel 332 is partially defined by a lower support surface 334. The support 318 includes a support portion 320 extending across the container from one side wall 316 to the other (not shown) and sitting on the end wall 314 (or alternatively could be adjacent end wall 314). The support portion 320 is pivotably and slidably connected to the side walls 316 by arms 322. As before, with the supports 318 in the retracted position, a similar container can be nested to a position in which the band of the upper container rests on the band of the lower container 310, as shown in FIG. 37.

Figure 39:
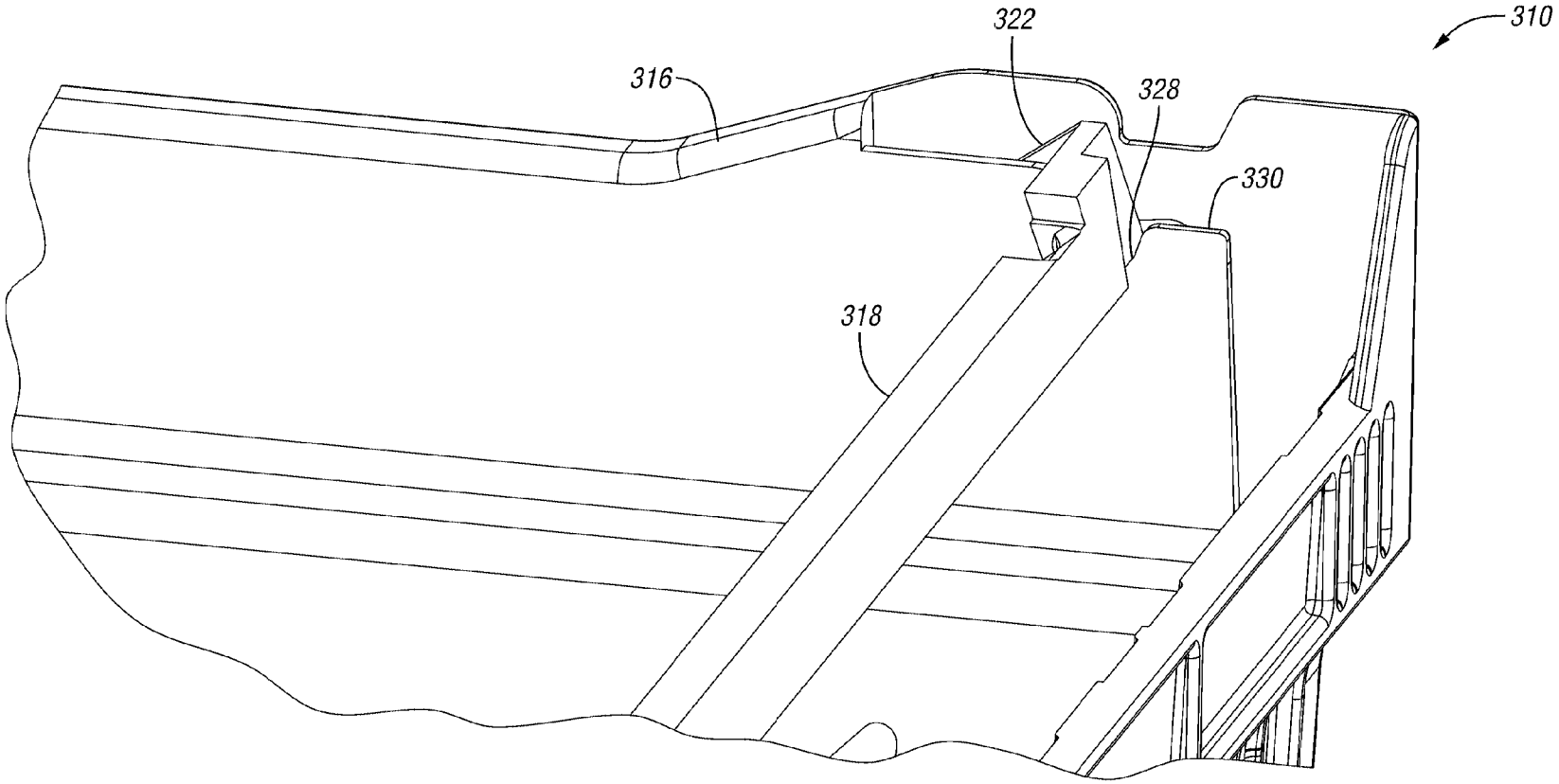
FIG. 39 is an interior corner view of the container of FIG. 35 with the support in an upper stack position.
Figure 40:
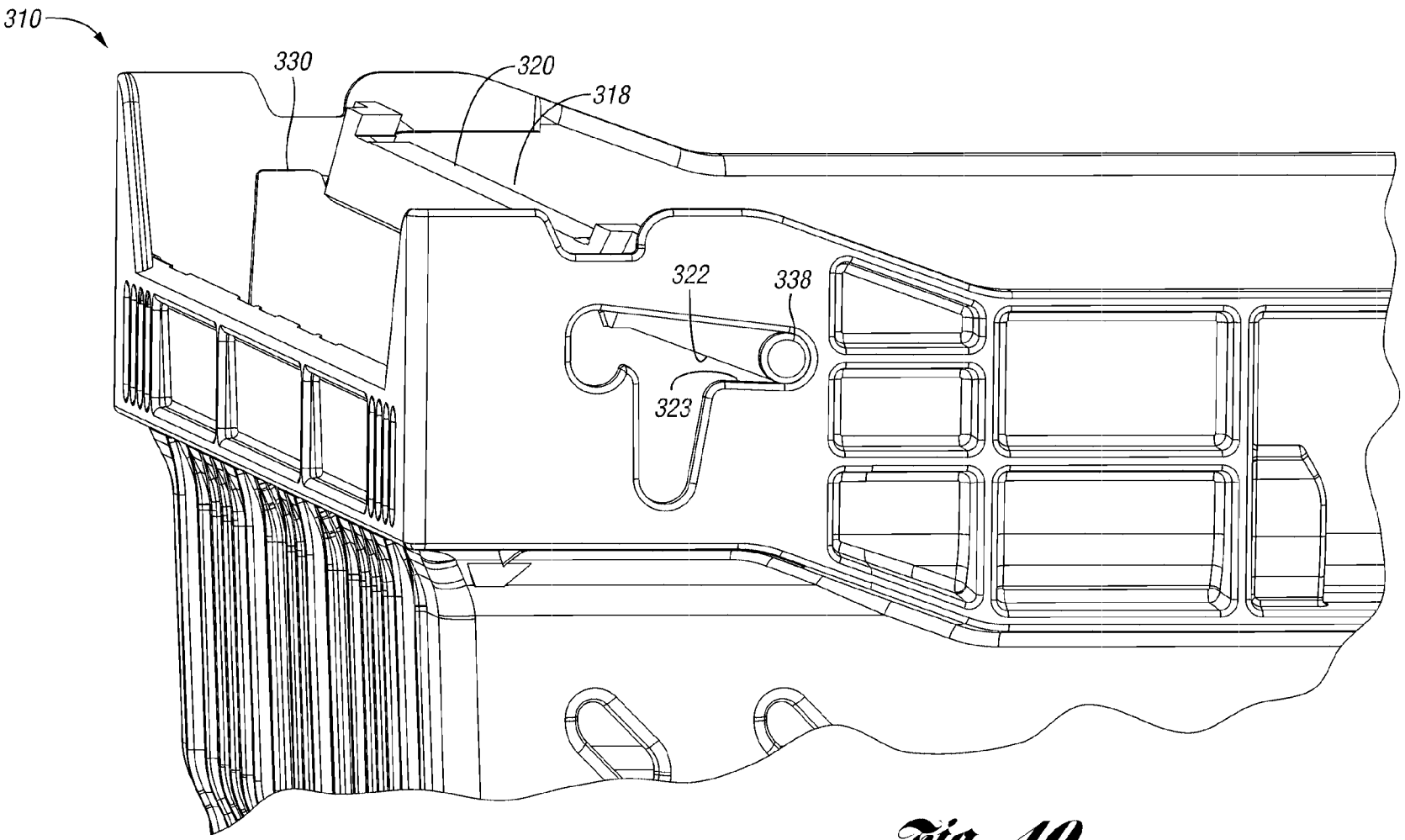
FIG. 40 is an exterior corner view of the container of FIG. 39.
Figure 41:
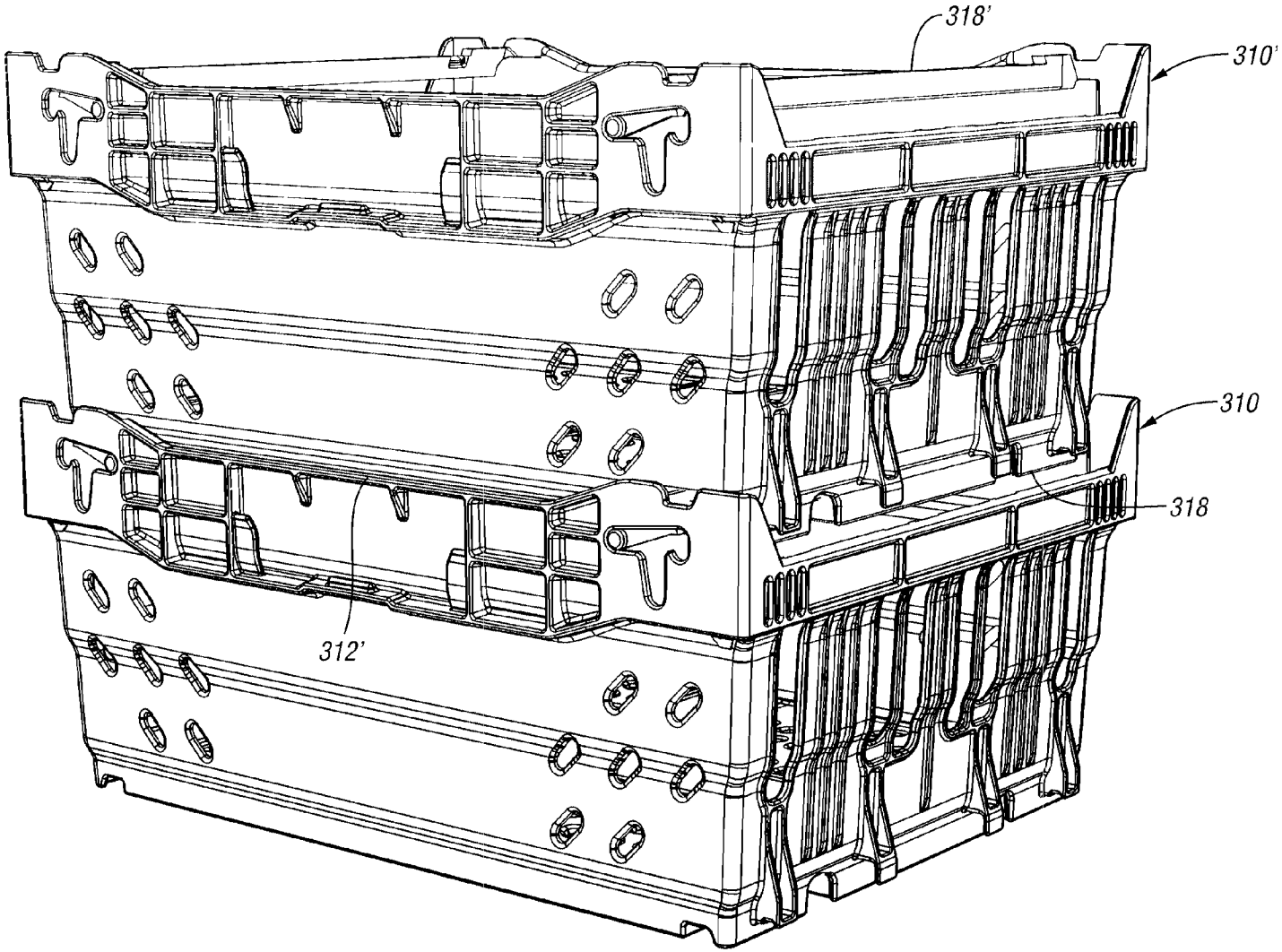
FIG. 41 is a perspective view of the container of FIG. 35 with the supports in the upper stack position and with a similar container stacked thereon.
Figure 42:
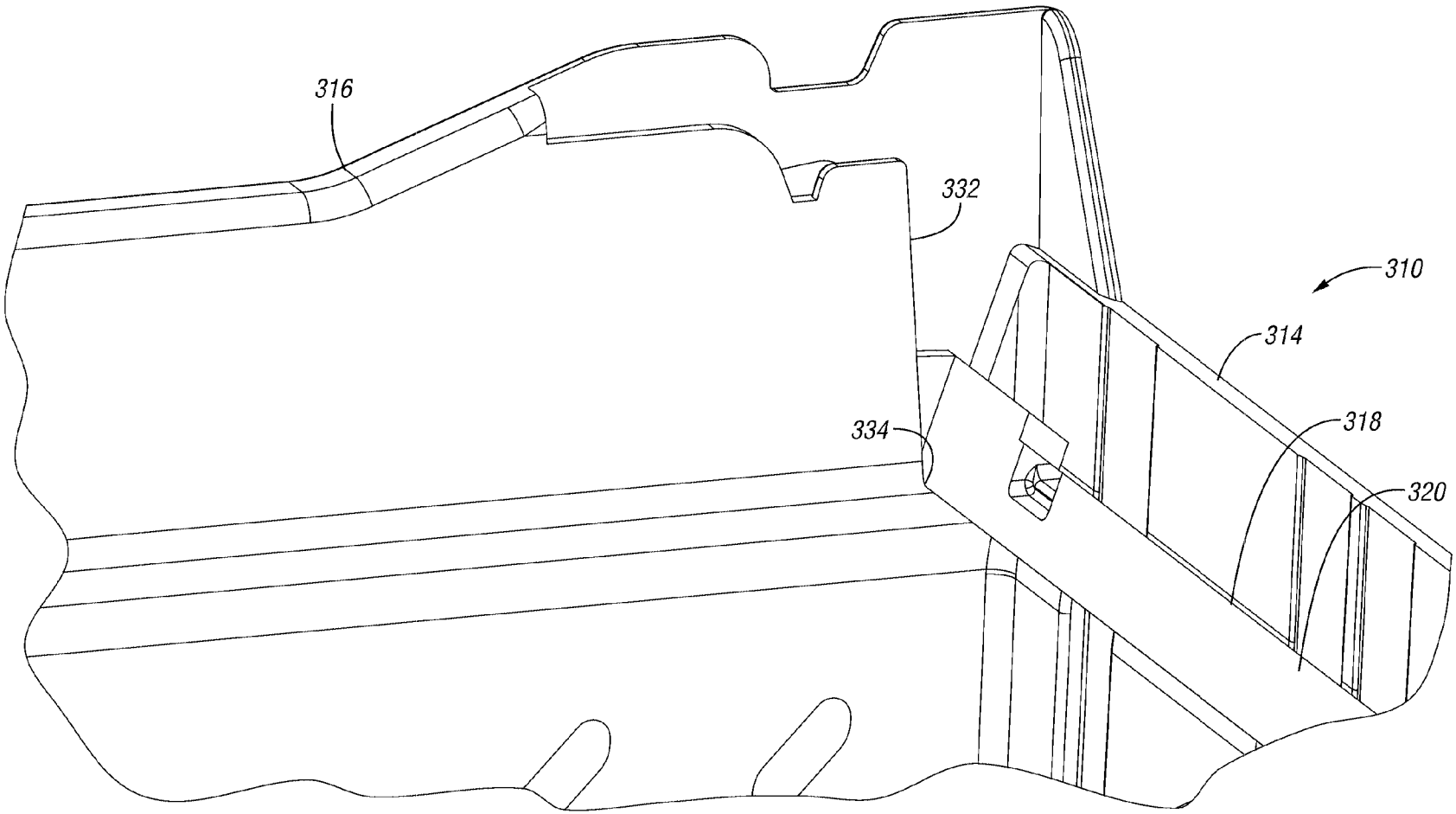
FIG. 42 is a perspective interior view of a corner of the container of FIG. 35 with the support in a lower stack position.
Figure 43:
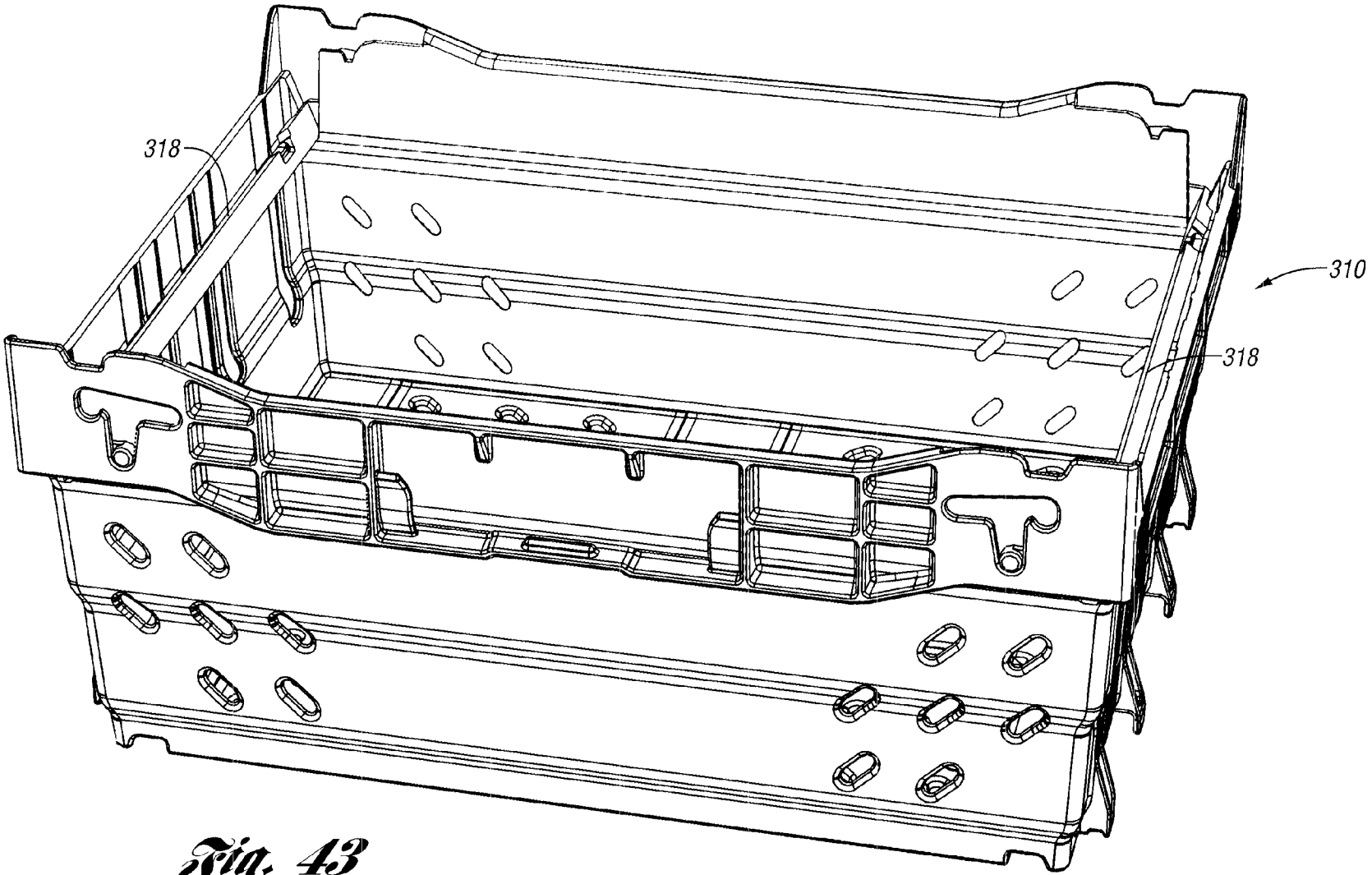
FIG. 43 is a perspective view of the container of FIG. 35 with the supports in the lower stack position.

FIGS. 38-41 illustrate the support 318 in the upper support position. Referring to FIG. 39, the support 318 is supported on the upper support surface 328 of the side wall 316. Referring to FIG. 40, to bring the support 318 out of the home position (shown in FIG. 36), the support 318 is lifted a short height vertically (to bring pin 338 out of the recess), and then the support 318 is pushed toward the interior of the crate until the pin 338 is at the most interior edge of the opening 323. During this movement, the support portion 320 is lifted over the projection 330 and set into the upper stack position. In this embodiment, the upper surface of the support portion 320 again faces upward, and the pin 338 is inward of the support portion 320, in both the home/nest and upper stack positions. In FIG. 41, the base 312' of the upper container 310' is supported on the supports 318 to provide maximum space for products in the lower container 310.

Figure 44:
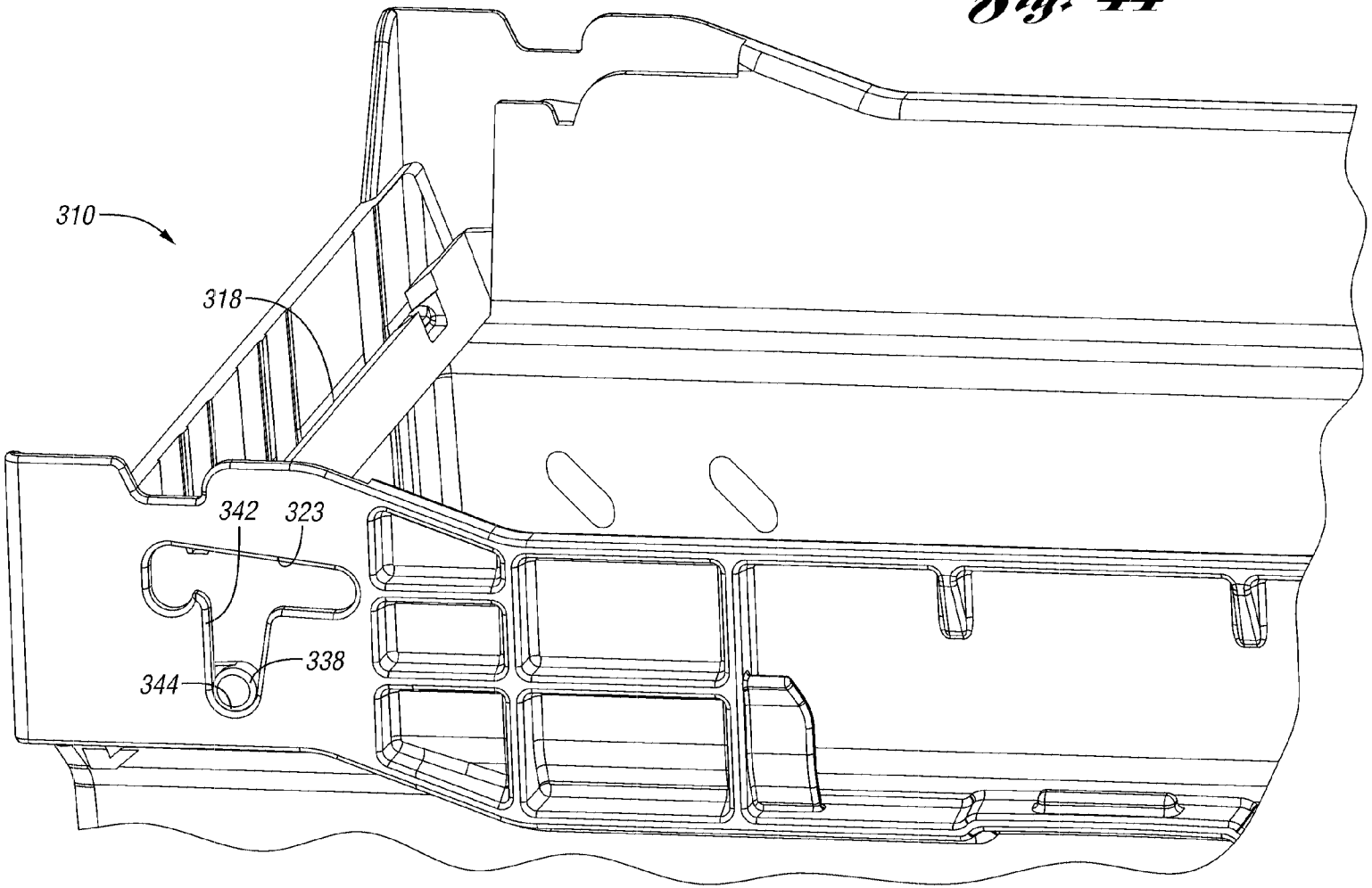
FIG. 44 is an exterior corner view of the container of FIG. 43.

FIGS. 42-46 illustrate the container 310 with the support 318 in the lower support position on the lower support surface 334 in the channel 332. Referring to FIG. 44, the pin 338 of the support 318 is pivotable and slidable within the opening 323 to the lower-most position on the lower surface 344 of the channel 342 in the outer wall portion of the side wall 316. For the lower position the pin 338 slid down the vertical channel 342, and the support 318 is then rotated slightly to place the support 318 into the lower stack position.

Figure 45:
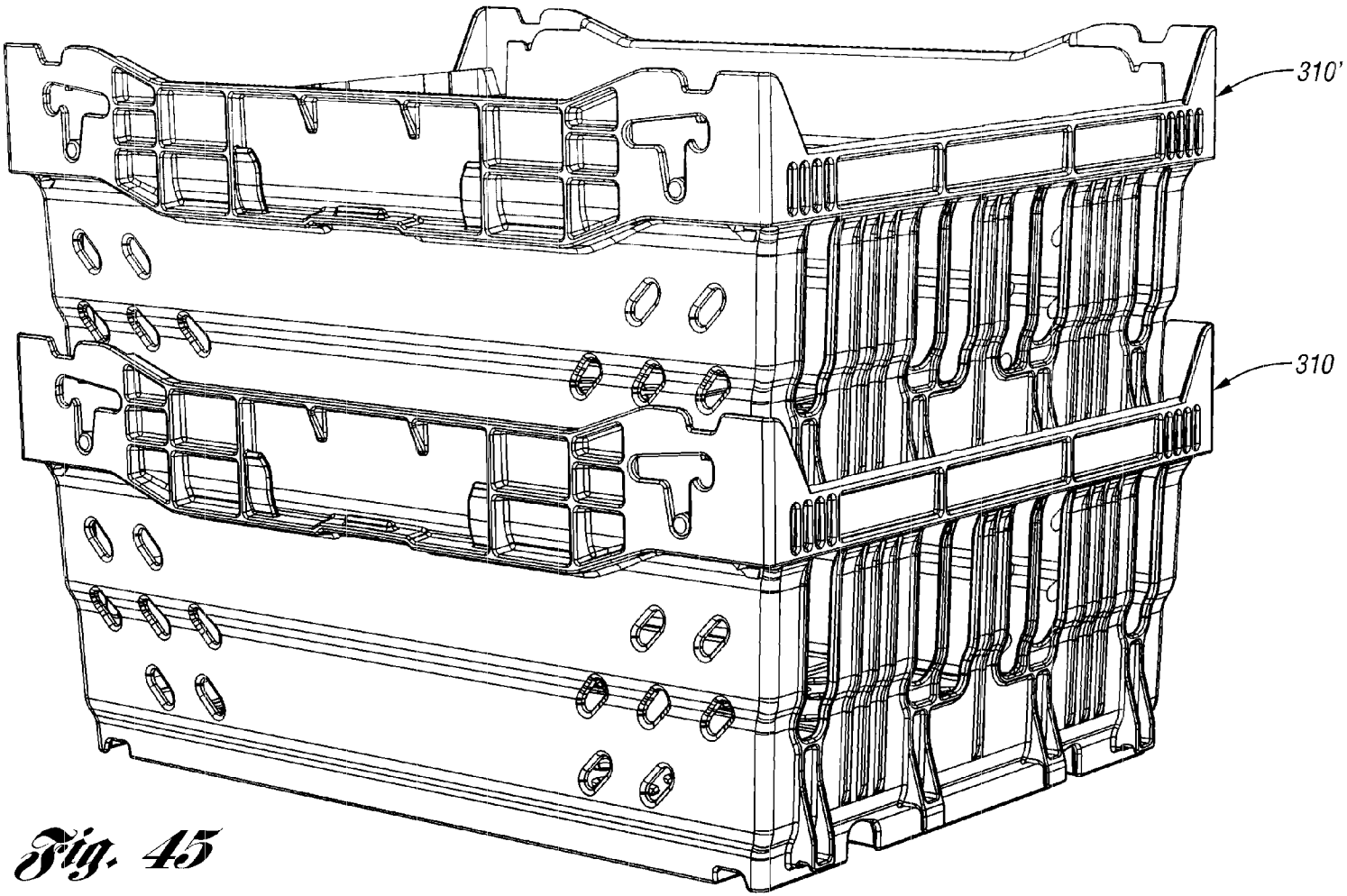
FIG. 45 is a perspective view of the container of FIG. 35 with the supports in the lower stack position and with a similar container stacked thereon.
Figure 46:
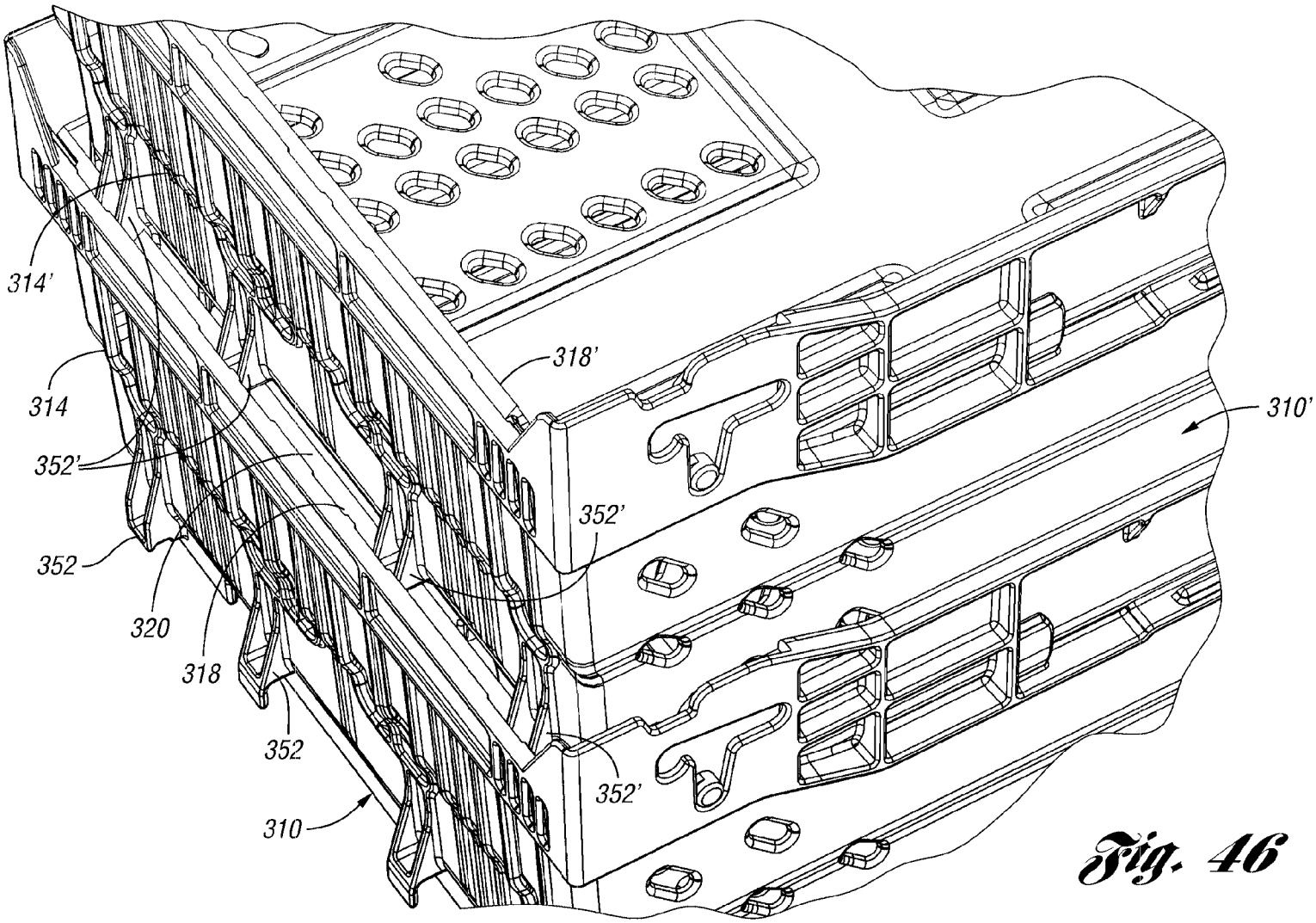
FIG. 46 is an upper perspective view of one end of the containers of FIG. 45.

In FIG. 45, the upper container 318' is stacked on the supports 318 of the lower container 318'. As can be seen in FIG. 46, the lower contact surfaces of the projections 352' on the end walls 314 of the upper container 310' are supported on the support portions 320 of the supports 318. This provides a lower stacking height of the upper container 310' on the lower container 310. This provides more efficient stacking of the containers 310 for goods in the containers 310 that do not occupy all of the volume. This reduces the overall stacking height of the containers 310.

Figure 47:
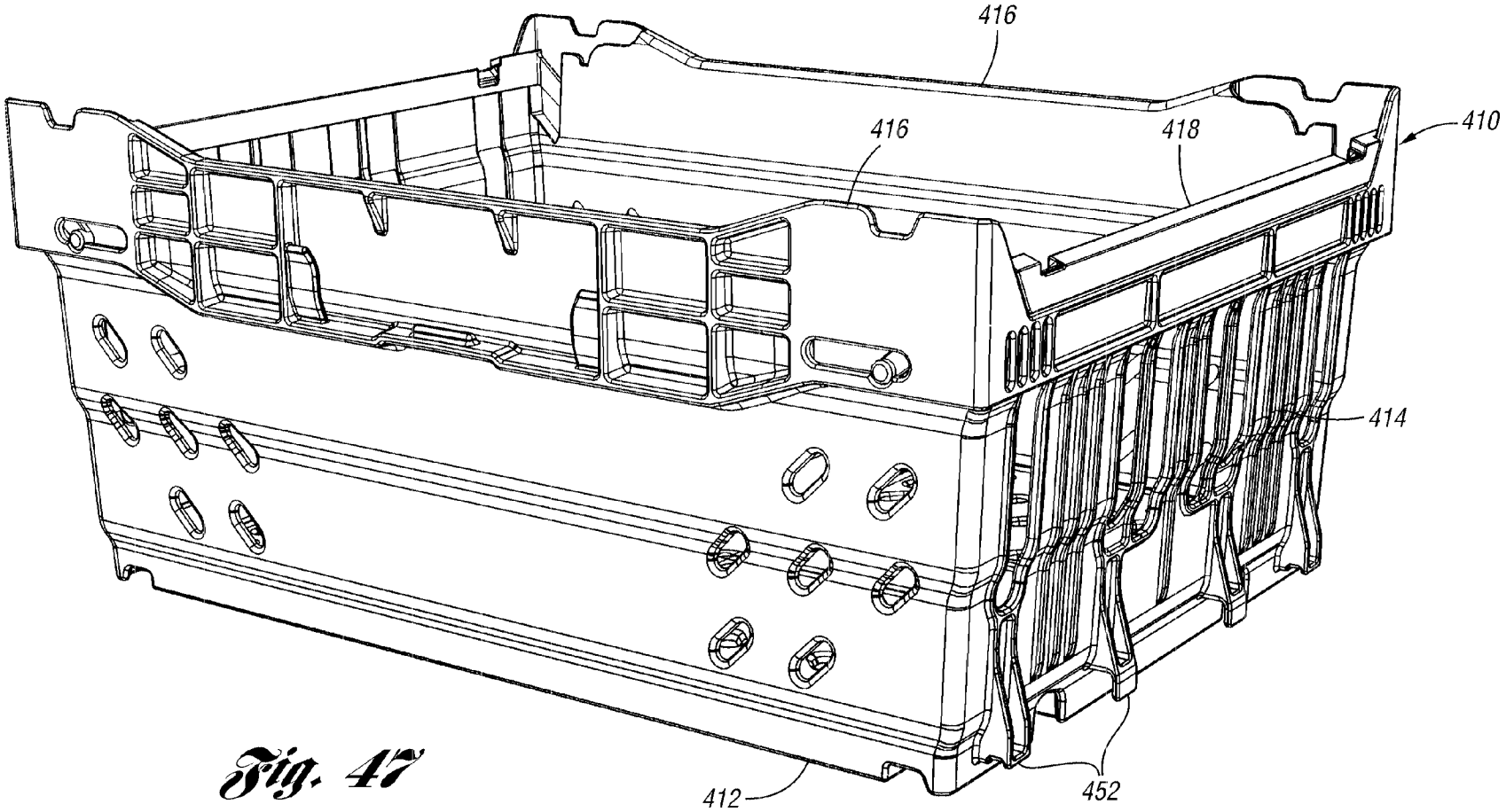
FIG. 47 is a perspective view of a container according to a fifth embodiment.

A container 410 according to a fourth embodiment of the present invention is shown in FIGS. 47-59. FIG. 47 is a perspective view of the container 410. The container 410 includes opposed end walls 414 and opposed side walls 416 extending upwardly from a base 412. The container 410 includes a pair of supports 418 mounted adjacent each end wall 414. The supports 418 are pivotably and slidably mounted to opposite side walls 416. In FIGS. 47-50, the supports 418 are shown in the home or nest position. Each end wall 414 includes a plurality of projections 452, which are typically used for stacking the container 410 crosswise on a container twice its size.

Figure 48:
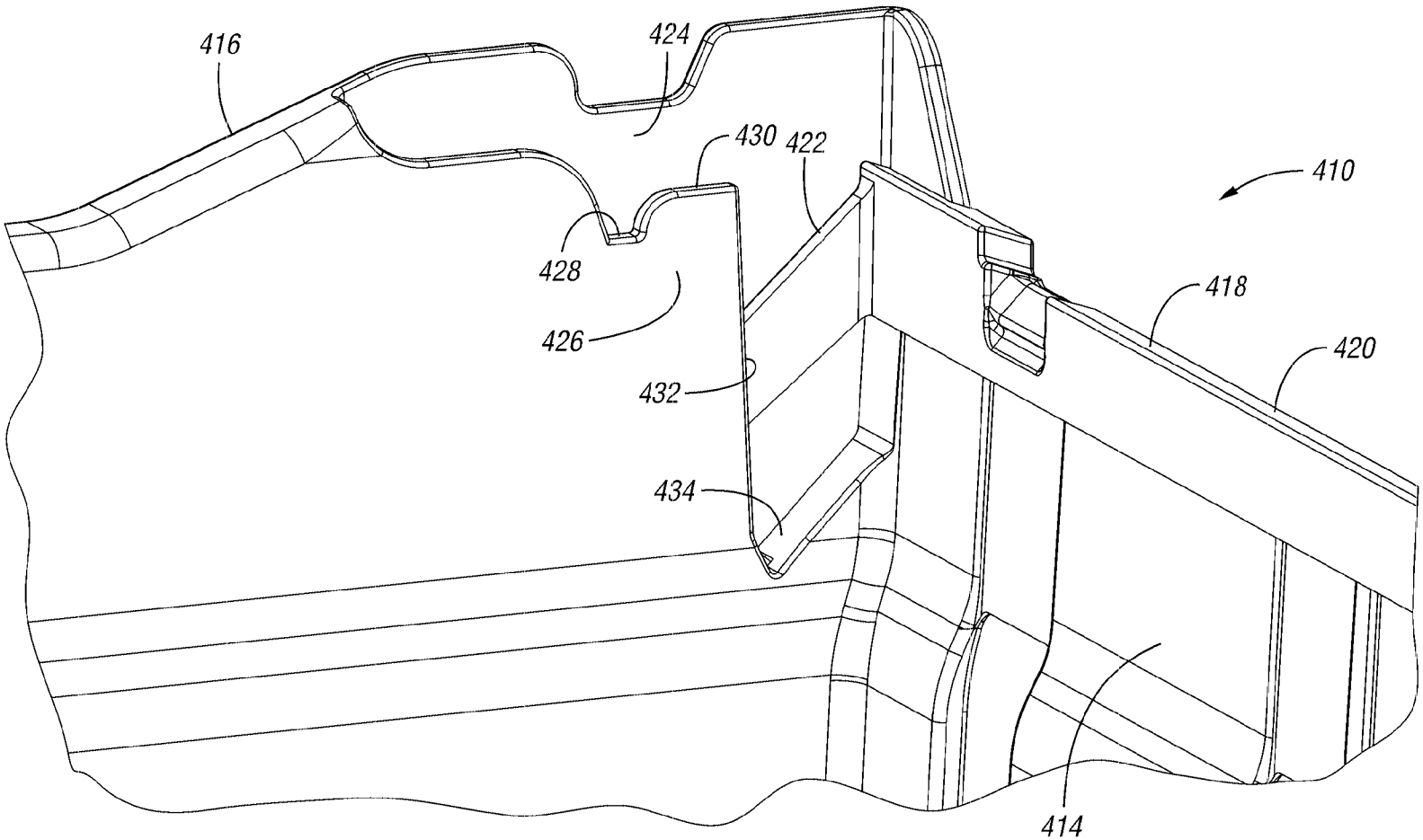
FIG. 48 is an enlarged interior view of one corner of the container of FIG. 47.

FIG. 48 is an interior view of a corner of the container 410. The side wall 416 includes an inner wall portion 426 having an upper support surface 428 with an upward projection 430 adjacent thereto. A channel 432 is formed through the inner wall portion 426 adjacent to and toward the exterior of the upward projection 430. The channel 432 is partially defined by a lower support surface 434. The support 418 includes a support portion 420 extending across the container from one side wall 416 to the other (not shown) and sitting on the end wall 414 (or alternatively could be adjacent end wall 414). The support portion 420 is pivotably and slidably connected to the side walls 416 by arms 422.

Figure 49:
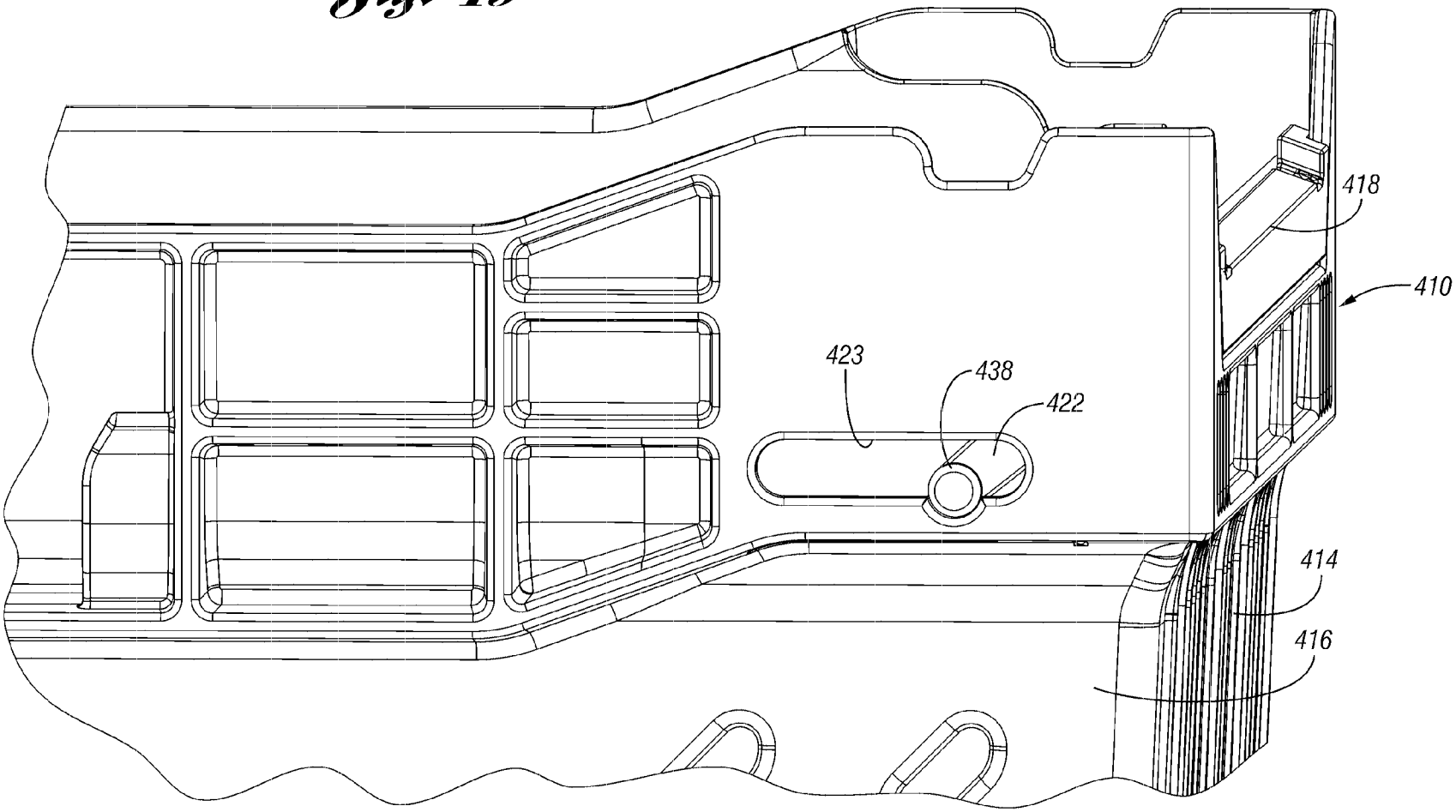
FIG. 49 is an exterior view of one corner of the container of FIG. 47.
Figure 50:
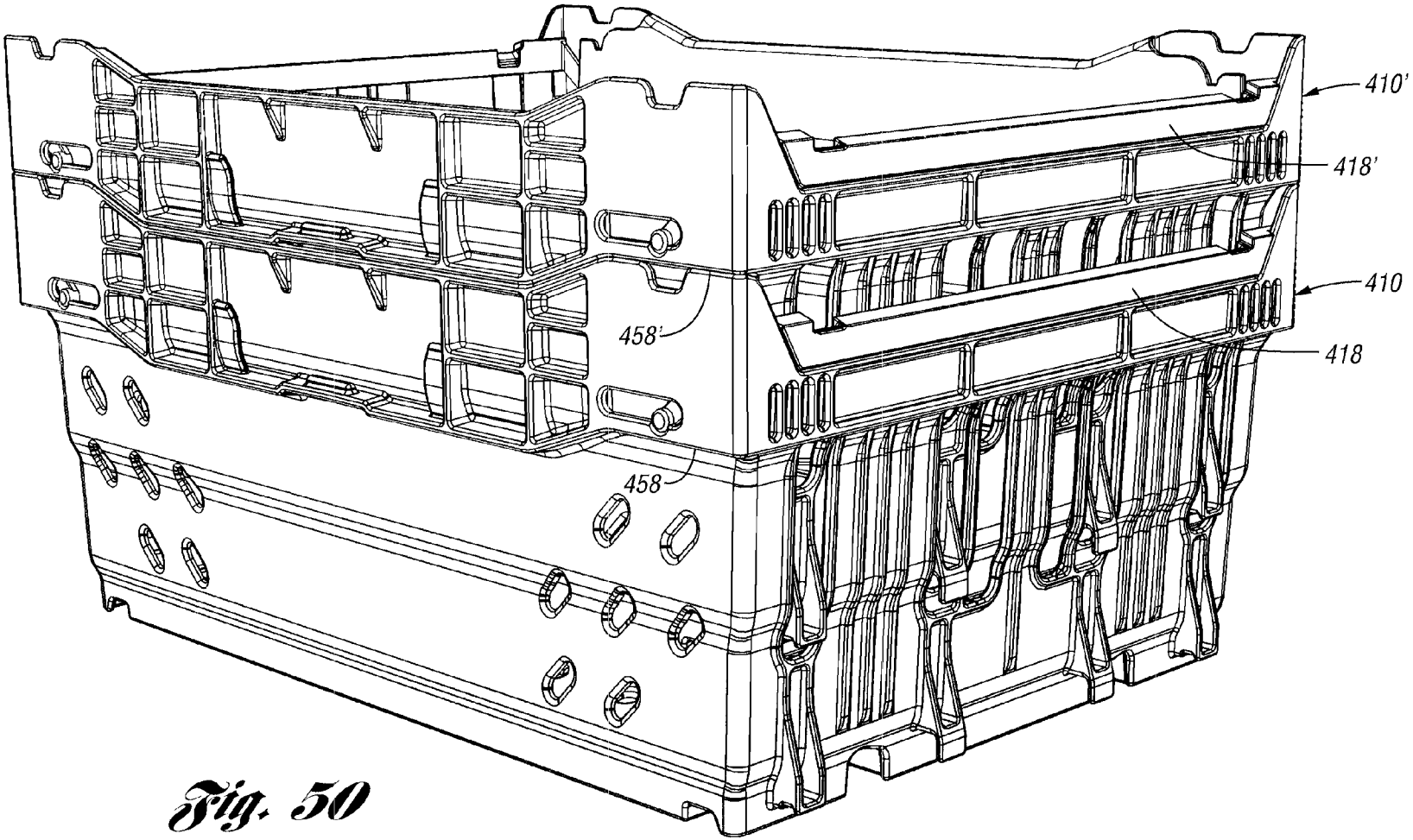
FIG. 50 is a perspective view of the container of FIG. 47 with the supports in the home position with a similar container nested therein.
Figure 51:
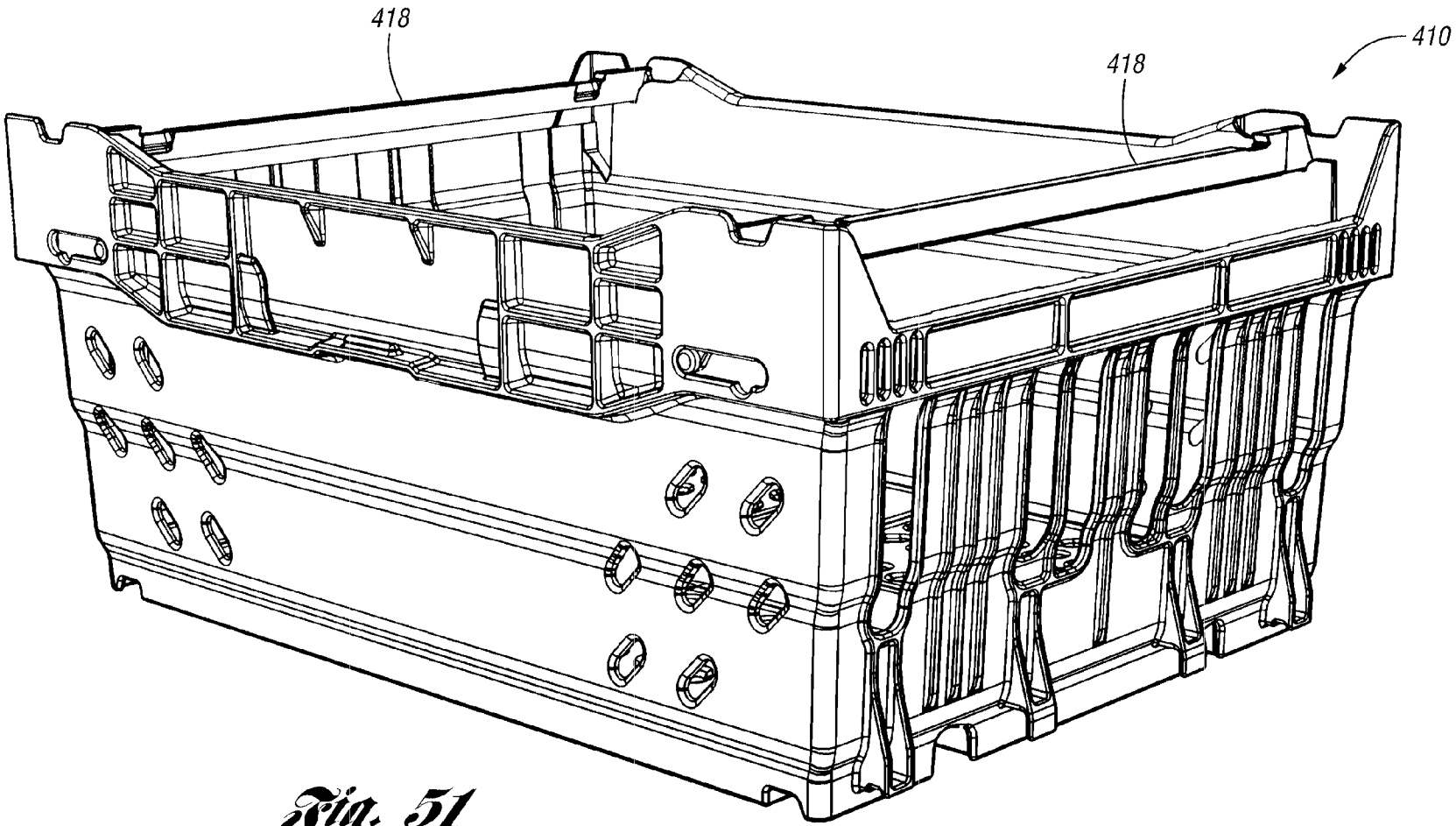
FIG. 51 is a perspective view of the container of FIG. 47 with the supports in an upper stack position.

Referring to FIG. 49, the outer portion 424 of the side wall 416 includes an opening 423 through which the pin 438 of the support 418 is received. The opening 423 is generally horizontal, which provides a simpler motion of the support 418. A recess for receiving the pin 438 is formed near, but spaced away from, the forward edge (nearest the end wall 414) of the opening 423. As shown, when the support 418 is in the home position, the pin 438 is in the recess 434. The pin 438 of the support 418 is pivotable and slidable within the opening 423. As before, with the supports 418 in the retracted position, a similar container can be nested to a position in which the band 458' of the upper container rests on the band 458 of the lower container 410, as shown in FIG. 50.

Figure 52:
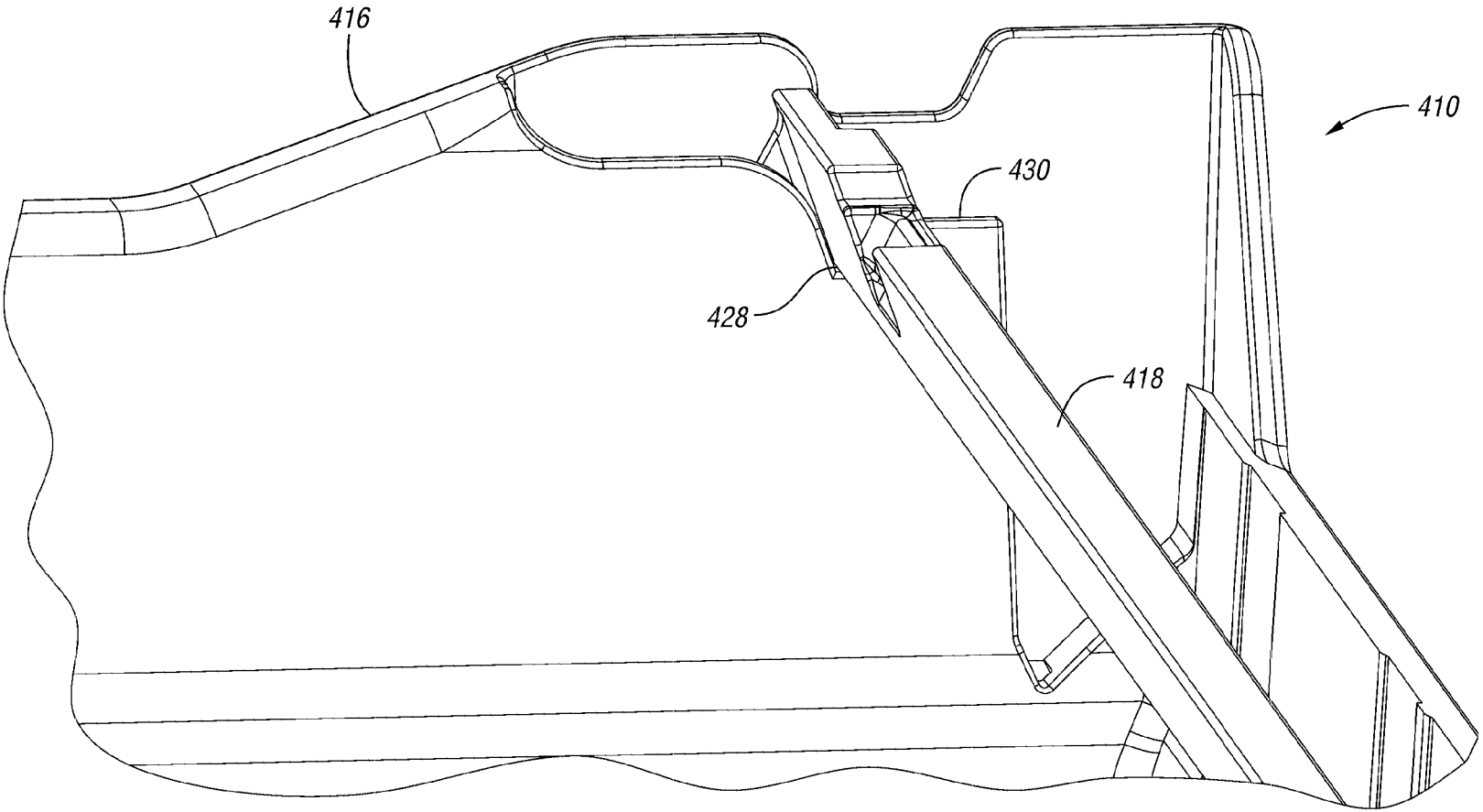
FIG. 52 is an interior corner view of the container of FIG. 47 with the support in an upper stack position.
Figure 53:
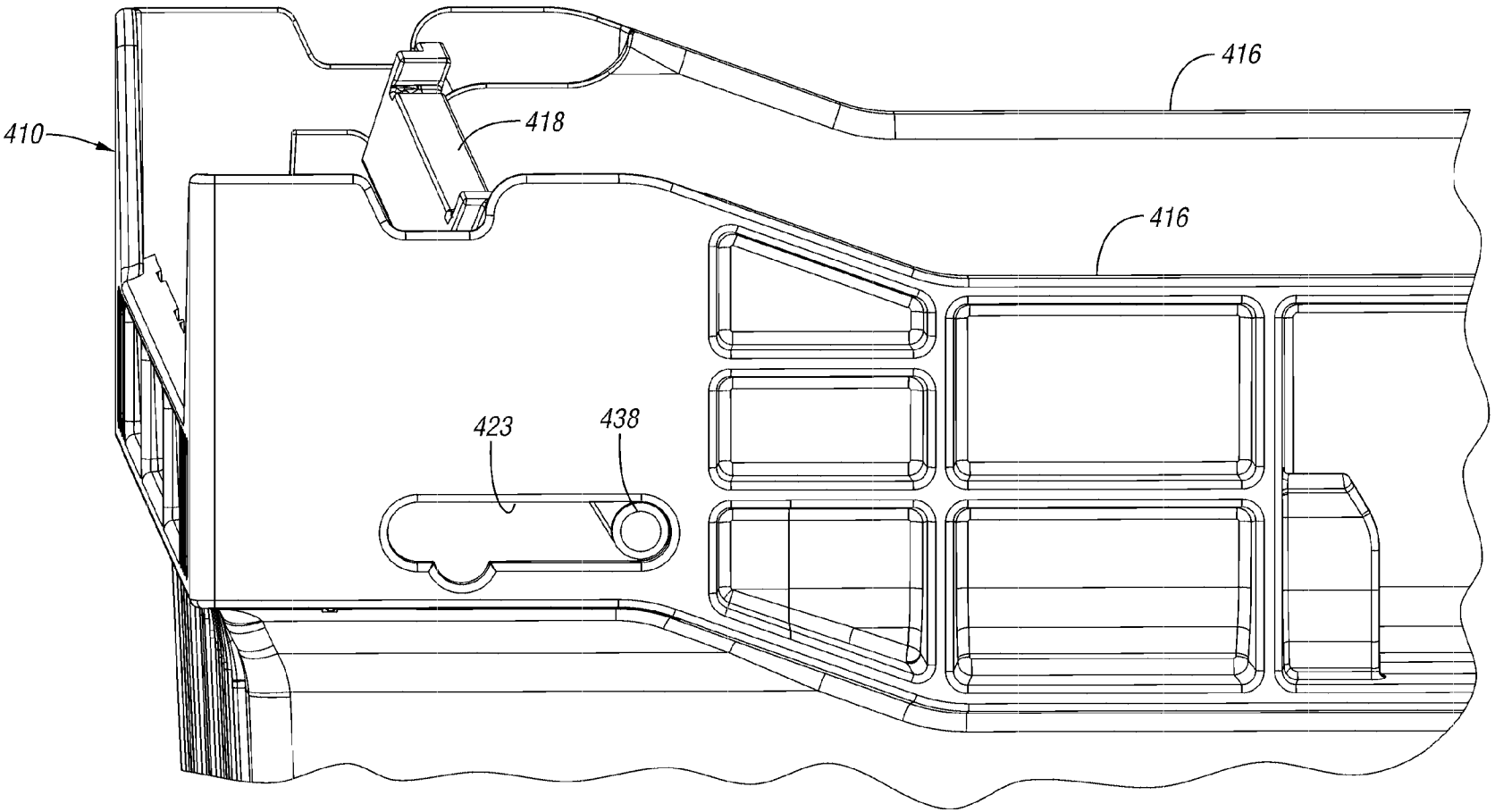
FIG. 53 is an exterior corner view of the container of FIG. 51.
Figure 54:
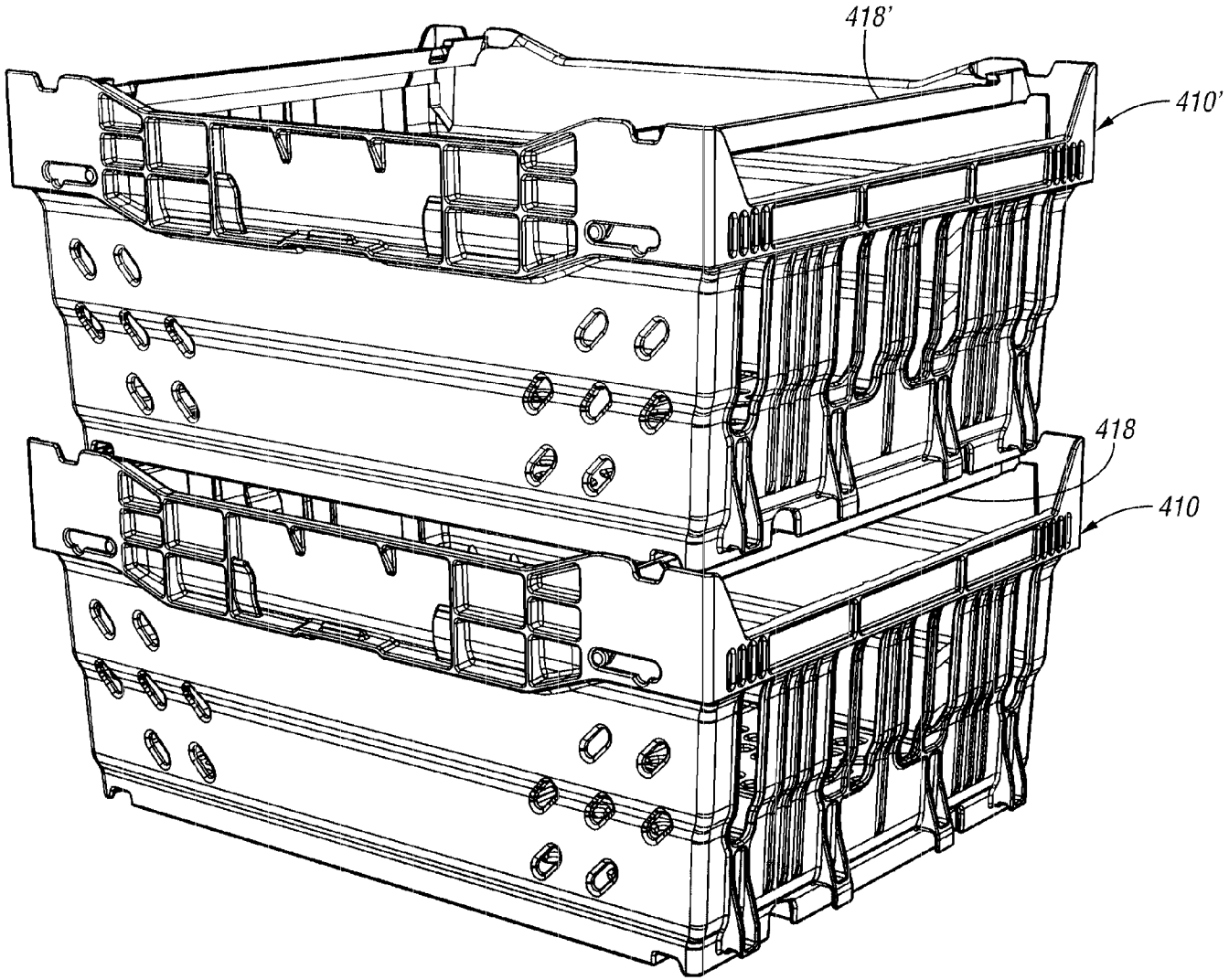
FIG. 54 is a perspective view of the container of FIG. 47 with the supports in the upper stack position and with a similar container stacked thereon.
Figure 55:
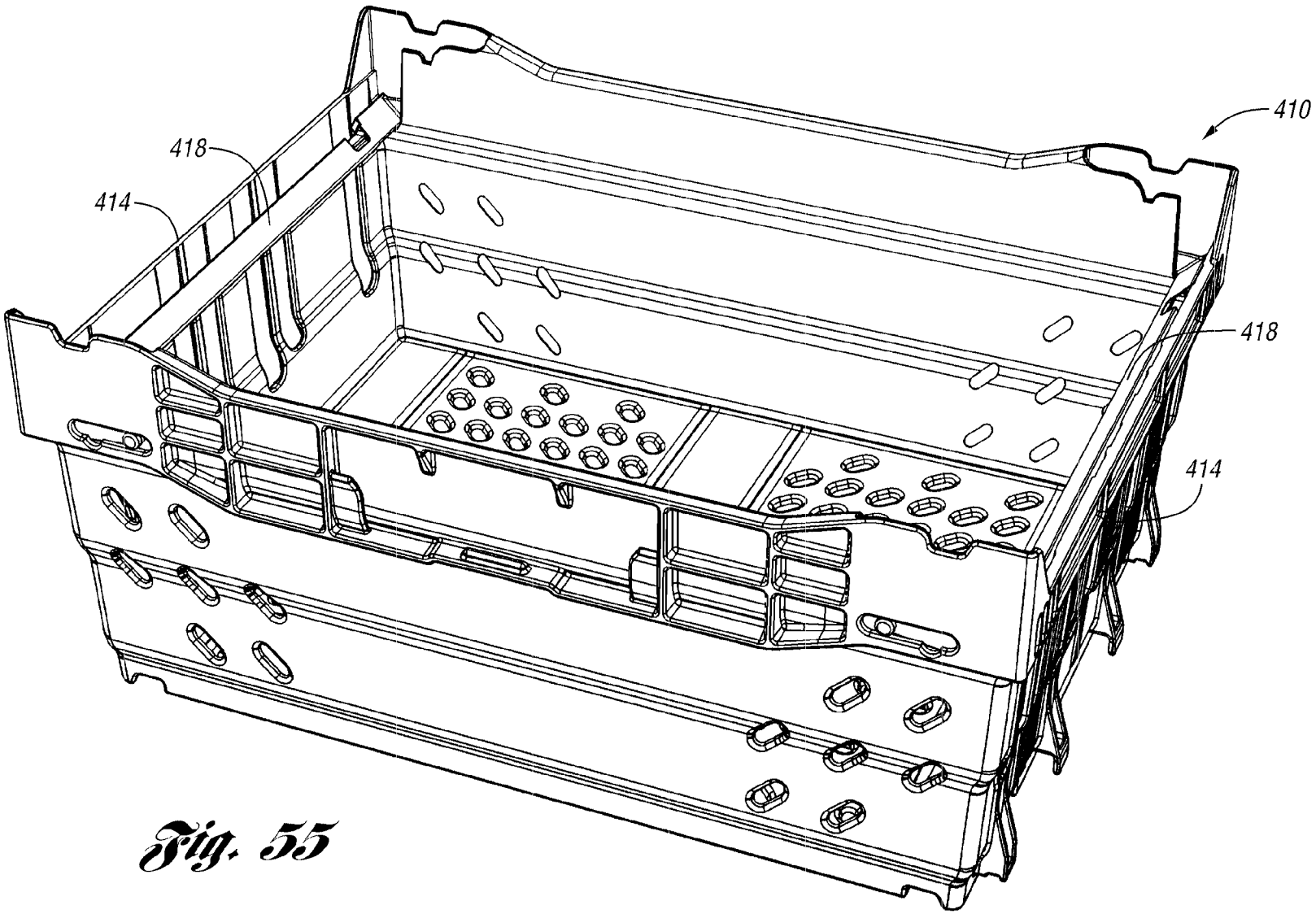
FIG. 55 is a perspective view of the container of FIG. 47 with the supports in the lower stack position.

FIGS. 51-54 illustrate the support 418 in the upper support position. Referring to FIG. 52, the support 418 is supported on the upper support surface 428 of the side wall 416. To bring the support 418 out of the home position (shown in FIG. 48), the support 418 is lifted a short height vertically (to bring pin 438 out of the recess), and then the support 418 is pushed toward the interior of the crate until the pin 438 is at the most interior edge of the opening 423. During this movement, the support portion 420 is lifted over the projection 430 and set into the upper stack position. In this embodiment, the upper surface of the support portion 420 again faces upward, and the pin 438 is inward of the support portion 420, in both the home/nest and upper stack positions. In FIG. 54, the base 412' of the upper container 410' is supported on the supports 418 to provide maximum space for products in the lower container 410.

Figure 56:
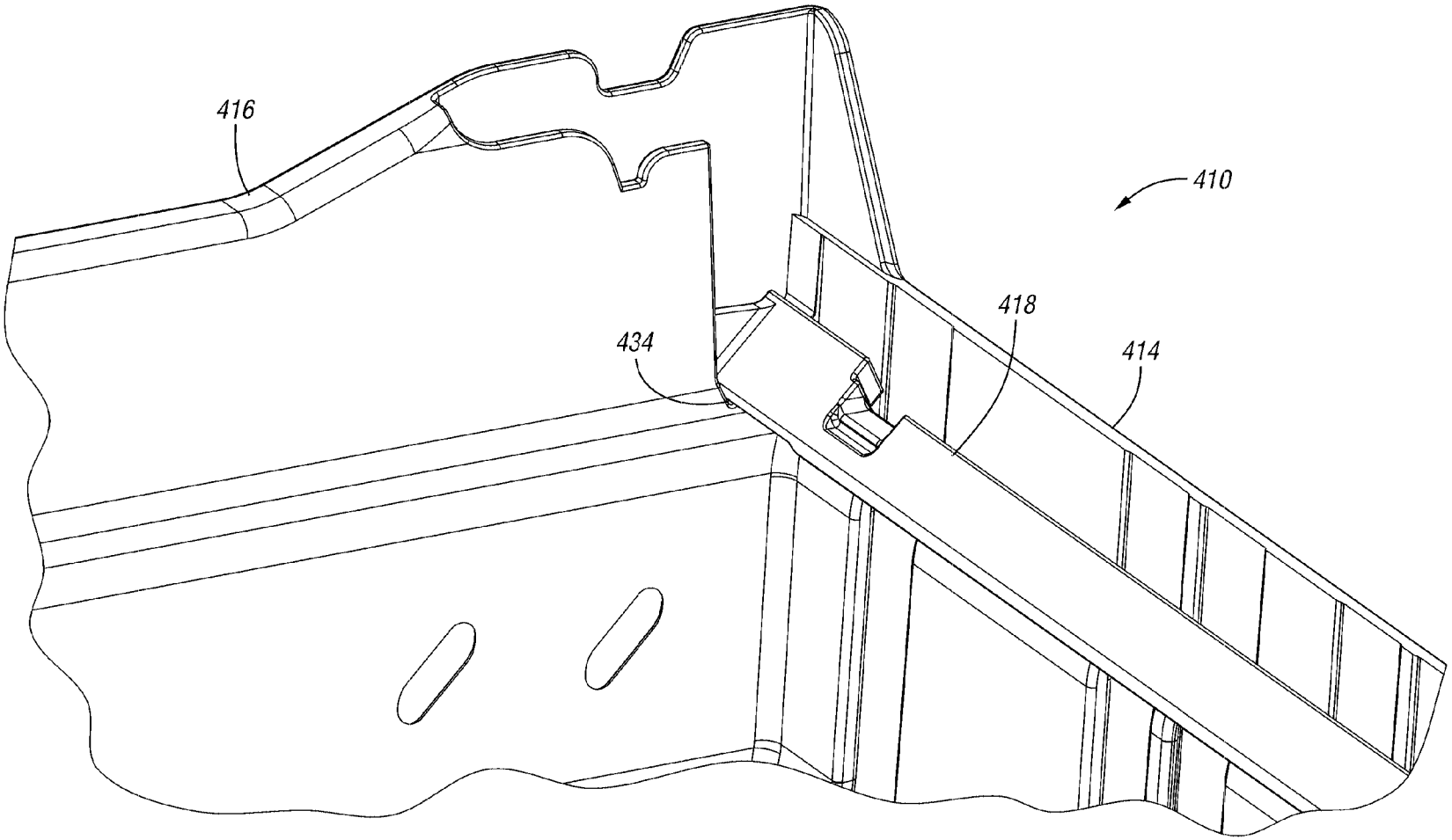
FIG. 56 is a perspective interior view of a corner of the container of FIG. 47 with the support in a lower stack position.
Figure 57:
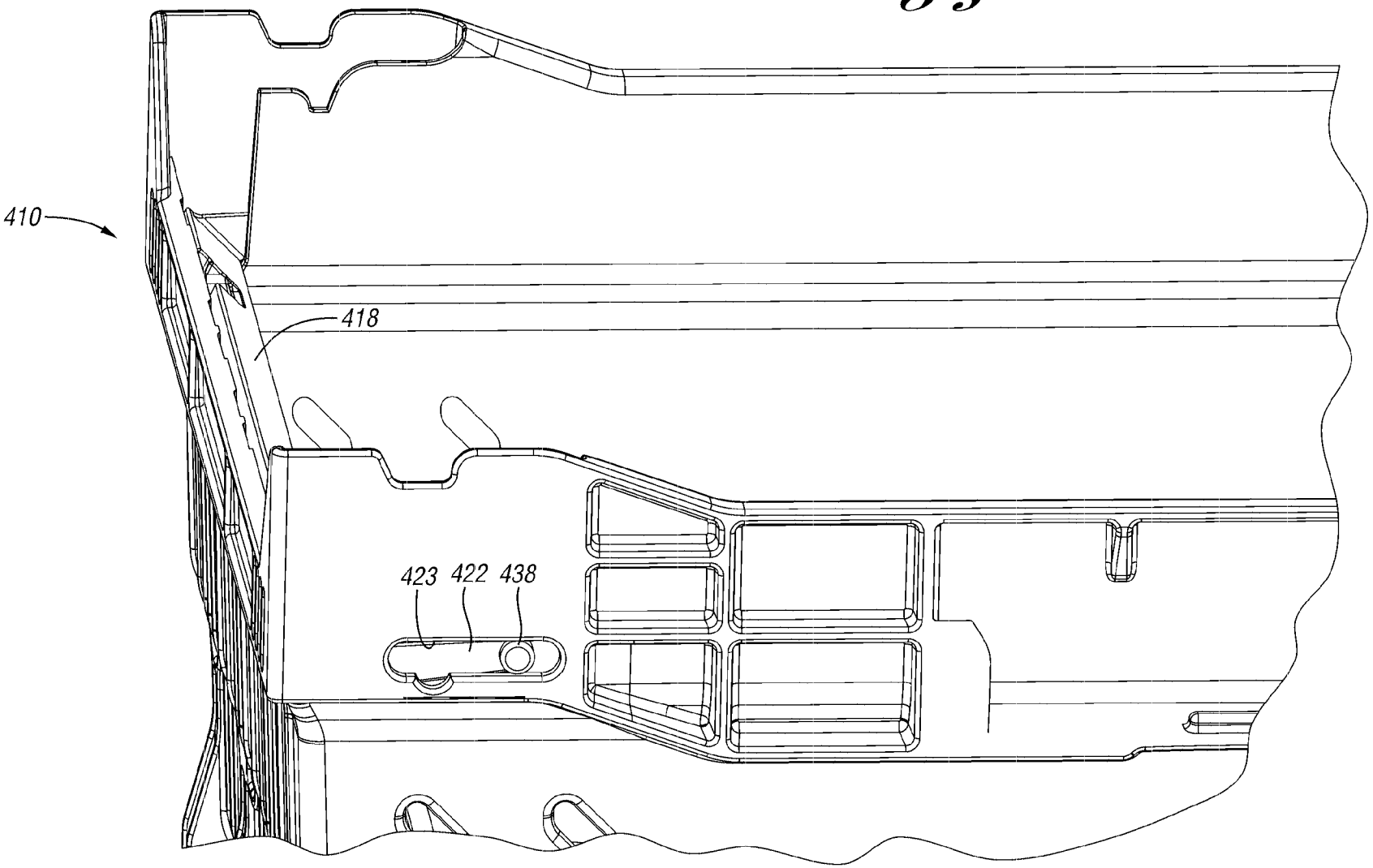
FIG. 57 is an exterior corner view of the container of FIG. 47.

FIGS. 55-59 illustrate the container 410 with the support 418 in the lower support position on the lower support surface 434 in the channel 432. Referring to FIG. 57, the pin 438 of the support 418 is pivotable and slidable within the opening 423 to the interior-most position in the opening 423, and the support 418 is then rotated downward to place the support 418 into the lower stack position, as shown in FIG. 56.

Figure 58:
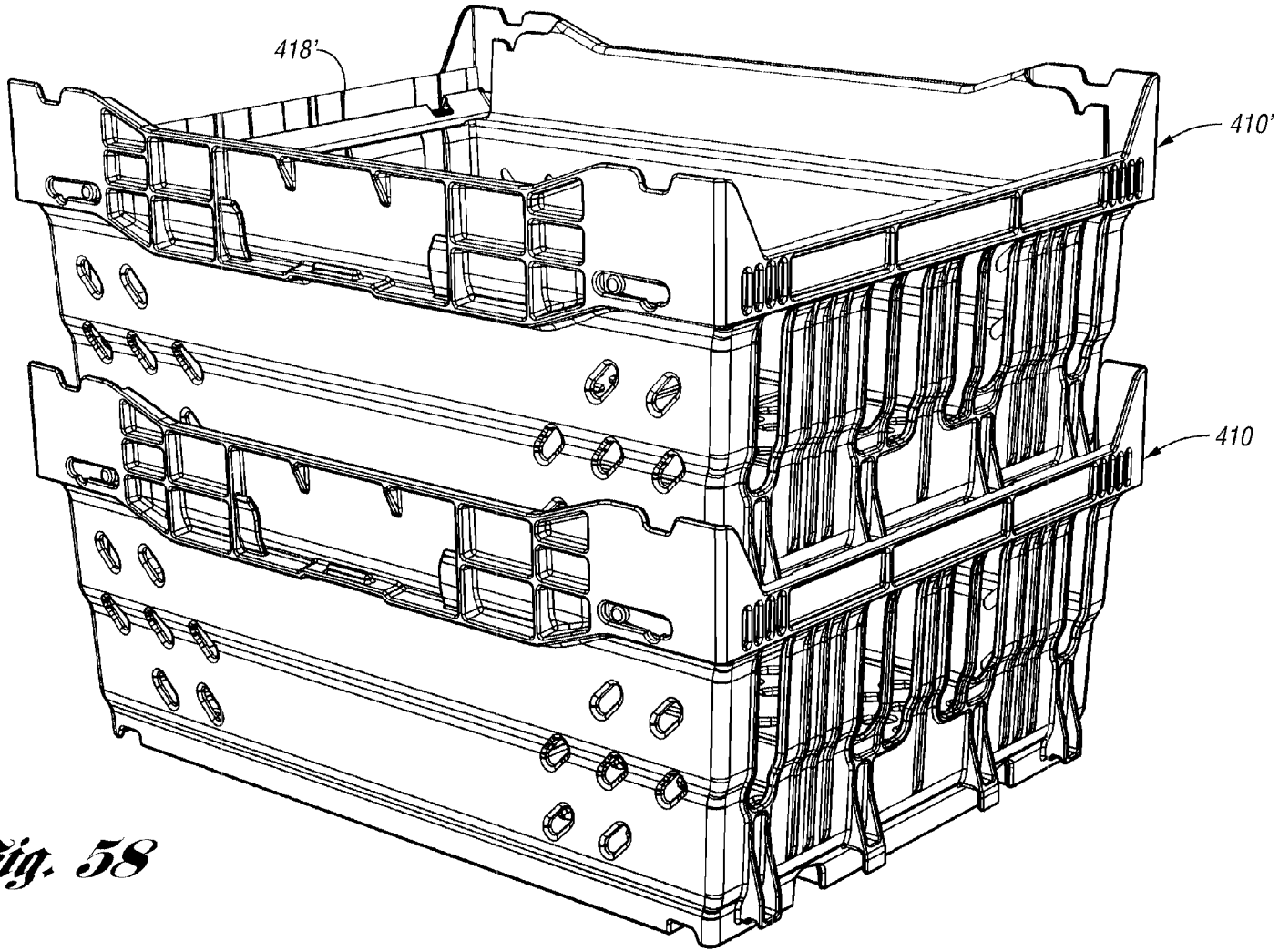
FIG. 58 is a perspective view of the container of FIG. 47 with the supports in the lower stack position and with a similar container stacked thereon.
Figure 59:
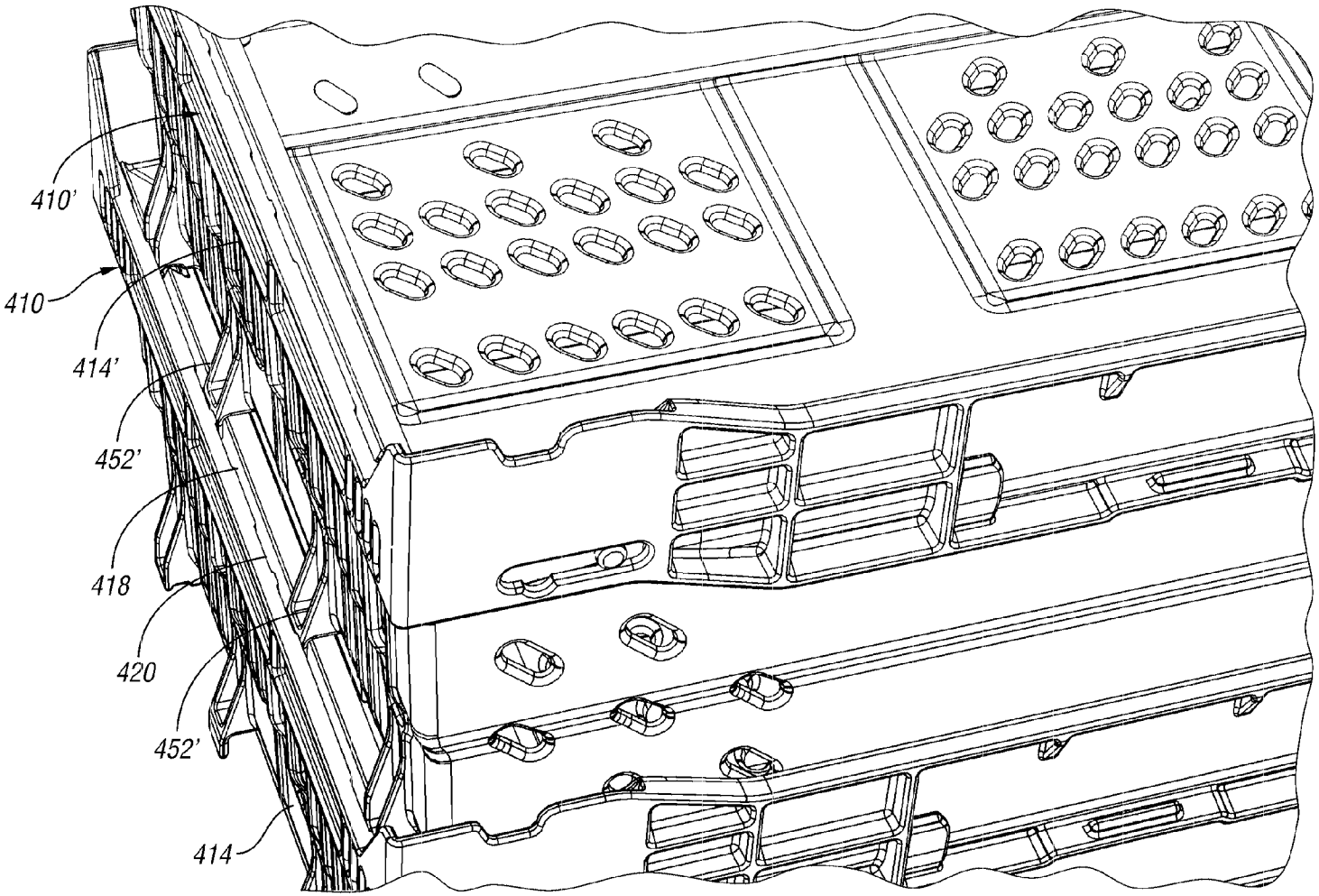
FIG. 59 is an upper perspective view of one end of the containers of FIG. 57.

In FIG. 58, the upper container 418' is stacked on the supports 418 of the lower container 418'. As can be seen in FIG. 59, the lower contact surfaces of the projections 452' on the end walls 414 of the upper container 410' are supported on the support portions 420 of the supports 418. This provides a lower stacking height of the upper container 410' on the lower container 410. This provides more efficient stacking of the containers 410 for goods in the containers 410 that do not occupy all of the volume. This reduces the overall stacking height of the containers 410.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A container comprising:

a base;

a plurality of walls extending upward from the base; and a support movable between a nesting position in which an identical container can be nested within the plurality of walls and a stack position in which an identical container can be supported on the support, wherein the support is below an uppermost edge of the plurality of walls when the support is in the stack position, wherein at least one of the plurality of walls includes at least one contact surface that can be supported on an identical container at a height higher than the nesting position, with the base of the container disposed within the plurality of walls of the identical container and below the support of the identical container, wherein the at least one contact surface can be supported on the support of the identical container in the stack position, and wherein the at least one contact surface is provided by at least one projection from the at least one of the plurality of walls.

2. The container of claim 1 wherein the stack position is a low stack position, the support also movable to a high stack position on which the base of an identical container can be supported.

3. The container of claim 1 wherein the stack position is a low stack position and wherein the support is also movable to a high stack position, wherein an upper surface of a support portion of the support faces upward in the high stack position and the nesting position.

4. The container of claim 3 wherein the upper surface of the support portion faces upward in the low stack position.

5. The container of claim 1 wherein the stack position is a low stack position and wherein the support is also movable to a high stack position, wherein the support includes a support portion extending across the container between a pair of arms each extending to a pivot pin movably connected to the container, wherein the pivot pins are toward the interior of the container relative to the support portion in the high stack position, low stack position and nesting position.

6. The container of claim 1 wherein the identical container nests in the container when the container and identical container are in a first relative orientation, and wherein the identical container stacks on support surfaces on two of the plurality of walls of the container when the container and identical container are in a second relative orientation that is 180 degrees relative to the first orientation.

7. The container of claim 6 wherein the two of the plurality of walls includes projections outwardly therefrom, the projections of the identical container stacked on the support surfaces of the two of the plurality of walls.

8. The container of claim 7 wherein the support surfaces are provided by bottom edges of first openings through the two walls.

9. The container of claim 8 wherein the projections of the identical container extend into second openings through the two walls in the first relative orientation.

10. The container of claim 1 wherein the stack position is a high stack position, the support also movable to a low stack position, wherein support is closer to a center of the container in the low stack position than the high stack position.

11. The container of claim 1 wherein the support includes a support portion extending across the container between a pair of arms movably connected to the plurality of walls, wherein the pair of arms are each U-shaped.

12. The container of claim 1 wherein the support includes a support portion extending across the container between a pair of arms movably connected to a pair of opposed walls of the plurality of walls, a pin projecting from each of the arms into an opening in one of the opposed walls, wherein the opening is generally horizontal.

13. A container comprising:

a base;

a plurality of walls extending upward from the base; and a support movable between a nesting position in which an identical container can be nested within the plurality of walls and a stack position, wherein at least one of the plurality of walls includes at least one contact surface that can be supported on the support of the identical container at a height higher than the nesting position, with the base of the container disposed within the plurality of walls of the identical container and below the support of the identical container, wherein the at least one contact surface is configured to contact a portion of one of the walls of the identical container to support the container at a first height when the container is oriented in a first orientation and wherein the container can nest in the identical container in a second orientation.

14. A container comprising:

a base;

a plurality of walls extending upward from the base; and a support movable between a nesting position in which an identical container can be nested within the plurality of walls and a stack position in which an identical container can be supported on the support, wherein an upper surface of a support portion of the support faces upwardly in the nesting position and in the stack position.

15. The container of claim 14 wherein the stack position is a high stack position, the support also movable to a low stack position, wherein support is closer to a center of the container in the low stack position than the high stack position.

16. A container comprising:

a base;

a plurality of walls extending upward from the base, wherein the plurality of walls includes a pair of opposed first walls and a pair of opposed second walls, the second walls each including a band protruding outward at an upper edge of the second wall; and a support movable between a nesting position in which an identical container can be nested within the plurality of walls and a stack position in which an identical container can be supported on the support, wherein at least one of the plurality of walls includes at least one contact surface that can be supported on an identical container at a height higher than the nesting position with the base of the container disposed within the plurality of walls of the identical container and below the support of the identical container, wherein the at least one contact surface can be supported on the support of the identical container in the stack position, and wherein the at least one contact surface is provided by at least one projection from the at least one of the plurality of walls, the support adjacent one of the first walls in the nesting position, the support protruding through an opening in each of the second walls below the band in the stack position.

17. A container comprising:

a base;

a plurality of walls extending upward from the base, wherein the walls include a band portion extending across an upper edge of the second walls;

a plurality of projections outward from two of the plurality of walls, the plurality of projections spaced below the band portion; and a pair of supports movable between a nesting position in which an identical container can be nested within the plurality of walls, a low stack position in which the plurality of projections of the identical container can be supported at a first height on the supports, and a high stack position in which the a base of the identical container can be supported at a second height on the supports.

18. The container of claim 17 wherein each support includes a support portion extending across the container between a pair of arms movably connected to the plurality of walls.

19. The container of claim 18 wherein the arms are U-shaped.

20. The container of claim 17 wherein the plurality of walls includes a pair of opposed first walls and a pair of opposed second walls, the support adjacent one of the first walls in the nesting position, the support protruding through an opening in each of the second walls in the low stack position.

21. The container of claim 20 wherein the support protrudes through the openings through the second walls below the band portion.

22. The container of claim 21 wherein an upper surface of a support portion of each support faces upward in the high stack position and the nesting position.

23. The container of claim 22 wherein the upper surface of the support portion faces downward in the low stack position.

24. A container comprising:

a base;

a plurality of walls extending upward from the base; and a support movable between a nesting position in which an identical container can be nested within the plurality of walls and a stack position in which an identical container can be supported on the support, wherein the support includes a support portion extending across the container between a pair of arms movably connected to the plurality of walls, wherein the support portion includes a tapered lower surface complementary to a tapered upper surface of an upper edge of a first wall of the plurality of walls on which the support portion of the support is received in the nesting position.

25. A container comprising:

a base;

a plurality of walls extending upward from the base, wherein two of the plurality of walls includes projections outwardly therefrom and wherein support surfaces are provided by bottom edges of first openings through the two walls; and a support movable between a nesting position and a stack position, wherein the support is configured such that an identical container can be supported on the support in the stack position and such that the identical container can nest in the container when the support is in the nesting position and the container and the identical container are in a first relative orientation, and wherein the identical container can stack on the container with a base of the identical container disposed between the plurality of walls and with projections of the identical container stacked on the support surfaces of the two of the plurality of walls of the container when the support is in the nesting position and the container and identical container are in a second relative orientation that is 180 degrees relative to the first orientation.

26. The container of claim 25 wherein the projections of the identical container would extend into second openings through the two walls in the first relative orientation.

* * * * *